US007082938B2

(12) United States Patent
Wilmot

(10) Patent No.: US 7,082,938 B2
(45) Date of Patent: Aug. 1, 2006

(54) BASEBALL FIELDING PRACTICE MACHINE

(76) Inventor: Thomas Wilmot, 76 Williams Way, Tolland, CT (US) 06084

( * ) Notice: Subject to any disclaimer, the term of this patent is extended or adjusted under 35 U.S.C. 154(b) by 0 days.

(21) Appl. No.: 10/830,807

(22) Filed: Apr. 23, 2004

(65) Prior Publication Data

US 2004/0261778 A1 Dec. 30, 2004

Related U.S. Application Data

(60) Provisional application No. 60/465,163, filed on Apr. 23, 2003, provisional application No. 60/476,027, filed on Jun. 5, 2003.

(51) Int. Cl.
*F41B 4/00* (2006.01)

(52) U.S. Cl. ..... 124/78; 124/81

(58) Field of Classification Search ..... 124/6, 124/56, 71, 72, 73, 78, 81, 83
See application file for complete search history.

(56) References Cited

U.S. PATENT DOCUMENTS

| | | | | |
|---|---|---|---|---|
| 3,018,769 | A | 1/1962 | Parsoneault | |
| 3,930,486 | A | 1/1976 | Kahelin | |
| 4,091,791 | A | 5/1978 | Castelli et al. | |
| 4,270,511 | A | 6/1981 | Ehama | |
| 4,291,665 | A * | 9/1981 | Bash et al. | 124/56 |
| 4,299,383 | A * | 11/1981 | Yuasa | 473/436 |
| 4,325,351 | A * | 4/1982 | Yuasa | 124/78 |
| 5,012,790 | A | 5/1991 | Bates | |
| 5,125,653 | A * | 6/1992 | Kovacs et al. | 124/78 |
| 5,437,261 | A | 8/1995 | Paulson et al. | |
| 5,722,384 | A | 3/1998 | Cox | |
| 5,771,621 | A | 6/1998 | Rogers | |
| 6,202,636 | B1 | 3/2001 | O'Brien | |
| 6,440,013 | B1 | 8/2002 | Brown | |
| 6,470,873 | B1 | 10/2002 | Battersby et al. | |
| 6,539,931 | B1 * | 4/2003 | Trajkovic et al. | 124/34 |
| 6,546,924 | B1 * | 4/2003 | Battersby et al. | 124/78 |
| 6,830,044 | B1 * | 12/2004 | Hansen et al. | 124/56 |
| 2002/0148455 | A1 | 10/2002 | Trajkovic et al. | |
| 2003/0004017 | A1 | 1/2003 | Brown | |

* cited by examiner

*Primary Examiner*—John A. Ricci
(74) *Attorney, Agent, or Firm*—McCormick, Paulding & Huber LLP

(57) ABSTRACT

The present invention provides a baseball practice machine for propelling balls onto a practice field thereby providing simulated hits for use in fielding practice for ball players. The practice machine includes a ball hopper, a propulsion unit for propelling a ball toward a practice field, a movable barrel through which a ball is propelled. A barrel positioner is coupled to the propulsion unit and the movable barrel for adjusting the position of the barrel thereby controlling the trajectory of a propelled ball. A programmable control system controls the operation of the practice machine. Trajectory parameters for the propelled balls are selected from predetermined parameters defining the path of the ball to a location of a practice field where the ball is intended to land. Information defining the dimensions of a practice field are stored in a memory of the control system and used in determining the trajectory parameters.

17 Claims, 44 Drawing Sheets

293

Fielder's Choice Control Logic Matrix

| Game Situation | Horizontal Direction (Degrees from CL) | Vertical Angle (of Projection Mechanism) | Tire Speed* | Deflector #1 | Deflector #2 |
|---|---|---|---|---|---|
| 1B Ground | R45 - R 22 | P45 - N45 | 0 - 99 MPH | Not Likely | Possible |
| 1B Bunt | R45 - R 22 | P45 - N45 | 0 - 99 MPH | Not Likely | Possible |
| 1B Foul | R60 - R45 | P60 - P25 | 0 - 99 MPH | Possible | Not Needed |
| 1B Pop Up | R60 - R30 | P60 - P25 | 0 - 99 MPH | Possible | Not Needed |
| 1B Liner | R45 - R 22 | P15 - N05 | 0 - 99 MPH | Not Needed | Not Needed |
| 1B Runner | R60 - R30 | P60 - P25 | 0 - 99 MPH | Possible | Not Needed |
| 1B P. Cover | R45 - R 22 | P45 - N45 | 0 - 99 MPH | Not Likely | Possible |
| 1B Double | R45 - R 22 | P45 - N45 | 0 - 99 MPH | Not Likely | Possible |
| 1B Tough | R60 - R30 | P65 - N45 | 0 - 99 MPH | Possible | Possible |
| 2B Ground | R30 - L05 | P45 - N45 | 0 - 99 MPH | Not Likely | Possible |
| 2B Foul | R60 - R45 | P60 - P25 | 0 - 99 MPH | Possible | Not Needed |
| 2B Pop Up | R60 - L05 | P60 - P25 | 0 - 99 MPH | Possible | Not Needed |
| 2B Liner | R30 - L05 | P15 - N05 | 0 - 99 MPH | Not Needed | Not Needed |
| 2B Runner | R40 - L05 | P60 - P25 | 0 - 99 MPH | Possible | Not Needed |
| 2B Double | R30 - L05 | P45 - N45 | 0 - 99 MPH | Not Likely | Possible |
| 2B Tough | R60 - L05 | P65 - N45 | 0 - 99 MPH | Possible | Possible |
| SS Ground | R05 - L30 | P45 - N45 | 0 - 99 MPH | Not Likely | Possible |
| SS Foul | L45 - L60 | P60 - P25 | 0 - 99 MPH | Possible | Not Needed |
| SS Pop Up | R05 - L60 | P60 - P25 | 0 - 99 MPH | Possible | Not Needed |
| SS Liner | R05 - L30 | P15 - N05 | 0 - 99 MPH | Not Needed | Not Needed |
| SS Runner | R05 - L60 | P60 - P25 | 0 - 99 MPH | Possible | Not Needed |
| SS Double | R05- L30 | P45 - N45 | 0 - 99 MPH | Not Likely | Possible |
| SS Tough | R05 - L60 | P65 - N45 | 0 - 99 MPH | Possible | Possible |
| 3B Ground | L22 - L45 | P45 - N45 | 0 - 99 MPH | Not Likely | Possible |
| 3B Bunt | L22 - L45 | P45 - N45 | 0 - 99 MPH | Not Likely | Possible |
| 3B Foul | L45 - L60 | P60 - P25 | 0 - 99 MPH | Possible | Not Needed |
| 3B Pop Up | L22 - L60 | P60 - P25 | 0 - 99 MPH | Possible | Not Needed |
| 3B Liner | L22 - L45 | P15 - N05 | 0 - 99 MPH | Not Needed | Not Needed |
| 3B Runner | L22 - L60 | P60 - P25 | 0 - 99 MPH | Possible | Not Needed |
| 3B Double | L22 - L45 | P45 - N45 | 0 - 99 MPH | Not Likely | Possible |
| 3B Tough | L22 - L60 | P65 - N45 | 0 - 99 MPH | Possible | Possible |
| C. Bunt | R45 - L45 | P05 - N45 | 0 - 99 MPH | Not Likely | Possible |
| C. Pop Up | R60 - L60 | P65 - P40 | 0 - 99 MPH | Possible | Not Needed |
| C. Fouls | R60 - L60 | P65 - P40 | 0 - 99 MPH | Possible | Not Needed |
| C. Chops | R45 - L45 | N30 - N45 | 0 - 99 MPH | Not Likely | Possible |
| C. Tough | R60 - L60 | P65 - N45 | 0 - 99 MPH | Possible | Possible |
| P. Ground | R25 - L25 | P45 - N45 | 0 - 99 MPH | Not Likely | Possible |
| P. Bunt | R45 - L45 | P45 - N45 | 0 - 99 MPH | Not Likely | Possible |
| P. Pop Up | R60 - L60 | P60 - P50 | 0 - 99 MPH | Possible | Not Needed |

FIG. 19B

293

| Game Situation | Horizontal Direction (Degrees from CL) | Vertical Angle (of Projection Mechanism) | Tire Speed* | Deflector #1 | Deflector #2 |
|---|---|---|---|---|---|
| P. Liner | R25 - L25 | P15 - N05 | 0 - 99 MPH | Not Needed | Not Needed |
| P. Tough | R60 - L60 | P65 - N45 | 0 - 99 MPH | Possible | Possible |
| LF Fly Ball | L15 - L60 | P65 - P30 | 0 - 99 MPH | Not Likely | Not Needed |
| LF Ground | L15 - L60 | P50 - P05 | 0 - 99 MPH | Not Needed | Not Needed |
| LF Gappers | L15 - L25 | P55 - P05 | 0 - 99 MPH | Not Likely | Not Needed |
| LF Fouls | L45 - L60 | P65 - P30 | 0 - 99 MPH | Possible | Not Needed |
| LF Liners | L15 - L45 | P45 - P05 | 0 - 99 MPH | Not Needed | Not Needed |
| LF Runners | L15 - L60 | P65 - P30 | 0 - 99 MPH | Possible | Not Needed |
| LF Sac Fly | L15 - L60 | P65 - P30 | 0 - 99 MPH | Not Likely | Not Needed |
| LF Wrn. Tr. | L15 - L60 | P65 - P30 | 0 - 99 MPH | Not Likely | Not Needed |
| LF Tough | L15 - L60 | P65 - P05 | 0 - 99 MPH | Possible | Not Needed |
| CF Fly Ball | R25 - L25 | P65 - P30 | 0 - 99 MPH | Not Likely | Not Needed |
| CF Ground | R25 - L25 | P50 - P05 | 0 - 99 MPH | Not Needed | Not Needed |
| CF Gappers | R25 - L25 | P55 - P05 | 0 - 99 MPH | Not Likely | Not Needed |
| CF Liners | R25 - L25 | P45 - P05 | 0 - 99 MPH | Not Needed | Not Needed |
| CF Runners | R25 - L25 | P65 - P30 | 0 - 99 MPH | Possible | Not Needed |
| CF Sac Fly | R25 - L25 | P65 - P30 | 0 - 99 MPH | Not Likely | Not Needed |
| CF Wrn. Tr. | R25 - L25 | P65 - P30 | 0 - 99 MPH | Not Likely | Not Needed |
| CF Tough | R25 - L25 | P65 - P05 | 0 - 99 MPH | Possible | Not Needed |
| RF Fly Ball | R60 - R15 | P65 - P30 | 0 - 99 MPH | Not Likely | Not Needed |
| RF Ground | R45 - R15 | P50 - P05 | 0 - 99 MPH | Not Needed | Not Needed |
| RF Gappers | R25 - R15 | P55 - P05 | 0 - 99 MPH | Not Likely | Not Needed |
| RF Fouls | R60 - R45 | P65 - P30 | 0 - 99 MPH | Possible | Not Needed |
| RF Liners | R45 - R15 | P45 - P05 | 0 - 99 MPH | Not Needed | Not Needed |
| RF Runners | R60 - R15 | P65 - P30 | 0 - 99 MPH | Possible | Not Needed |
| RF Sac Fly | R60 - R15 | P65 - P30 | 0 - 99 MPH | Not Likely | Not Needed |
| RF Wrn. Tr. | R60 - R15 | P65 - P30 | 0 - 99 MPH | Not Likely | Not Needed |
| RF Tough | R60 - R15 | P65 - P05 | 0 - 99 MPH | Not Likely | Not Needed |
| BS First | R050 - R40 | P05 - N05 | 0 - 99 MPH | Not Needed | Not Needed |
| BS Second | R05 - L05 | P05 - N05 | 0 - 99 MPH | Not Needed | Not Needed |
| BS Third | L40 - L 50 | P05 - N05 | 0 - 99 MPH | Not Needed | Not Needed |
| P Left | L04 - L02 | P04 - N04 | 0 - 99 MPH | Not Needed | Not Needed |
| P Middle | L02 - R02 | P04 - N04 | 0 - 99 MPH | Not Needed | Not Needed |
| P Right | R02 - R04 | P04 - N04 | 0 - 99 MPH | Not Needed | Not Needed |
| P Low | L04 - R04 | N02 - N04 | 0 - 99 MPH | Not Needed | Not Needed |
| P Center | L04 - R04 | P02 - N02 | 0 - 99 MPH | Not Needed | Not Needed |
| P High | L04 - R04 | P04 - P02 | 0 - 99 MPH | Not Needed | Not Needed |

FIG. 19B cont.

BASEBALL FIELDING PRACTICE MACHINE

CROSS REFERENCE TO RELATED APPLICATIONS

This application claims priority to U.S. Provisional Patent Application Nos. 60/465,163 filed on Apr. 23, 2003 entitled "Fielding Practice Machine" and 60/476,027 filed on Jun. 5, 2003 entitled "Practice Machines for Sports". The disclosure of each of the above-identified provisional applications is incorporated herein by reference.

FIELD OF THE INVENTION

The present invention generally relates to a practice machine for use with baseball players, and more particularly to a baseball fielding practice machine that is positionable at a predetermined location on a practice field for propelling balls toward the practice field. The present invention practice machine provides simulated hits for use in fielding practice for baseball players.

BACKGROUND OF THE INVENTION

Generally, machines for projecting baseballs are well known in the art and include mostly pitching machines designed to simulate pitches for use in batting practice for baseball players. Normally, this type of machine can be set to control the speed and a spin imparted to a baseball for simulating various pitches such as a fastball, curveball, or slider. In most pitching machines, the trajectory of a propelled ball is set by manually aiming a barrel of the pitching machine toward a target such as home plate on a baseball field.

Currently used pitching or ball-throwing machines usually employ one of various known types of propulsion devices for projecting baseballs or softballs from the machine. Known propulsion devices suitable for use with pitching machines include spring actuated arm mechanisms, devices employing one or more rotating wheels, devices utilizing pressurized gases, and machines employing rotating discs.

Most currently used pitching or ball-throwing machines are adjustable for changing the parameters of a propelled ball including the speed, spin and trajectory of the ball. However, in most machines, such adjustments normally require manually adjusting the speed of wheels used to propel a ball or the angular position of a barrel of the machine. Thus, most prior art pitching and ball-throwing machines do not employ a control system for adjusting the parameters of a ball propelled from the machine.

Although, many of the above-described prior art pitching or ball-throwing machines can be positioned to project balls to simulate ground balls, pop-ups or other types of hits for use in fielding practice for baseball players, none of the above-described prior art pitching or ball throwing machines incorporate a control system for providing automated fielding practice for ball players.

Another disadvantage associated with most prior art pitching or ball throwing machines is that most of the prior art machines do not include a scoreboard for displaying information related to a simulated game situation so that players in a fielding practice session can practice as if in a real game situation.

Based on the foregoing, it is the general object of the present invention to provide a baseball fielding practice machine that improves upon, or overcomes the problems and drawbacks associated with prior art pitching or ball-throwing machines.

SUMMARY OF THE INVENTION

The present invention is directed to a baseball fielding practice machine for propelling balls onto a practice field thereby providing simulated hits for use in fielding practice for ball players. The practice machine includes a ball hopper for storing balls and a propulsion unit for imparting a velocity and spin on a ball. The propulsion unit is mounted adjacent a movable barrel for propelling balls through the movable barrel. A barrel positioner is coupled to the movable barrel and the propulsion unit and is controllable for adjusting the position of the barrel and the propulsion unit thereby controlling the trajectory of a propelled ball.

A programmable control system controls the operation of the practice machine including all components thereof. The control system controls the operation of both of the propulsion unit and the barrel positioner to impart a velocity, trajectory and spin to a ball for propelling the ball from the practice machine toward an intended location on a practice field. The velocity, trajectory and spin for each ball propelled from the practice machine are selected from predetermined trajectory parameters. The trajectory parameters define the intended trajectory of a propelled ball for propelling the ball toward a location in the practice field where the ball is intended to land.

The control system includes an input device for inputting data to the control system including dimensions of the practice field. The control system uses the inputted field dimensions to calculate the velocity and the trajectory of the propelled balls. Accordingly, the control system, utilizing inputted field dimensions for a particular field, will propel balls only toward locations within a predefined practice field which may include designated areas of foul territory of the practice field.

In one embodiment of the present invention, the practice machine includes a deflector coupled to the movable barrel and the control system. The deflector is operable for changing the trajectory of a ball propelled from the propulsion unit and can be used with predetermined trajectory parameters or when a selected trajectory requires use of the deflector to provide the required trajectory.

The practice machine also includes a scoreboard coupled to the control system for displaying information related to a simulated game situation to ball players in the practice field. The information displayed on the scoreboard includes at least one of a score, an inning number, a number of outs, and a location of any base runners. The scoreboard is useful for simulating real game situations so that the balls propelled from the practice machine can be fielded and /or played by position players according to a game situation displayed on the scoreboard. The scoreboard can also be used in conjunction with various practice modes discussed below.

The programmable control system includes various user selectable practice modes in which the control system selects trajectory parameters from predetermined ranges of trajectory parameters for propelling balls one after the other toward random or selected locations of the practice field. For example, in a Team mode, the control system can be programmed to randomly select trajectory parameters for propelling a series of balls to random locations throughout the practice field for providing simulated hits toward random locations in a practice field. The Team practice mode is used in a fielding practice session directed to all of the player positions of an entire baseball team.

Additionally, various practice modes are selectable wherein the control system is programmed to select trajectory parameters for propelling balls one after the other toward selected locations of the practice field such as specific areas of the practice field designated in accordance with typical player positions.

The control system also includes a start-up program for initializing the practice machine. In the start-up mode, the control system provides for user input of certain information such as the shape and dimensions of a practice field, the game intended to be played, e.g. baseball, softball, and the skill level of the intended players. Additionally, the start-up program provides for user input of safety settings such as maximum ball speeds, etc. The start-up program stores the user input data and initializes the control system accordingly.

The practice machine can be positioned at home plate and aligned with the first and third base lines of a practice field. Once the practice machine is positioned relative to the practice field and initialized, one or more practice modes can be selected and activated. In a typical practice mode, a series of balls are propelled from the practice machine toward predetermined locations on the practice field including designated player positions. Alternatively, the machine can propel balls toward random locations throughout the practice field.

Various practice modes are provided wherein a coach or other user can pre-program a practice session by selecting trajectory parameters for a plurality of balls to be propelled from the practice machine toward the practice field at predetermined time intervals. The control system can also be operated from a remote location using a remote control device. Additionally, the practice machine can be used in accordance with predefined practice modes that include stored trajectory parameters defining trajectories of typical hits.

The present invention practice machine can simulate practically any type of hit to substantially all locations of a practice field. Thus, the practice machine can be used to conduct a baseball fielding practice session that efficiently provides simulated hits at various trajectories to all of the player positions of the practice field.

BRIEF DESCRIPTION OF THE DRAWINGS

The foregoing an still other objects and advantages of the present invention will be more apparent from the detailed explanation of the preferred embodiments of the invention in connection with the accompanying drawings wherein throughout the figures, like reference numerals describe like elements of the invention.

FIG. 19B is a chart showing one embodiment of predetermined ranges of trajectory parameters corresponding to various player positions on a practice field and various simulated hits for each of the player positions.

DESCRIPTION OF THE PREFERRED EMBODIMENTS

Figure 1:
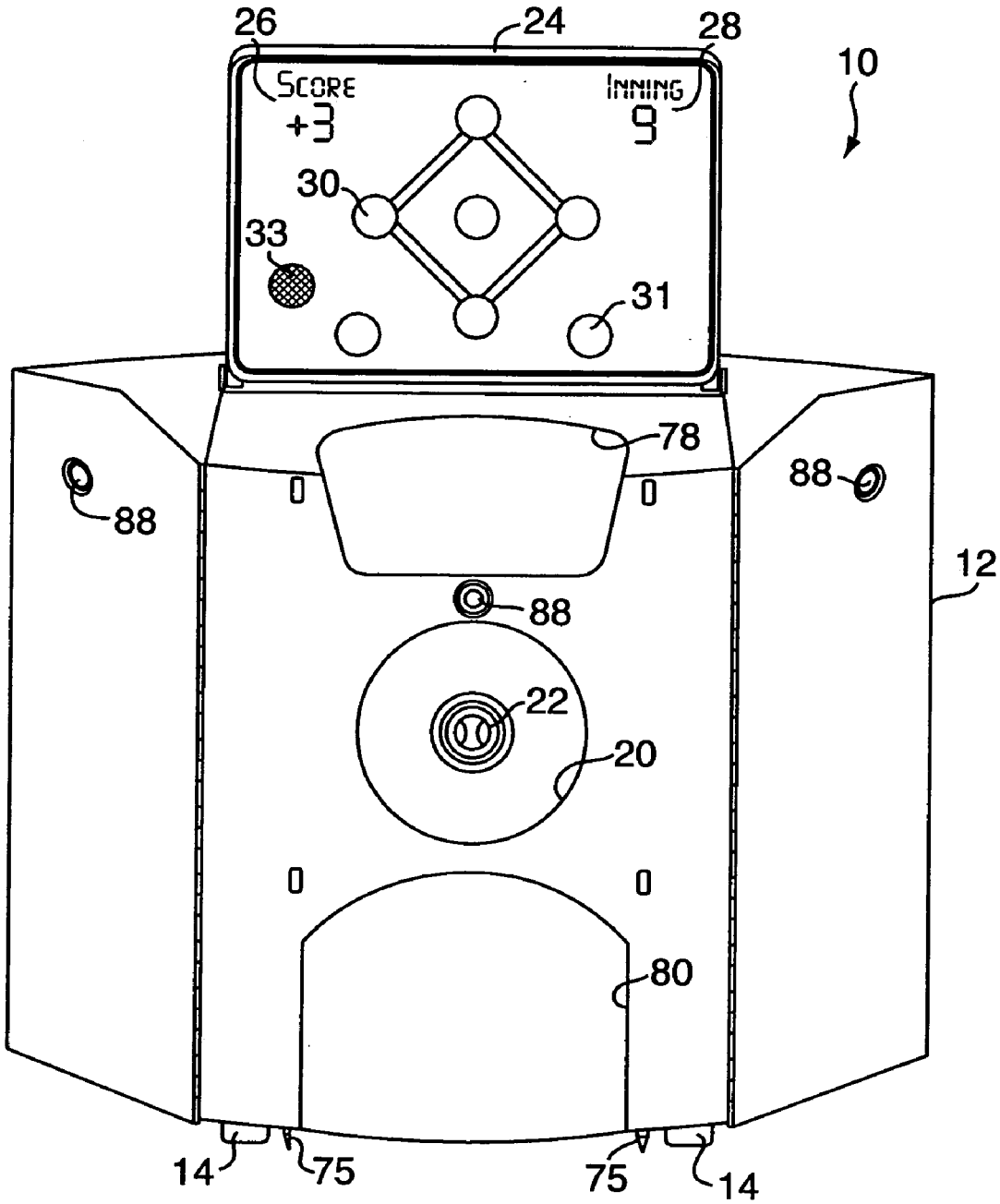
FIG. 1 is a front view of one embodiment of a baseball practice machine according to the present invention.
Figure 2:
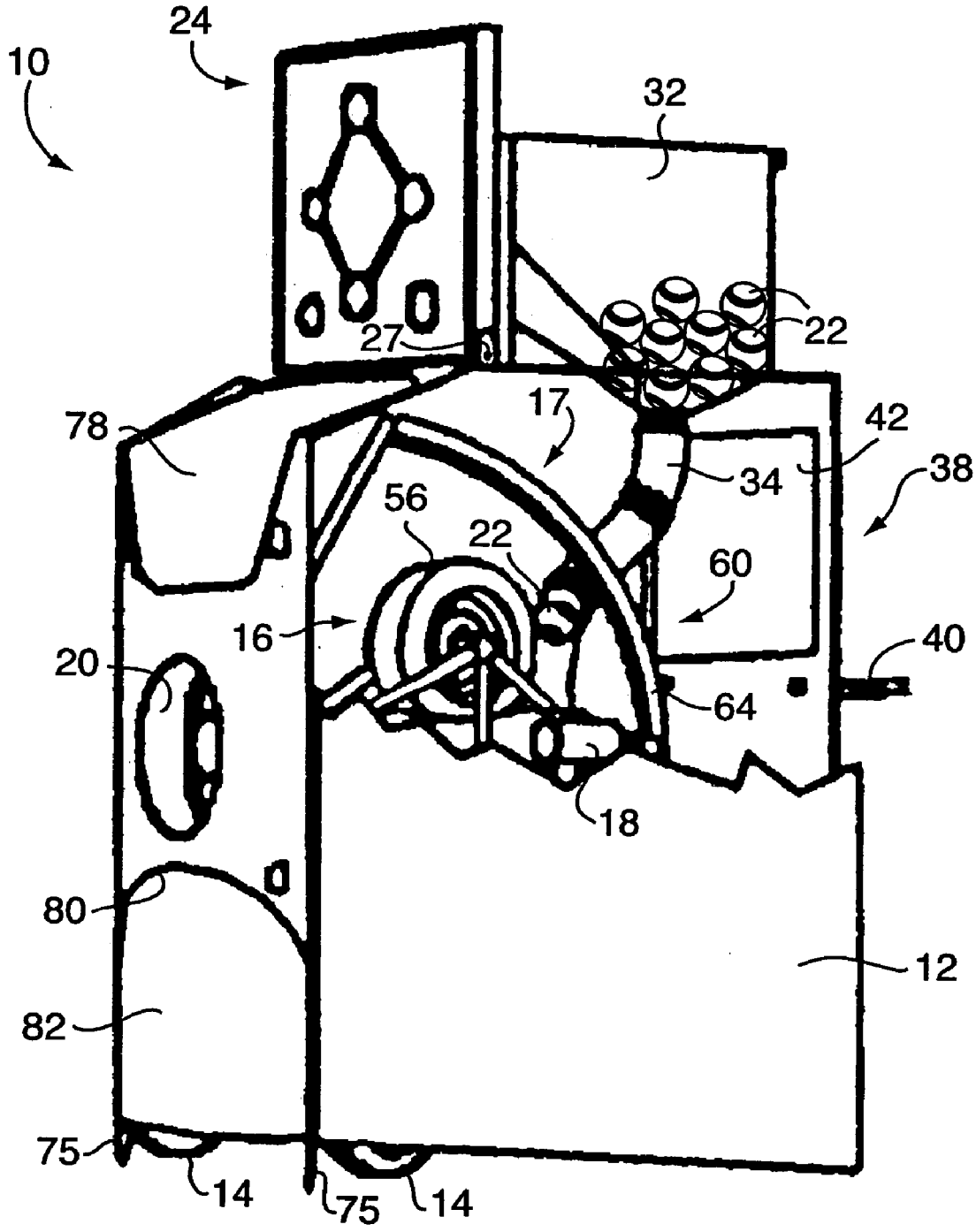
FIG. 2 is a partially cut-away perspective view of the baseball practice machine of FIG. 1.

As shown in FIGS. 1–4A, the present invention is directed to a baseball fielding practice machine (referred to herein as "practice machine") generally designated by the reference number 10. The practice machine 10 includes a housing 12 mounted on wheels 14. A propulsion unit, generally designated by the reference numeral 16, is mounted inside the housing 12. A movable barrel 18, is disposed adjacent to the propulsion unit 16. The propulsion unit 16 is for propelling balls 22 through the movable barrel 18 outwardly from the practice machine 10. The housing 12 defines a barrel opening 20 through which the balls 22 are propelled from the practice machine 10. In the illustrated embodiment, both the propulsion unit 16 and the movable barrel 18 are coupled to a barrel positioner, identified generally by the reference numeral 17. The barrel positioner 17 is controllable for moving both the propulsion unit 16 and the movable barrel 18 for adjusting the trajectory of a ball 22 propelled from the practice machine 10. Typically, the balls 22 are baseballs, that is hardballs or softballs, however, the scope of the invention is not limited in this regard. The term barrel as used herein is to be broadly construed beyond the traditional tube-shaped barrel 18, to include any device which channels the direction of a ball propelled from the propulsion unit 16.

Figure 3:
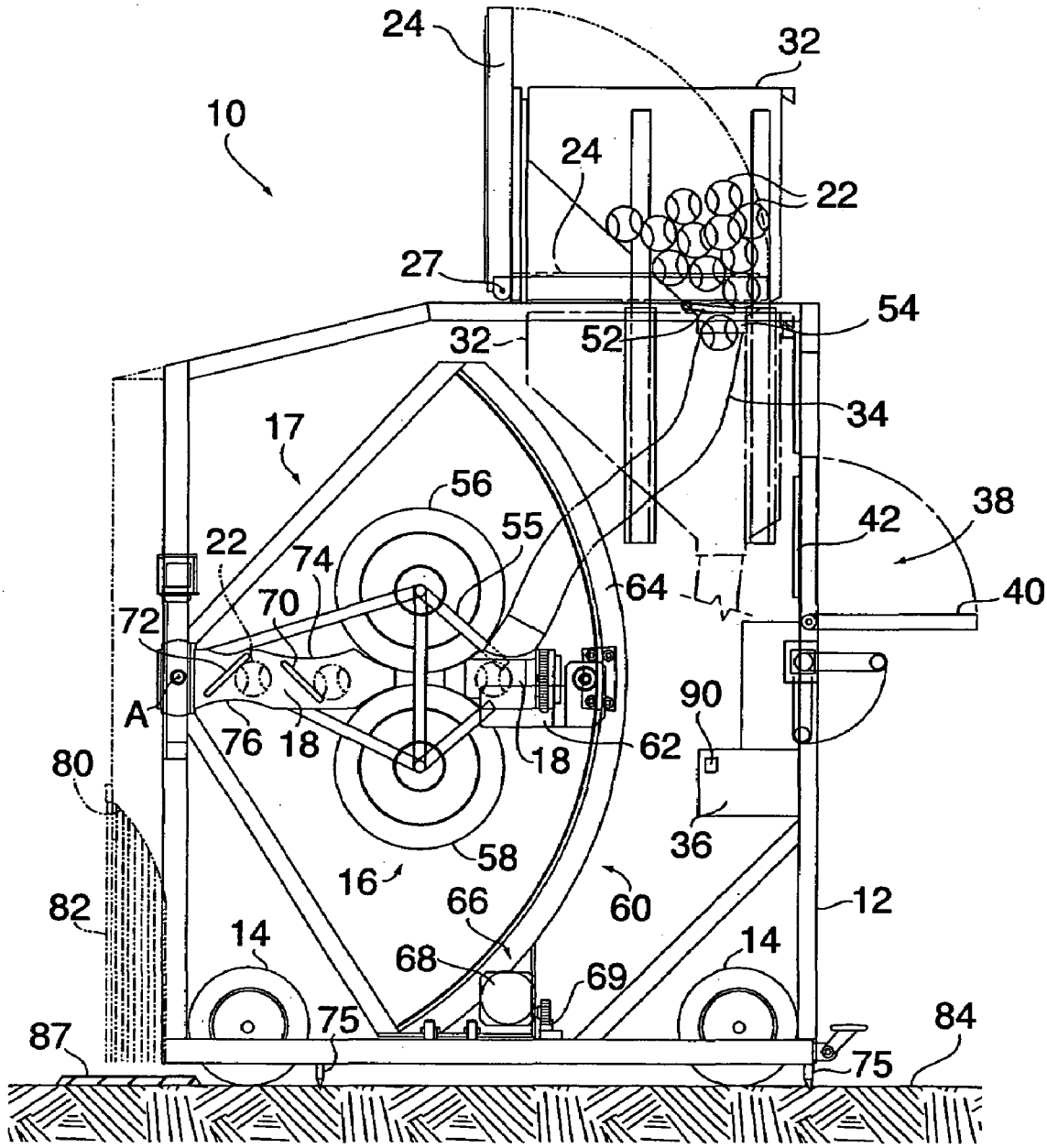
FIG. 3 is a side view of the baseball practice machine of FIG. 1 including a scoreboard, hopper and control panel shown in solid lines in an operational position and shown in dashed lines in a storage position.

In the illustrated embodiment, the practice machine 10 includes a scoreboard 24 for displaying information corresponding to a simulated game situation. For example, in FIG. 1, the scoreboard 24 displays a score or run differential 26 and an inning number 28. Additionally, the scoreboard 24 includes base runner indicators 30 identifying the location of any base runners and an out indicator 31 for displaying a number of outs in a simulated baseball game. As shown in FIG. 3, the scoreboard 24 is hinged to the housing 12 about an axis 27 and is movable between an operational position illustrated in solid lines and a storage position shown in dashed lines. In the operational position, the scoreboard 24 faces toward the barrel opening 20 for displaying game situation information to ball players on a practice field. The scoreboard 24 also includes an indicator 33 providing a visible or audible signal each time a ball 22 is to be propelled from the practice machine 10.

A ball hopper 32 for storing the balls 22 is mounted to the housing 12 and coupled to a ball feeder 34. The ball feeder 34 is coupled between the ball hopper 32 and the propulsion unit 16 and transports the balls 22 therebetween. As shown in FIG. 3, in the illustrated embodiment, the ball hopper 32 is movable between an operational position shown in solid lines and a storage position shown in dashed lines.

Still referring to FIG. 3, the practice machine 10 includes a programmable control system 36 for controlling the operation of the practice machine. The control system 36 is coupled to the each of the components of the practice machine 10 including the propulsion unit 16, the barrel positioner 17, the ball hopper 32, and the scoreboard 24 and controls the operation of each.

Figure 5:
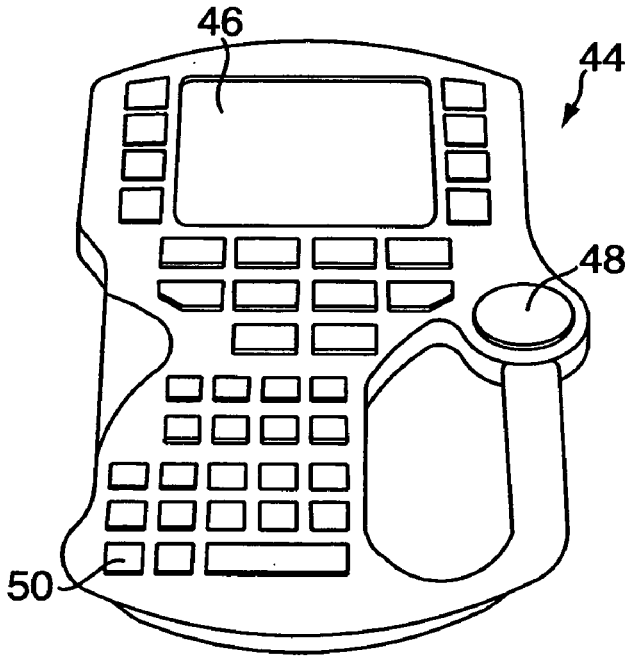
FIG. 5 is a perspective view of one embodiment of a remote control device for use with the present invention practice machine.

A control panel 38 is coupled to the control system 36 and includes a user interface having an input device 40 and a monitor 42 for user control and programming of the control system 36. As shown in FIG. 5, a remote control device 44 is also provided to communicate with the control system 36 from a remote location. The remote control device 44 includes a display 46 an input device 48, and a keyboard 50 for operating or programming the control system 36 from a remote location.

Figure 4A:
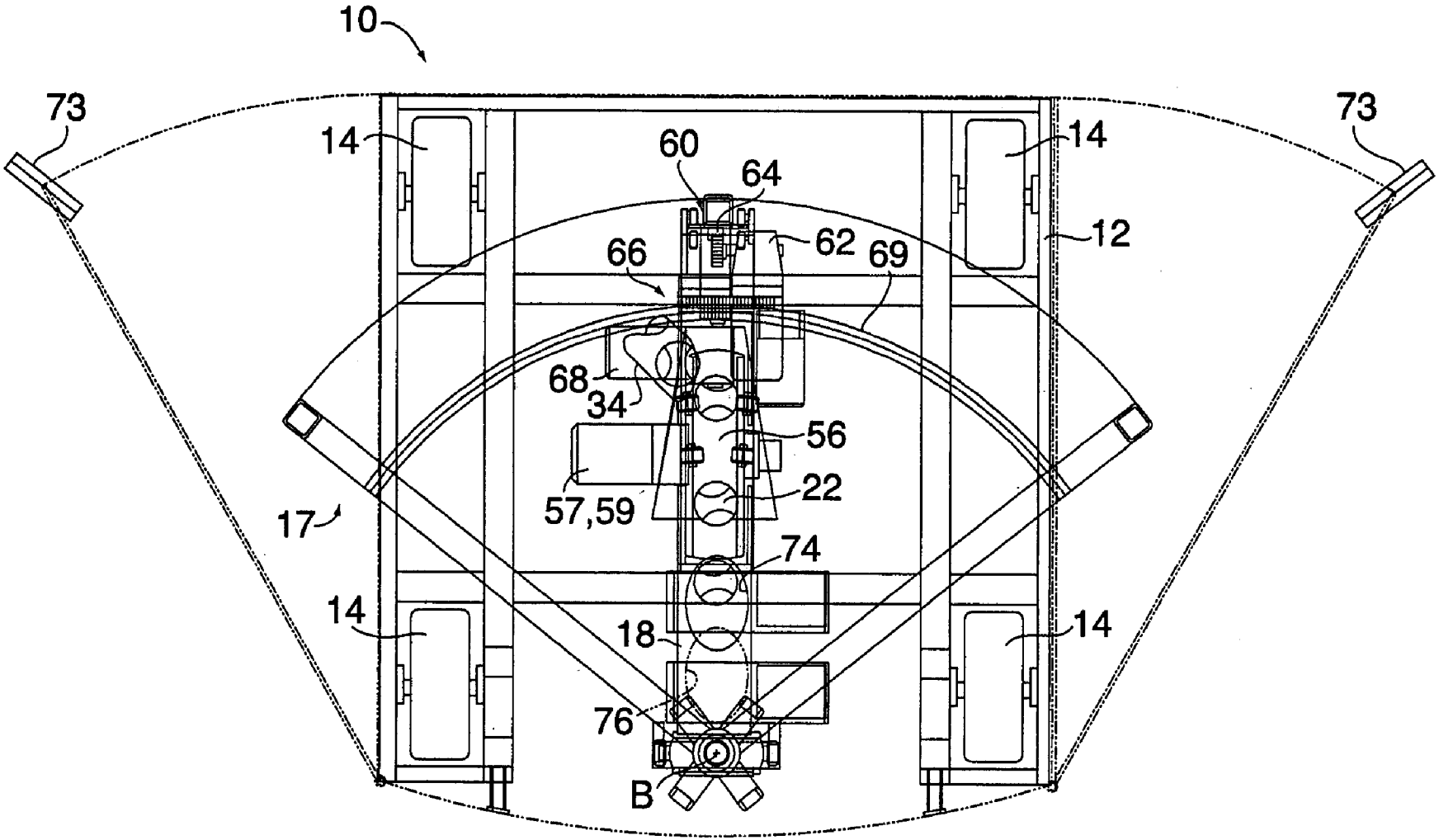
FIG. 4A is a partial top view of the baseball practice machine of FIG. 1.

Referring to FIGS. 3 and 4A, the ball hopper 32 includes a hopper gate 52 coupled to an opening 54 defined by a lower portion of the ball hopper for controlling the feeding of the balls 22 to the propulsion unit 16. In the illustrated embodiment, the propulsion unit 16 includes first and second rotating wheels 56 and 58 respectively. During operation of the practice machine, the balls 22 are fed from the ball feeder 34 between the first and second rotating wheels which propel the ball through the movable barrel 18. An ejector gate 55 is coupled to the control system 36 and moves the balls 22 from the ball feeder 34 into engagement with and between the first and second rotating wheels 56 and 58.

The first and second rotating wheels 56 and 58 are separately controlled by the control system 36 and cooperate in a known manner to impart a predetermined velocity and spin on a ball 22 and propel the ball through the movable barrel 18. In the preferred embodiment, the rotating wheels 56 and 58 are powered by separate motors 57 and 59 respectively, and can be controlled to accelerate or decelerate quickly so that a subsequent ball 22 can be propelled from the practice machine at a much slower or faster speed than a previous ball 22. Preferably, the balls 22 can be propelled at ejection speeds in a range between about 1 and about 99 miles per hour.

Figure 6:
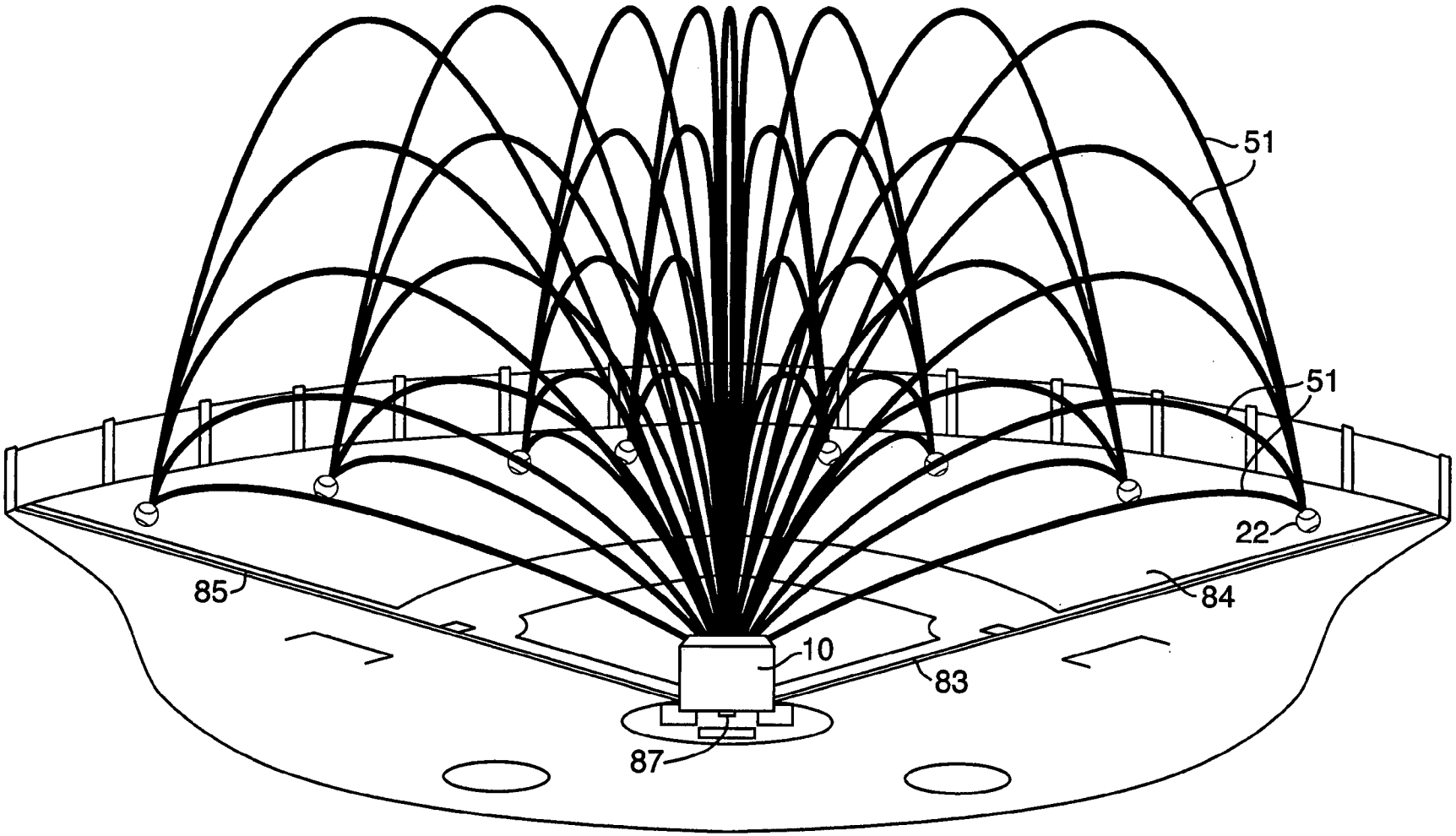
FIG. 6 is an illustration of a practice machine according to the present invention positioned at home plate on a baseball practice field.

The trajectory of a ball 22 propelled from the practice machine 10 is adjustable and controlled by the control system 36 by adjusting the angular position of the movable barrel 18 and the propulsion unit 16 relative to the housing 12 via the barrel positioner 17. FIG. 6 illustrates various trajectories 51 by which a ball 22 can be delivered to different locations of a practice field 84 from the practice machine 10. The term trajectory parameters as used herein with respect to a ball 22 propelled from the practice machine 10 includes the angular position of the movable barrel 18 as well as the speed and spin imparted to the ball 22.

The barrel positioner 17 includes a vertical controller 60 and a horizontal controller 66 for adjusting the angular position of the movable barrel 18 and propulsion unit 16 relative to the housing 12 thereby controlling the trajectory of a ball 22 propelled from the practice machine 10. The vertical controller 60 includes a first motor 62 and vertical track device 64 for adjusting the angular position of the movable barrel 18 and the propulsion unit 16 about an axis A. In the illustrated embodiment, the vertical displacement of the propulsion unit 16 and the movable barrel 18 has a range of motion of approximately 120 degrees about the axis A. The control system 36 operates the barrel positioner 17 to control the movement of the propulsion unit 16 and the movable barrel 18 throughout the full range of vertical motion such that a ball 22 can be propelled from the practice machine 12 at any angle within the vertical range. Thus, the balls 22 can be propelled from the machine at various vertical trajectories for simulating bunts, grounders, line drives, fly balls, pop-ups as well any other trajectory within the vertical range.

Referring to FIG. 4A, the horizontal controller 66 includes a second motor 68 and horizontal track device 69 for adjusting the angular position of the propulsion unit 16 and the movable barrel 18 about an axis B. In a preferred embodiment, the horizontal displacement of the propulsion unit 16 and the movable barrel 18 has a range of approximately 120 degrees. The control system 36 operates the barrel positioner 17 including the second motor 68 to control the movement of the propulsion unit 16 and the movable barrel 18 throughout the full range of horizontal motion such that a ball 22 can be propelled from the practice machine 12 at any angle within the horizontal range. The control system 36 can control the practice machine 10 to deliver a ball 22 to any location throughout the practice field 84 including locations normally designated foul territory that is outside of a first baseline 83 or a third baseline 85 of the practice field.

Referring again to FIG. 3, the propulsion unit 16 also includes first and second deflectors 70 and 72 disposed adjacent corresponding first and second barrel openings 74 and 76 defined by the movable barrel 18. The first and second deflectors 70 and 72 respectively are coupled to and controlled by the control system 36 for deflecting the trajectory of a propelled ball 22 through the corresponding barrel opening 74 and 76 respectively. The first deflector 70 can be operated to engage a propelled ball 22 and deflect the ball through the first barrel opening 74 and an upper opening 78 defined in the housing 12 for directing the ball 22 along certain trajectories and simulating, pop-ups, foul tips, etc. Similarly, the second deflector 72 can be operated to deflect a propelled ball 22 causing the ball to exit the movable barrel 18 through the second barrel opening 76 and the practice machine 10 through a lower opening 80 defined in the housing 12 for simulating a bunt or short ground ball for example. A skirt 82 conceals the lower opening 80 in the housing 12 and the movement of the propulsion unit 16 therein. The barrel openings 74 and 76 may include doors such that the sidewalls of the barrel 18 are continuous when the barrel openings are not being used. Alternatively, in other embodiments of the practice machine 10, a single deflector can be configured to deflect the trajectory of a ball 22 in multiple directions thereby eliminating the need for both first and second deflectors 70 and 72.

Figure 4B:
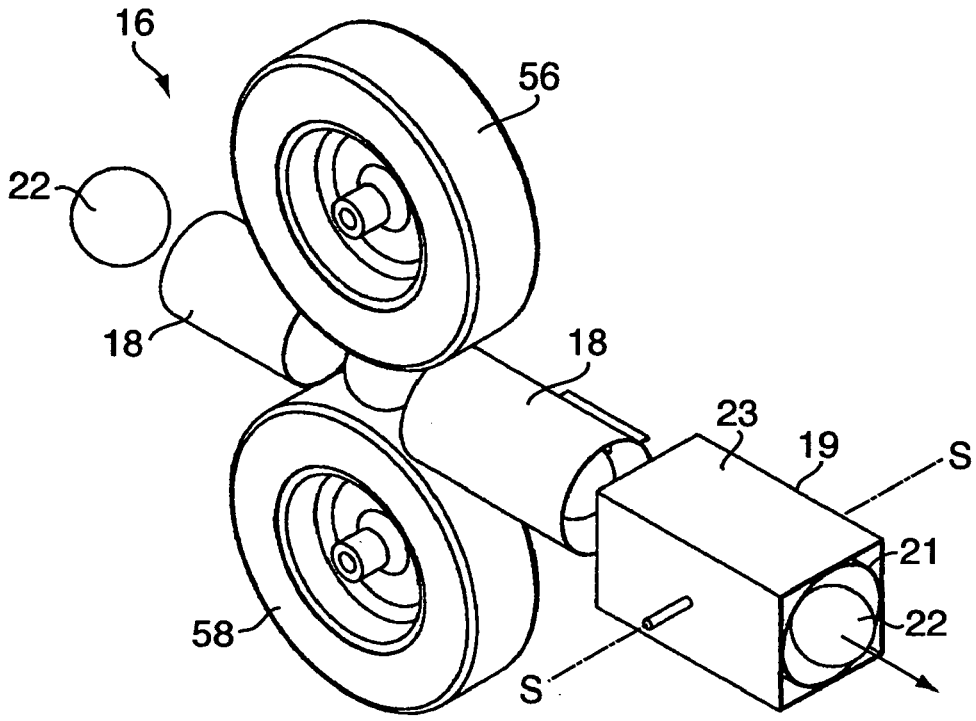
FIG. 4B is a perspective view of another embodiment of the propulsion unit and movable barrel of a practice machine according to the present invention.
Figure 4C:
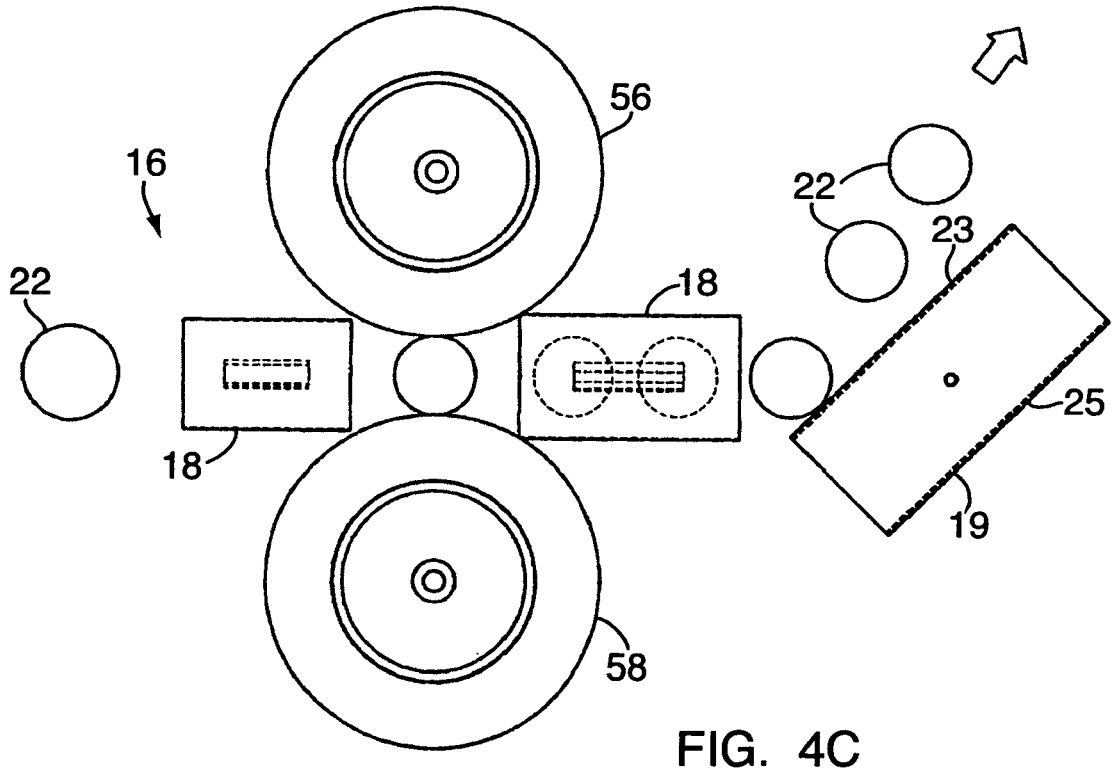
FIG. 4C is a front side view of the embodiment of FIG. 4B showing a ball being deflected by an upper surface of an end portion of the movable barrel.
Figure 4D:
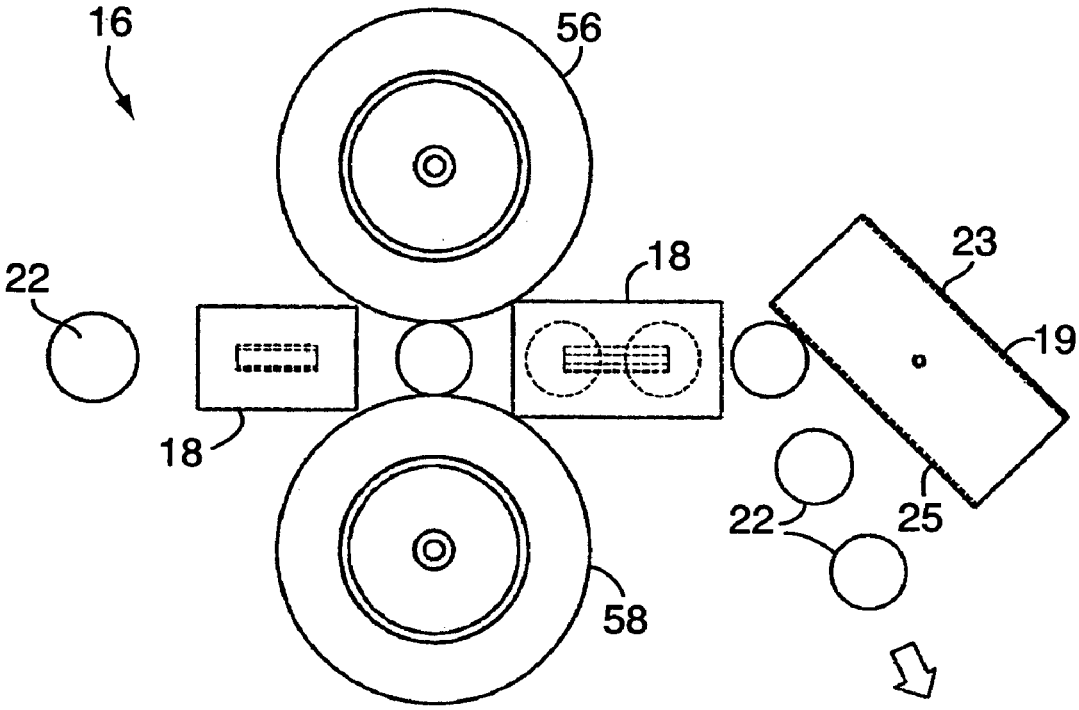
FIG. 4D is a front side view of the embodiment of FIG. 4B showing a ball being deflected by a lower surface of an end portion of the movable barrel.

Another embodiment of the propulsion unit 16 and movable barrel 18 according to the present invention, is shown in FIGS. 4B, 4C, and 4D. In this embodiment, the movable barrel 18 includes a separately movable end portion 19 as an alternative to the first and second deflectors 70 and 72. The end portion 19 is coupled to a motor (not shown) that is coupled to and controlled by the control system 36 for movement of the end portion about an axis S-S that is substantially perpendicular to the length of the movable barrel 18. For most trajectories, the end portion 19 is controlled to remain aligned with the movable barrel 18 wherein a ball 22 is propelled through both of the movable barrel 18 and the opening 21 in the end portion 19 and outwardly from the practice machine 10 through the ball opening 20. For deflecting the trajectories of a ball 22, as discussed above with respect to the first and second deflectors 70 and 72, the end portion 19 can be controlled to pivot about the axis S-S for engaging a ball 22 with an upper surface 23 or a lower surface 25 of the end portion 19. As shown in FIGS. 4C and 4D, the end portion 19 is movable relative to the movable barrel 18 causing a propelled ball 22 to be deflected through one of the upper opening 78 in the housing or the lower opening 80. Thus, the end portion 19 can be used to simulate foul tips and bunts, for example.

The housing 12 includes field alignment markings 73 for positioning the practice machine 10 relative to the practice field 84. In the preferred embodiment, the field alignment markings 73 are alignable with the first baseline 83 and the third baseline 85 of the practice field 84. Placement spikes 75 are mounted to the housing 12 and are engageable with the practice field 84 to secure the position of the housing relative to the practice field. The field alignment markings 73 and placement spikes 75 are provided to ensure that the practice machine 10 can be quickly and accurately positioned at a predetermined position relative to the practice field 84.

Normally, the practice machine 10 is positioned at home plate 87, for use by position players in fielding practice. However, the practice machine 10 can also be positioned at other locations on a practice field, for example, the practice machine can be positioned at a pitcher's mound facing home plate and be used as a pitching machine. Alternatively, the practice machine 10 can be positioned at other locations of the practice field such as first or second base and propel balls 22 toward players in a practice field so that the players can practice fielding the balls.

Because the entire propulsion unit 16 and barrel positioner 17 is disposed inside the housing 12, a fielder (not shown) positioned in the practice field 84 forward of the practice machine 10 cannot detect the angular position of the barrel 18 relative to the housing 12 and thereby predict the estimated trajectory of a next ball 22 to be propelled from the practice machine 10.

Referring again to FIG. 1, the practice machine 10 includes a plurality of cameras 88 that mounted to the housing 12 and directed towards the practice field 84 for recording a practice session. The cameras 88 are coupled to and controlled by the control system 36, and may be directed toward a location of the practice field 84 where a next ball 22 to be propelled from the practice machine is intended to land.

The control system 36 is a programmable computer-based system for controlling the operation of the practice machine 10 for propelling balls 22 from the practice machine relative to the practice field 84. In the preferred embodiment, the control system 36 includes a computer (not shown) having a Windows® based operating system and software including a baseball practice program 90 stored on a memory of the computer and configured to control the operation of the practice machine 10. The baseball practice program 90 includes a graphical user interface (GUI) for configuring and operating various practice modes for controlling the operation of the practice machine 10 with respect to the practice field 84. The control system 36 can be configured to be programmed using various known methods including by updating the memory of the control system using a CD-ROM, flash card, or via an external device such as a remote computer, laptop computer, etc.

Figure 7:
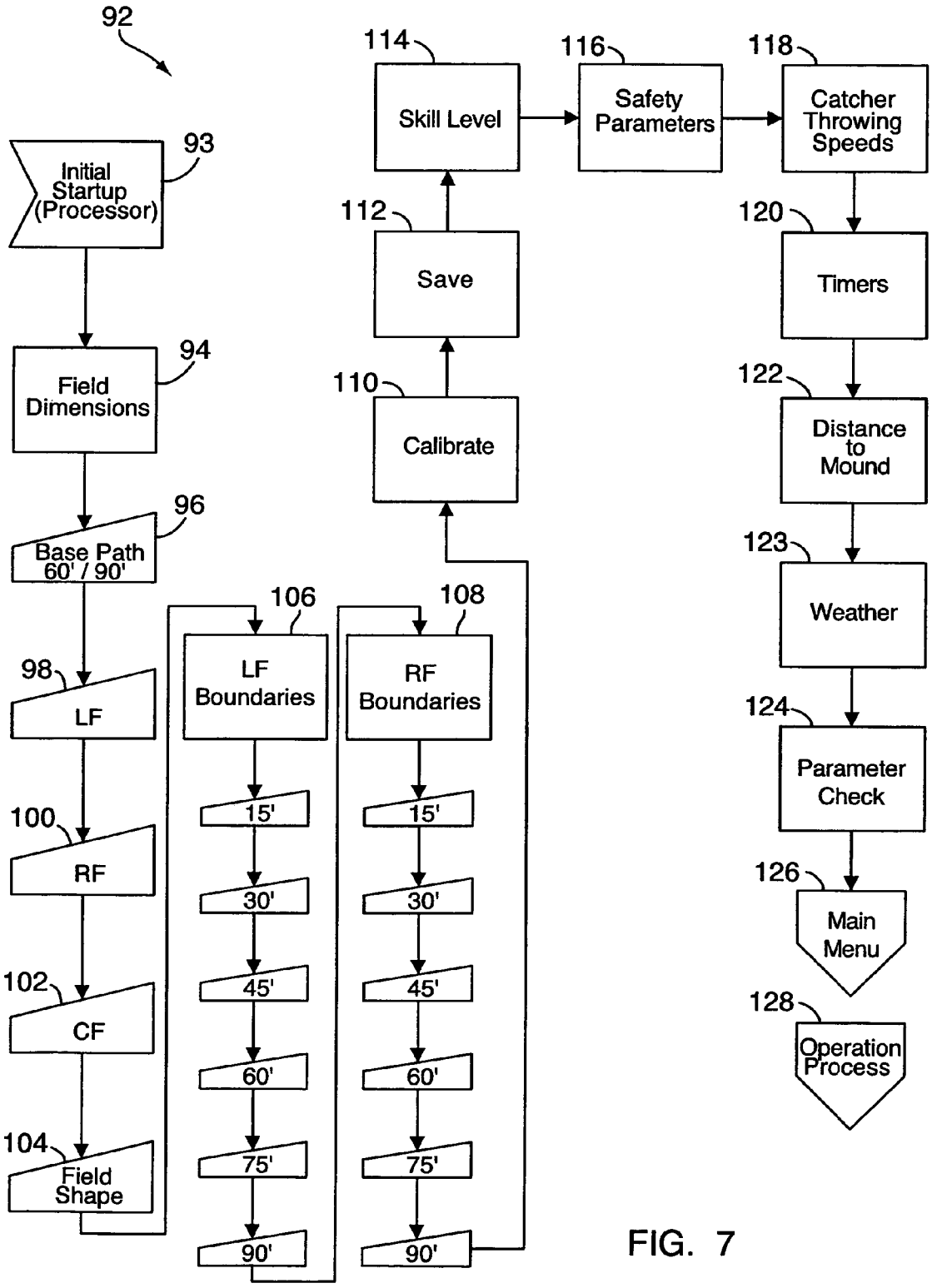
FIG. 7 is a flow chart of one embodiment of a start-up program for a control system of the FIG. 1 practice machine.

Referring to FIG. 7, the control system 36 includes a start-up program 92 for initializing the baseball practice program 90. FIG. 7 includes a flow chart of one embodiment of a start-up program 92 according to the present invention. The start up program 92 begins at block 93 and provides a user interface including prompts for inputting and saving start-up information such as field dimensions, equipment information, player skill level data, timer and safety parameters as well as other information.

In the FIG. 7 embodiment, the start-up program includes a field dimension button 94 that is selectable for inputting the dimensions of the practice field 84. Dimensions of the practice field 84 that can be input to the start-up program 92 include the length of the first base line 83 at block 96, the length of the third baseline 85 at block 98, and a length from home plate to a far end of center field at block 102. The general shape of the practice field 84 is entered at block 104. Left and right boundaries of the practice field 84 are entered at blocks 106 and 108 at certain distances from home plate along the first and third baselines 83 and 85 respectively. The start-up program 92 includes a calibration feature 110 wherein the field dimensions and other initialization data are used to establish parameters for the trajectories speed and spin imparted to each ball 22 propelled from the practice machine 10. The calibration function is automatically activated by the start-up program 92 or can be manually activated. A save control 112 stores the field dimensions and other data in a memory (not shown) for use by the control system 36. The start-up program 92 provides for storing field dimensions for multiple practice fields.

The start-up program 92 includes a skill level option 114 that provides for game and equipment data as well as player skill level to be input to the control system 36. The skill level option 114 includes user interface prompts for inputting game parameters including designating the game to be practiced such as baseball, softball, and a level of play such as Little League, High School, College, or professional. Additionally, the start-up program 92 provides for designating and storing game and skill level parameters by a team name wherein multiple teams can utilize a single machine and the set-up time for each is minimal. The weight of the balls 22 being used for a practice session(s) is input into the control system during a start-up mode.

The start-up program includes initializing the control system 36 with predetermined default values for controlling balls propelled from the practice machine 10 based on the game being practiced, skill level, input data, field dimension data, and other game parameters designated by a user. For example, for pee-wee players, a default value for the maximum ball speed may be 15 mph whereas for major league players the maximum ball speed of a propelled ball 22 is set to a default maximum of 99 mph. Additionally, a user may overide the established parameters for customizing the trajectory of a ball 22 launched from the practice machine 10. For example, a user may increase or decrease the established parameter the skill level of a particular position player or the maximum speed of a ball 22 propelled towards a particular player position.

The start-up program provides for player data to be input for each of the player positions. The player data may include a player's height, weight, and whether he fields with a left or a right hand (lefty/righty). Additionally, average numbers for a player's athletic abilities such as a maximum vertical jump, 40 yard dash time, and a sideways mobility speed may be entered and used by the control system 36 in the selection of trajectory parameters for the balls 22 propelled from the practice machine 10.

The start-up program provides for the input of safety parameters at block 116. The safety parameters include maximum ball speeds, for example. The manual input safety parameters, if used, override any default maximum parameters determined by the control system 36 based on skill level, field, or player information inputs. The safety parameters also provide for controlling a propelled ball 22 to maintain a minimum distance away between the intended destination of a propelled ball on the practice field 84 and any obstruction on the practice field 84 such as a wall, pole, sprinkler head, or other obstruction. For example, if a left field area of the practice field 84 ends at a wall or other obstruction, a safety parameter can be input to ensure that a propelled ball will not be directed towards an intended landing point on the practice field that is closer than a minimum distance from the obstruction.

Catcher throwing speeds are input at 118. The catcher throwing speed controls the speed of a ball 22 propelled from the practice machine .10 when the control system 36 is set to simulate a catcher throwing a ball 22. Alternatively, the control system 36 determines a default catcher throwing speed based on the level of play, age, and skill levels of the intended players using the practice machine 10. The catcher throwing option is discussed further infra.

At block 120, various timers can be initialized in the start-up program 92. A hit timer can be initialized with an input time to fix the time between successive balls 22 that are propelled from the practice machine during a practice mode. The hit timer includes a predetermined default setting.

Block 122 provides for the distance between home plate and a pitcher's mound to be entered into the control system 36. At block 123, weather conditions including wind speed and direction can be input into and utilized by the start-up program 90 to initialize and calibrate the control system 36.

At block 124, the start-up program 92 provides a parameter check wherein the above-identified input parameters can be displayed for review and confirmation. Each of the input parameters can be updated and resaved as necessary if an error is detected or a change is desired. A main menu selector 126 allows a user to access a main menu 130. An operation process selector allows a user to access an operational process interface for the practice machine 10.

Figure 8:
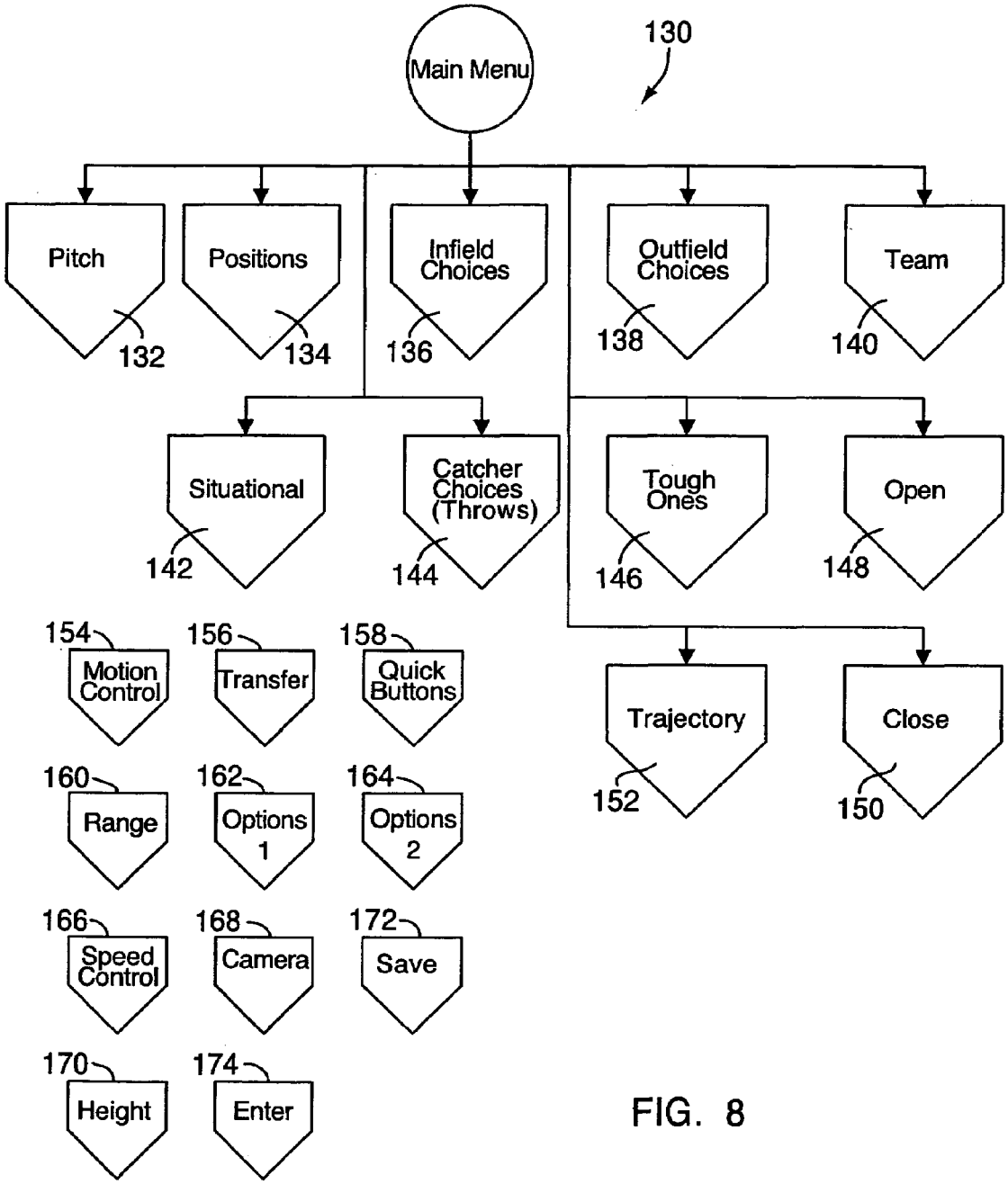
FIG. 8 is an illustration of one embodiment of a main menu user interface for a control system of the FIG. 1 practice machine.

FIG. 8 illustrates a main menu 130 GUI for programming and operating the control system 36. At 132 a pitch selector allows a user to control the practice machine 10 as a standard pitching machine wherein the practice machine 10 is positioned with the barrel opening 20 facing home plate 87. A user can input the distance from the practice machine to home plate and the desired speed and spin of a ball 22 to be propelled toward home plate 87. Additionally, various standard pitches are selectable for defining the trajectories of a series of balls 22 for a hitting practice session.

The main menu 130 user interface includes a plurality of selectors for controlling the practice machine 10 in various practice modes including Positions at 134, Infield at 136, Outfield at 138, Team at 140, Situational at 142, Catcher Throw at 144, Tough Ones at 146, Open at 148, Close at 150 and Trajectory at 152. The main menu 130 also includes additional selectors for controlling the practice machine 10 including Motion Control at 154, Transfer at 156, Quick Buttons at 158, Range at 160, Options 1 at 162, Options 2 at 164, Speed Control at 166, Camera at 168, and Height at 170. The main menu 132 also includes Save and Enter selectors at 172 and 174 respectively.

The practice modes allow a user to configure the control system 36 to control the practice machine 10 to propel a selected number of balls 22 towards certain predetermined locations of the practice field 84. The practice modes operate with respect to the field dimensions, game parameters, and other information input to the control system 36 via the start-up program 92 and operate assuming the practice machine 10 is positioned at a home plate 87 and aligned with the practice field 84 using the field alignment markers 73. Home plate 87 is the located on the practice field 84 at a point where the first baseline 83 intersects with the third baseline 85, as normally, the first baseline 83 and the third baseline 85 are perpendicular to each other.

Figure 9:
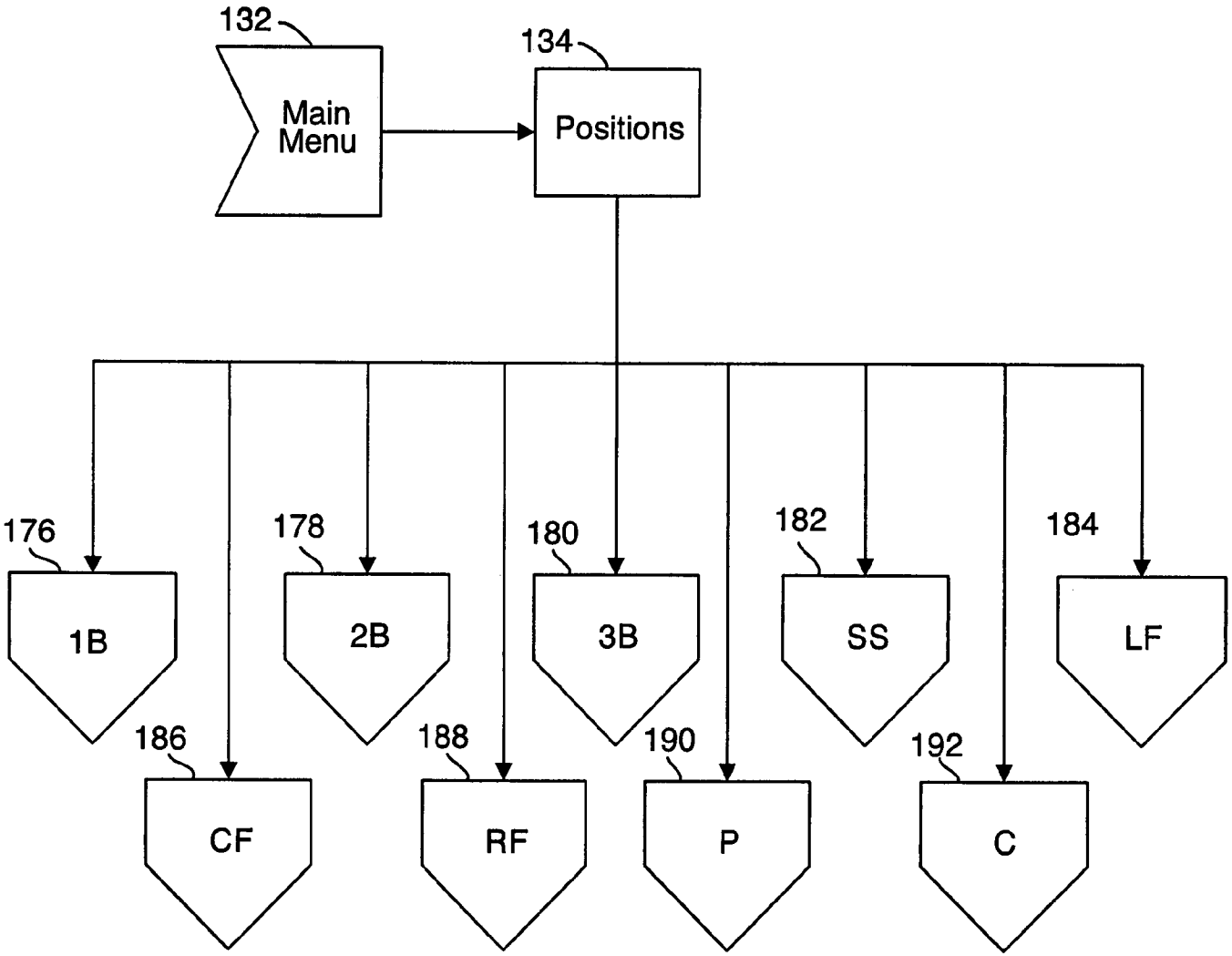
FIG. 9 is an illustration of one embodiment of a user interface for a positions practice mode for controlling the practice machine of FIG. 1.

Positions practice mode 134 is illustrated in a flow chart in FIG. 9. Using the Positions practice mode 134 a user can program the control system 36 by selecting a player position practice mode wherein at least one ball 22 can be propelled toward a predetermined location near the selected player position on the practice field 84. As shown in FIG. 9, the player position practice modes selectable include First Base (1B) at block 176, Second Base (2B) at block 178, Third Base (3B) at block 180, Short Stop (SS) at block 182, Left field (LF) at block 184, Center Field (CF) at block 186, Right Field (RF) at block 188, Pitcher (P) at block 190, and Catcher (C) at block 192. By selecting a plurality of trajectories for successive balls 22 to be propelled from the practice machine 10, a user can design a training session for a particular player position or an entire baseball team. The trajectory parameters for each of a series of balls 22 to be propelled from the practice machine 10 are selected to simulate hits in a baseball game that are presumed to be fieldable by players on the practice field 84 located at the above-identified player positions.

Figure 10:
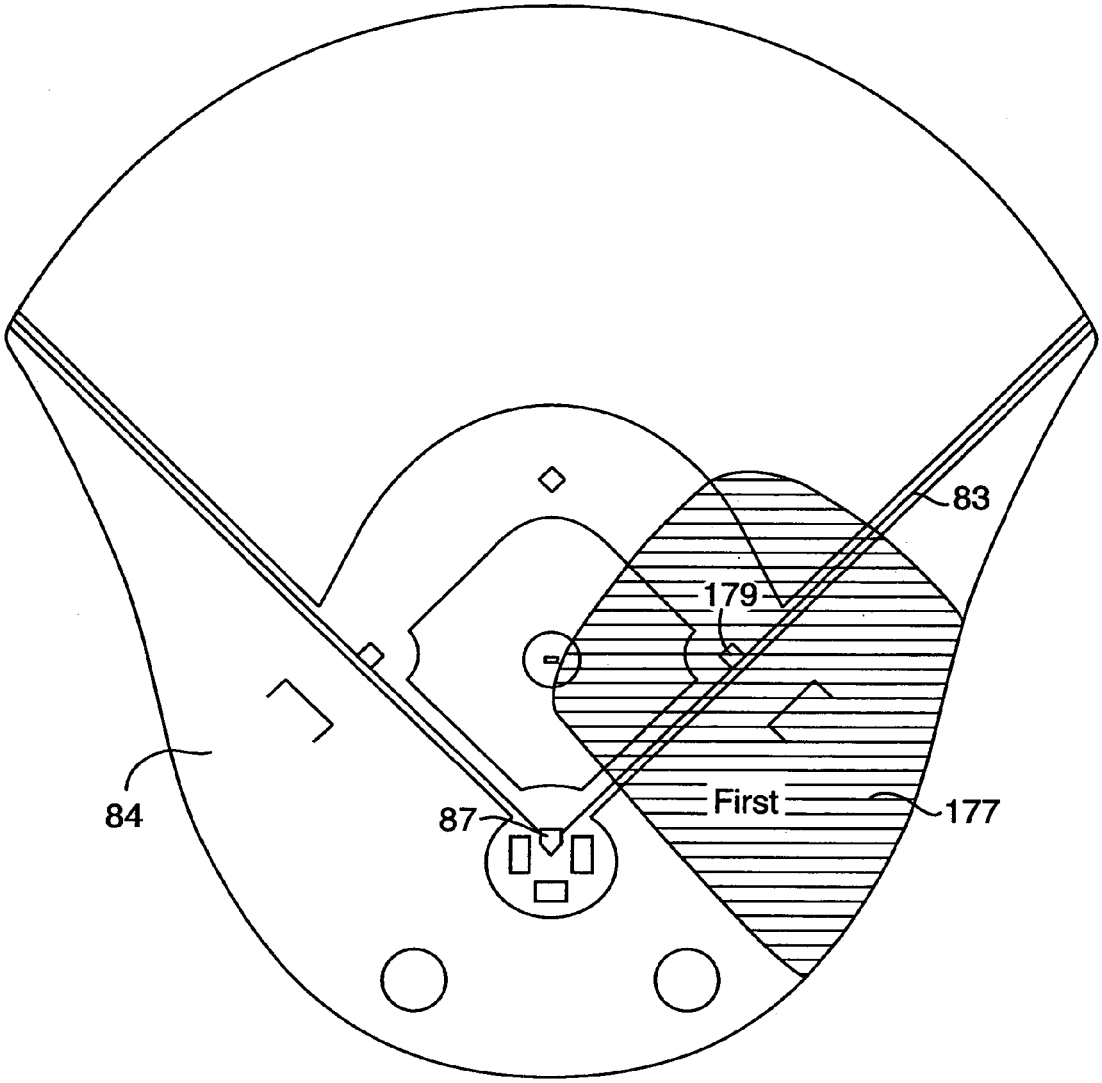
FIG. 10 is an illustration of an area of a practice field designated as a first base player position for use by the control system of the present invention practice machine.

FIG. 10 illustrates an approximation of an area of the practice field 84 designated as a first base player position 177. A first base 179 is located on the first baseline 83 at a user-defined distance from home plate 87. The actual position of the area of the practice field 84 designated as the first base player position 177 is determined as a function of the start-up program 92 based on the field dimensions, player level, the distance between home plate 87 and first base 179, the length of the first baseline 83 as well the other input parameters discussed above. Additionally, a user can define the size and location of the area of the practice field 84 designated as the first base player position 177.

Figure 11:
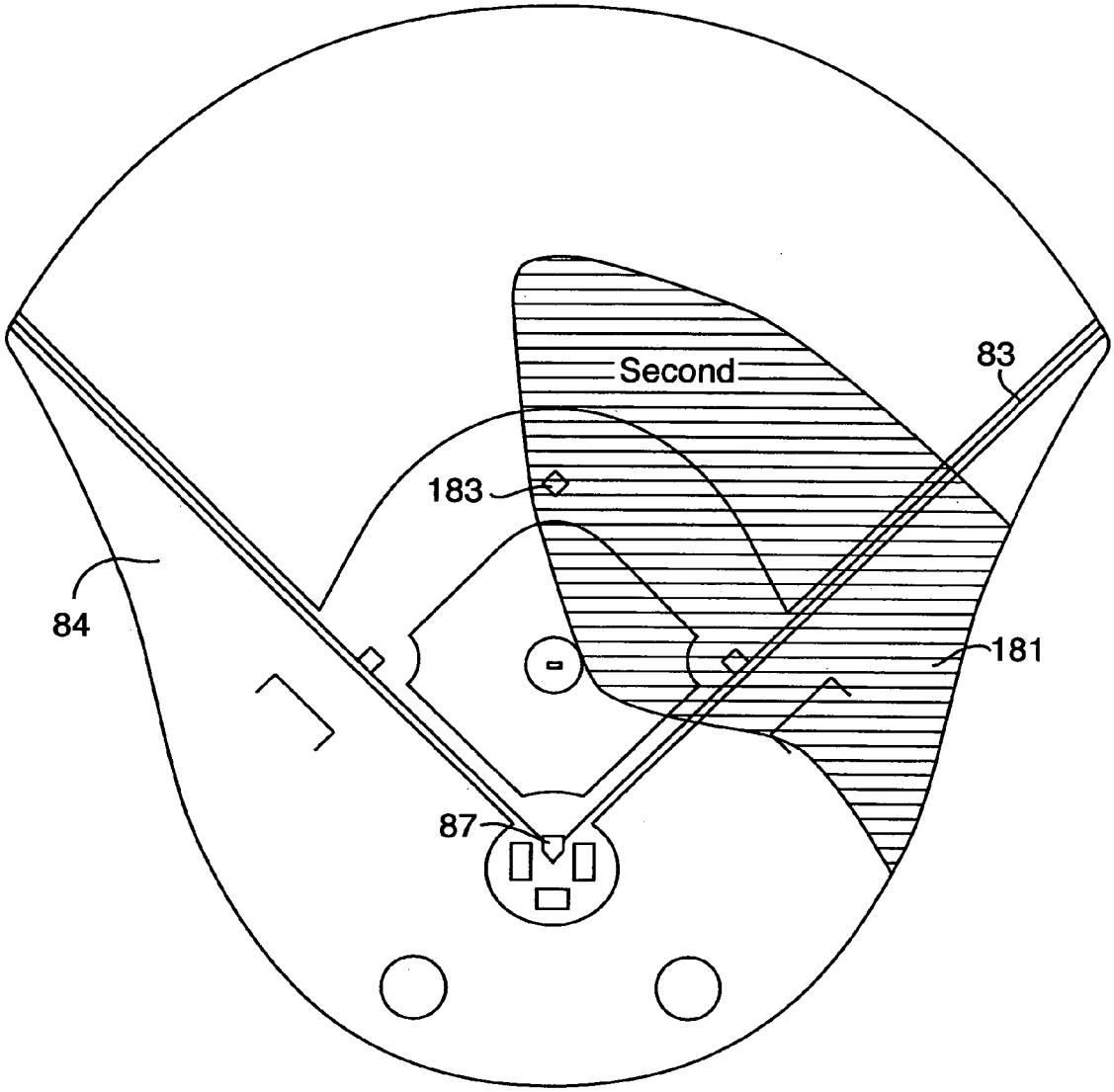
FIG. 11 is an illustration of an area of a practice field designated as a second base player position for use by the control system of the present invention practice machine.
Figure 12:
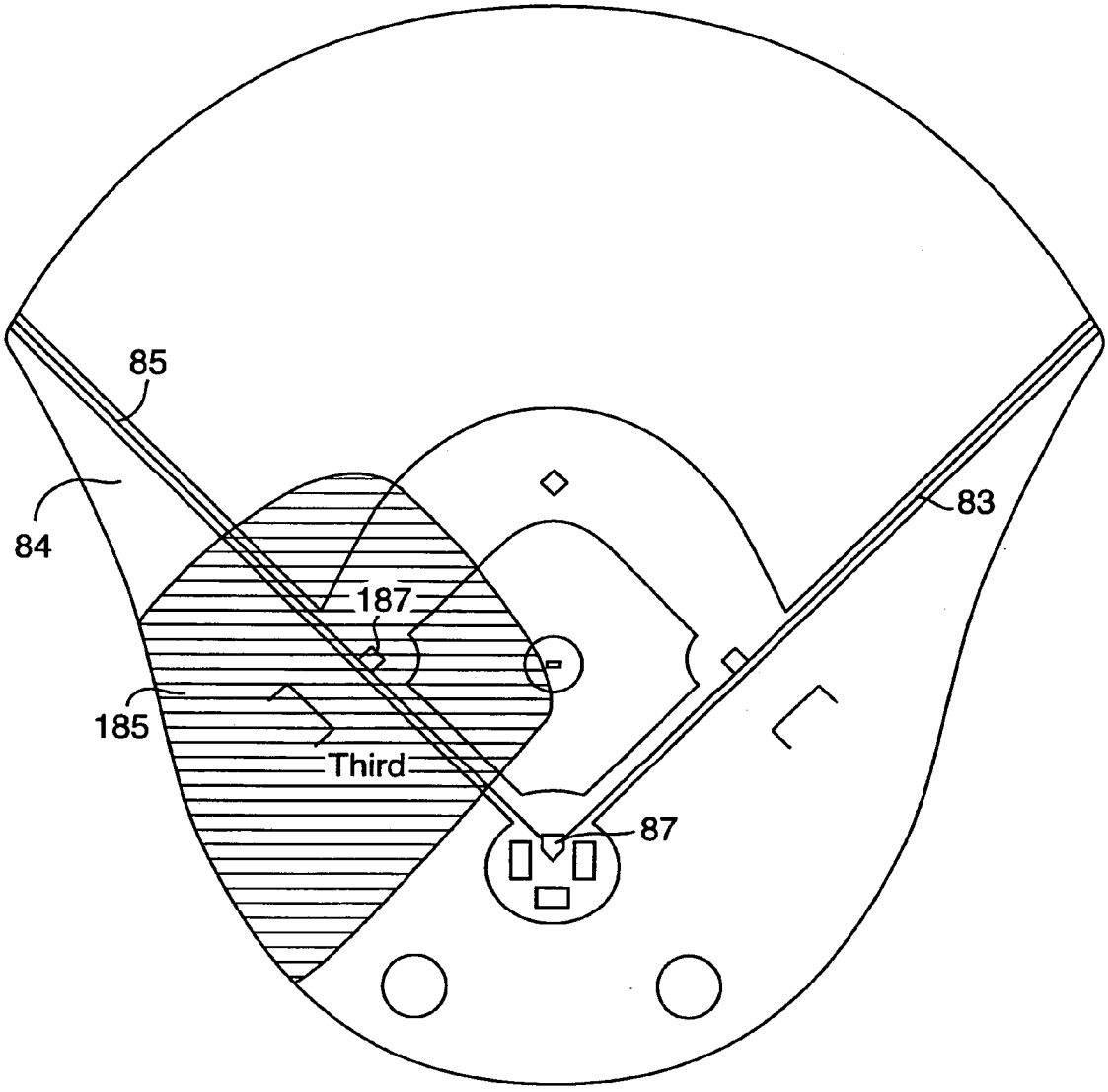
FIG. 12 is an illustration of an area of a practice field designated as a third base player position for use by the control system of the present invention practice machine.
Figure 13:
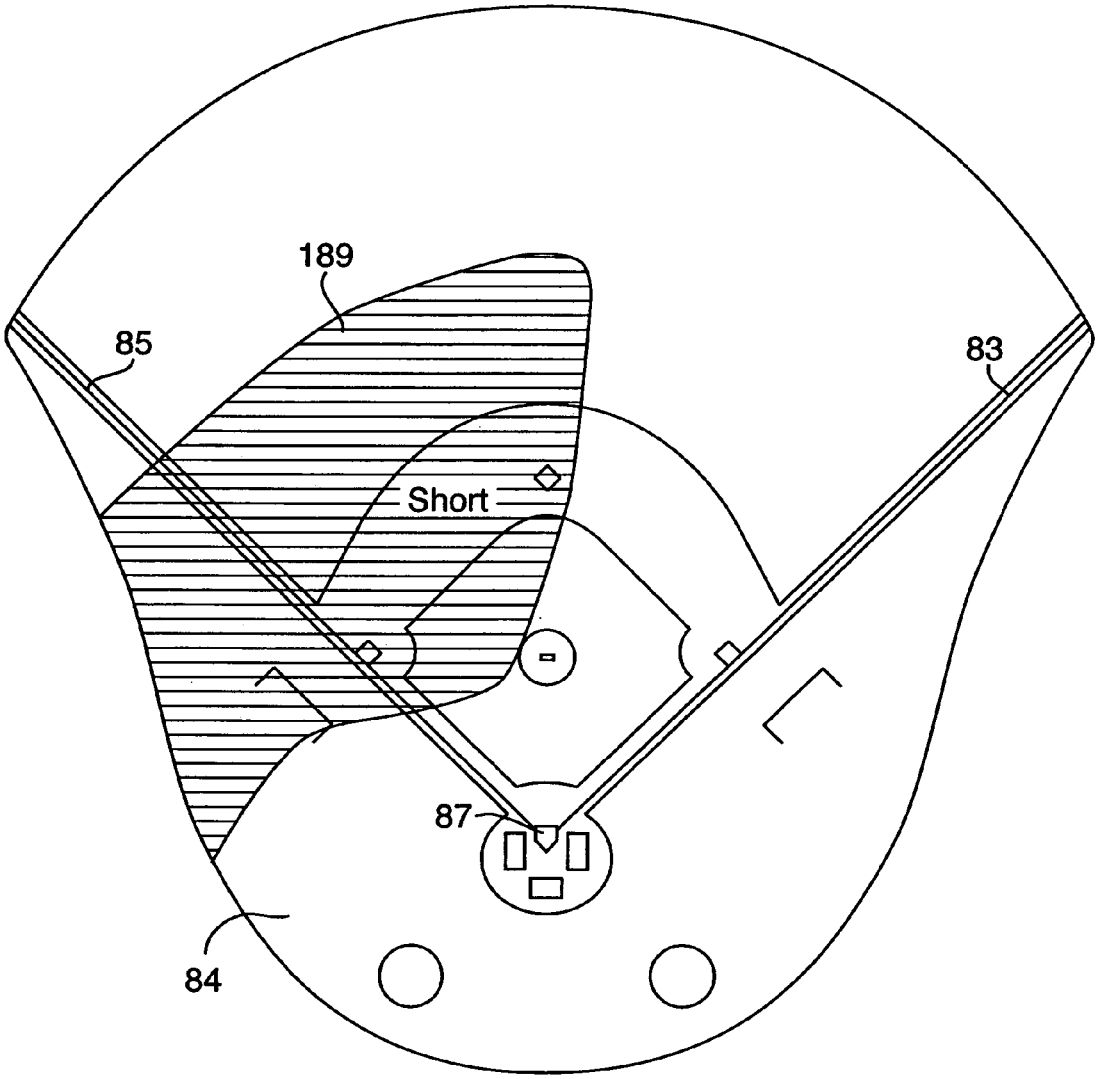
FIG. 13 is an illustration of an area of a practice field designated as a shortstop player position for use by the control system of the present invention practice machine.
Figure 14:
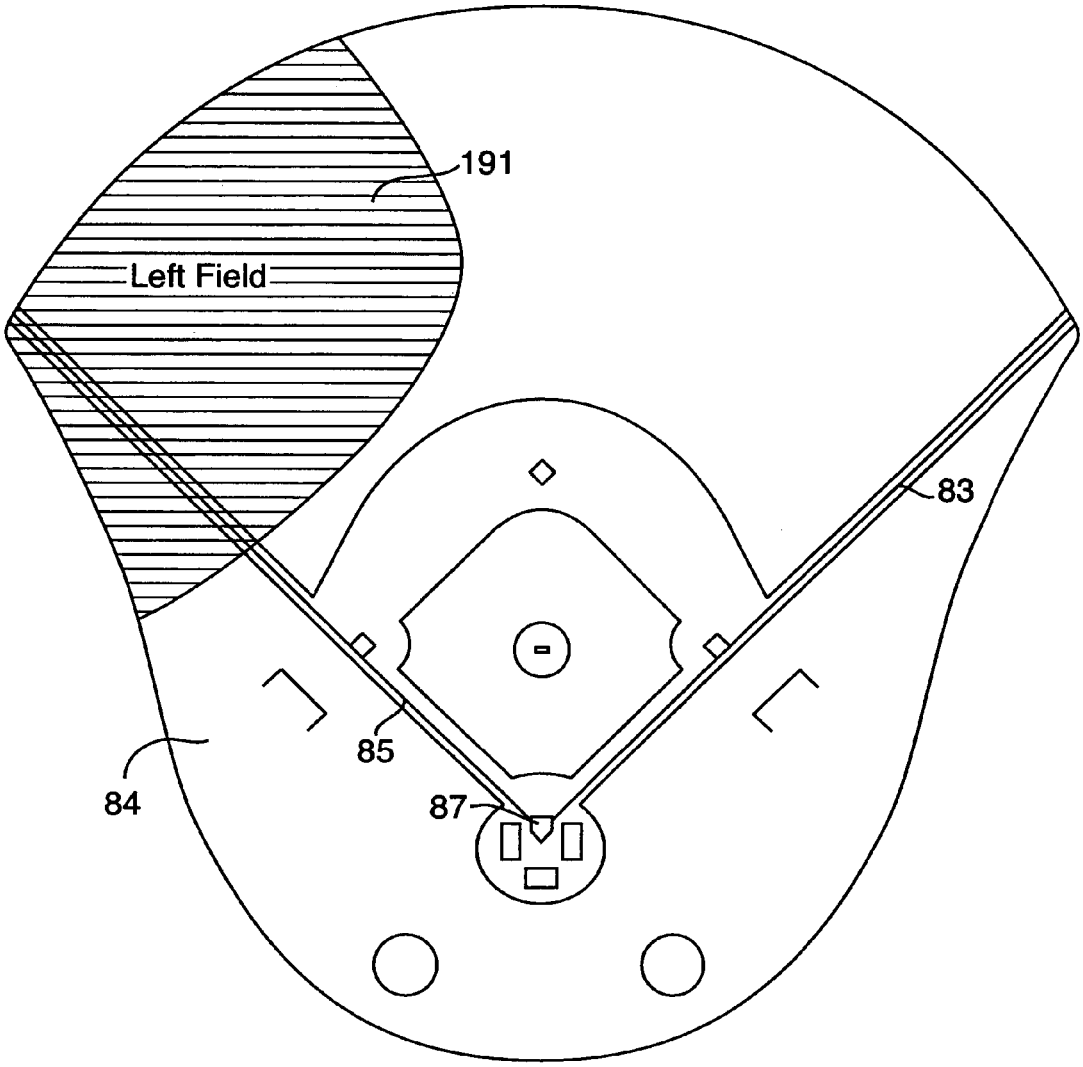
FIG. 14 is an illustration of an area of a practice field designated as a left field player position for use by the control system of the present invention practice machine.
Figure 15:
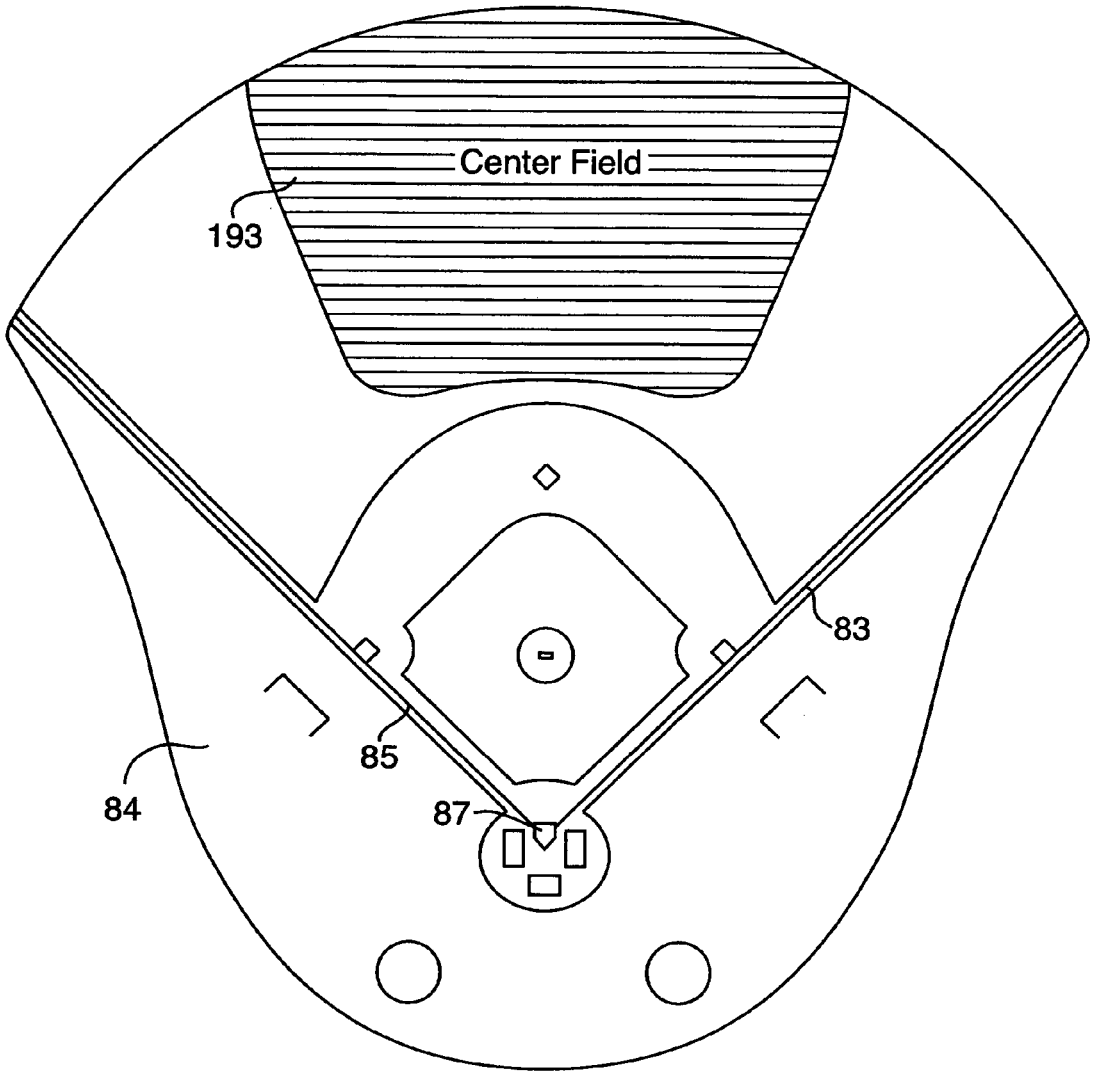
FIG. 15 is an illustration of an area of a practice field designated as a center field player position for use by the control system of the present invention practice machine.
Figure 16:
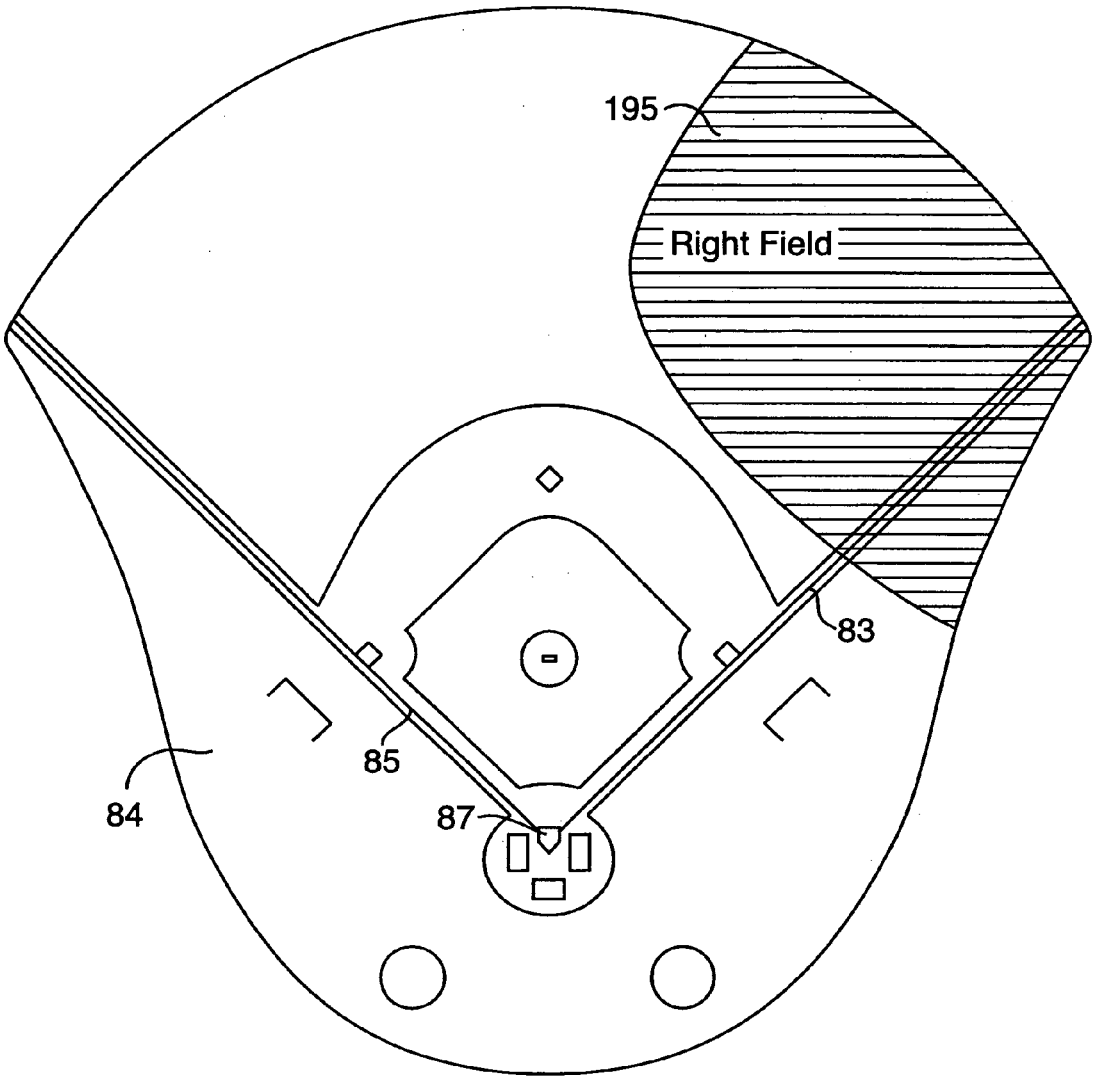
FIG. 16 is an illustration of an area of a practice field designated as a right field player position for use by the control system of the present invention practice machine.
Figure 17:
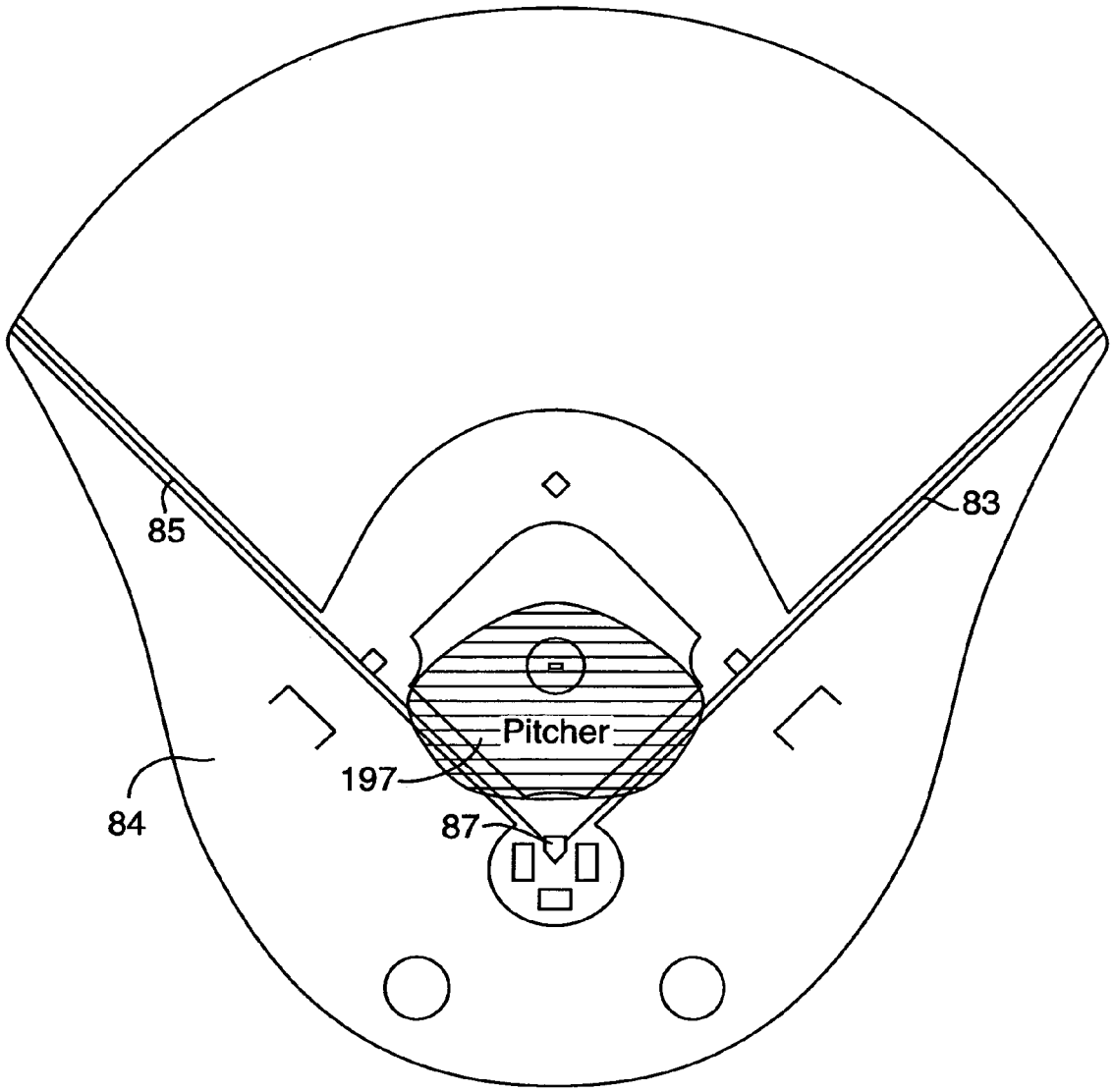
FIG. 17 is an illustration of an area of a practice field designated as a pitcher player position for use by the control system of the present invention practice machine.
Figure 18:
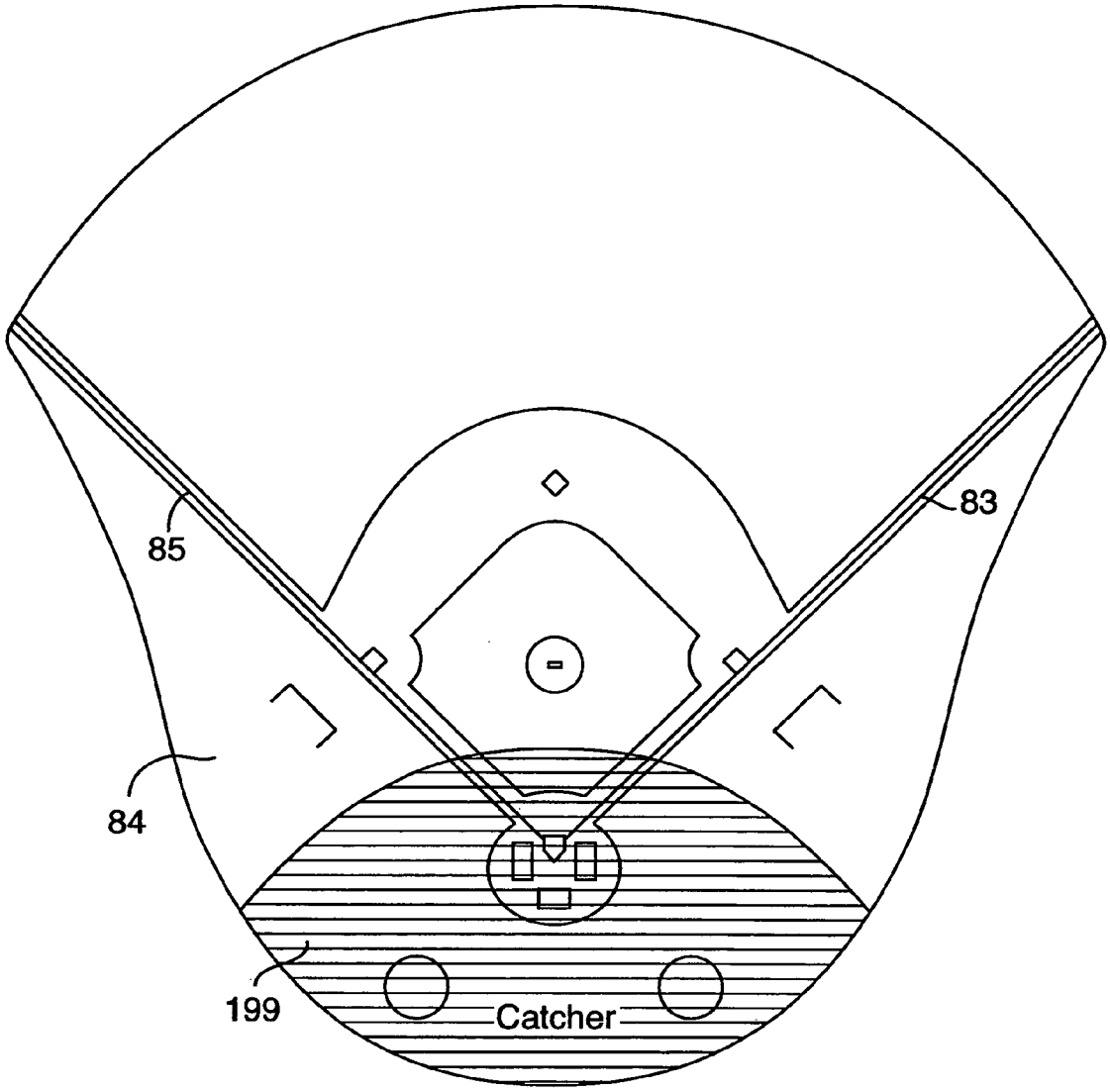
FIG. 18 is an illustration of an area of a practice field designated as a catcher player position for use by the control system of the present invention practice machine.

Similarly, FIG. 11 shows an approximation of an area of the practice field 84 designated as the second base player position 181 and the location of second base 183. FIG. 12 shows an approximation of an area of the practice field 84 designated as the third base player position 185 and the location of third base 187. FIG. 13 shows an approximation of an area of the practice field 84 designated as the short stop player position 189. FIG. 14 shows an approximation of an area of the practice field 84 designated as the left field player position 191. FIG. 15 shows an approximation of an area of the practice field 84 designated as the center field player position 193. FIG. 16 shows an approximation of an area of the practice field 84 designated as the right field player position 195. FIG. 17 shows an approximation of an area of the practice field 84 designated as the pitcher player position 197. FIG. 18 shows an approximation of an area of the practice field 84 designated as the catcher player position 199.

For each player position identified above, an actual player position is also determined defining a location of the practice field 84 where a corresponding position player would normally be located while playing the position. The actual player position is utilized by the control system for determining trajectory parameters for selected simulated hits. For example, as discussed hereinbelow, a user can select a forehand option for defining a ball 22 designated a grounder to be delivered toward a player position, thus the control system utilizes the actual player position as well as the player information (left handed or right handed player) to determine trajectory parameters for a ball 22 to simulate a "forehand grounder" to be propelled toward a selected player position.

Figure 19A:
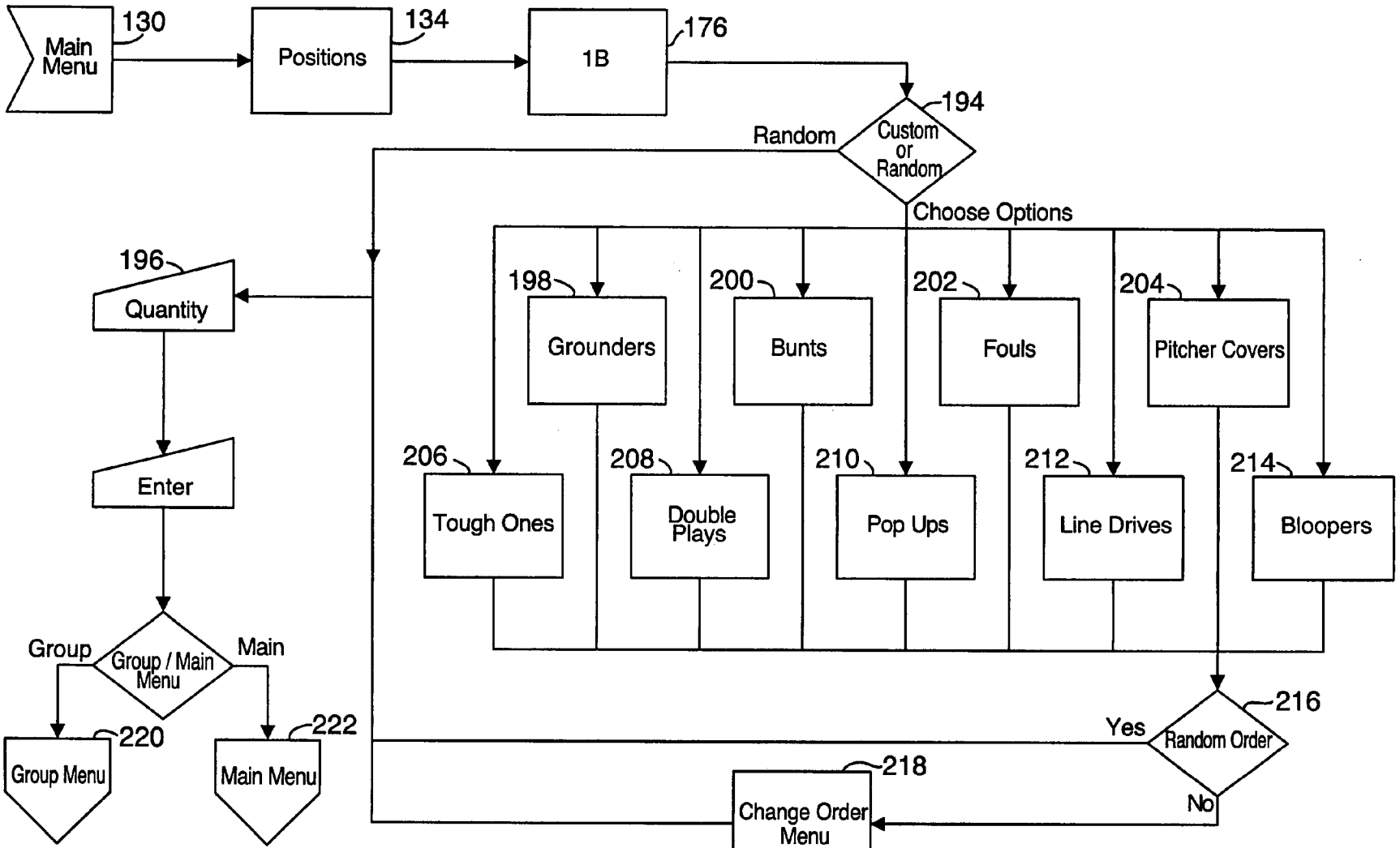
FIG. 19A is an illustration of one embodiment of a user interface for a First Base player position practice mode for controlling the practice machine of the present invention.

FIG. 19A illustrates a flow chart for configuring the control system 36 in the First Base player position practice mode 176. The First Base player position practice mode 176 allows a user to define the trajectory parameters for each of a series of balls 22 to be propelled from the practice machine 10 toward the first base player position 177 on the practice field 84. A user is first given an option at block 194 to choose either random or custom for selecting the trajectory parameters for the sequence of balls 22 in the series. Using the random selection option, a quantity of balls 22 to be propelled toward the first base player position 177 can be entered at 196. In a random selection, the trajectory parameters for each ball 22 to be propelled toward the first base player position 177 on the field 84 are randomly selected from a predetermined range of trajectory parameters stored in the memory of the control system 36 and corresponding to locations within the first base player position 177 on the practice field and various trajectory paths from the movable barrel 18 toward the randomly selected locations. As set forth above, the speed and spin imparted to the ball 22 are included in the randomly selected trajectory parameters. The selected trajectory parameters are then calibrated by the control system 36 depending on the input parameters for the practice field, player skill level and equipment information. Alternatively, the start-up program 92 can calibrate the stored trajectory parameters for each player position according to the input parameters. Thus, in a random selection for the First Base player position practice mode 176, the user merely chooses the number of balls 22 to be propelled toward the first base player position 177 and the control system randomly selects the trajectory parameters from a predetermined range of trajectory parameters.

Referring to FIG. 19B, a control logic chart illustrates one embodiment of the predetermined ranges of trajectory parameters that can be used for selecting the trajectory parameters for a ball 22 to be propelled toward the player positions of the practice field 84. For example, on the first line of the chart identified by reference numeral 293, a grounder toward the first base player position 177 includes trajectory parameters in the following range: Horizontal Range=Right 22° to Right 45° measured from a center line between the practice machine 10 and second base 183; Vertical Range=Positive 45° to Negative 45°; Tire Speed=0–99 Miles Per Hour (MPH); Deflector #1=not likely; Deflector #2=possible. The Horizontal and Vertical Ranges correspond to the angular position of the movable barrel 18 relative to the housing 12. The Vertical Range is measured from a horizontal position of the movable barrel 18. The ranges of trajectory parameters shown in the FIG. 19B chart are one example of possible ranges for the player position trajectory parameters. Other ranges for the trajectory parameters can be utilized depending on the dimensions of the practice field 84 and the skill level of the players, as well as other considerations.

Accordingly, if a grounder is selected in the First Base player position practice mode 176, the baseball practice program 90 randomly selects trajectory parameters from each of the above-identified ranges of trajectory parameters thereby establishing the trajectory parameters for a ball 22 to be propelled toward the first base player position 177. For each ball 22 of the quantity selected for a practice session, trajectory parameters are established and stored for use by the control system 36 during the practice session.

Alternatively, if a user chooses to select a custom trajectory at block 194, certain trajectory parameters can be selected for each of the balls 22 of the series. At block 198, a grounder can be selected wherein the baseball practice program 90 randomly selects trajectory parameters from stored trajectory parameters identified as corresponding to a grounder for delivering a ball 22 toward the first base player position 177 on the practice field 84 that will simulate a ground ball hit towards a first basemen. A quantity for a number of grounders is selectable at 196. Although not shown in the flow chart of FIG. 19, a user selecting the grounder option at block 198 can also be given the option to further limit the trajectory parameters selected for a ball 22. For example, additional options could be selected to limit the selectable trajectory parameters to those that correspond to grounders propelled to the forehand or backhand side of the position player. Additionally, hard, soft, high, low selection options may be employed to further limit the selection of the trajectory parameters according to corresponding predetermined ranges for the selected options.

Similar to the grounders 198 option, trajectory parameters for one or more balls 22 to be propelled from the practice machine 10 toward the first base player position 177 can be selected using the following options as shown in FIG. 19A: Bunts at block 200; Fouls at block 202; Pitcher Covers at block 204; Tough Ones at block 206; Double Plays at block 208; Pop Ups at block 210; Line Drives at block 212; and Runners at block 214.

If the Bunts 200 option is selected, the baseball practice program 90 identifies, selects and stores predetermined trajectory parameters for delivering a ball 22 toward the first base player position 177 that will simulate a bunted ball to be fielded by a first baseman. As set forth above with respect to the grounders option, the trajectory parameters may be randomly identified from a predetermined range of parameters defined with respect to the specific player position selected. Alternatively the trajectory parameters for a specific ball 22 or series of balls 22 to be delivered from the practice machine 10 can be selected from previously stored trajectory parameters using corresponding identifiers stored with the trajectory parameters. The stored trajectory parameters can be used to define routine plays to be practiced or warm-up exercises. A quantity for the number of balls 22 having trajectory parameters corresponding to a bunt toward the first base player position 177 can be entered at 196. As set forth above, with respect to grounders, additional bunt selection options can be employed wherein a user can further limit the selectable trajectory parameters for a ball 22.

Similarly, as a bunt may be classified as a grounder, wherein the trajectory parameters for a ball 22 are selected using the grounder selectors via block 198, other trajectories are selectable from multiple selectors or in multiple practice modes. For example, a trajectory defining a "foul pop-up" propelled toward a left field player position 191, may be selectable from the left field player position practice mode 184, pop-up option 210, fly ball option 234, sac fly option 236, foul balls option 324, deep fly option 238, etc.

If the Fouls 202 option is selected, the baseball practice program 90 identifies and stores predetermined trajectory parameters for delivering a ball 22 toward the first base player position 177 for simulating a foul ball to be fielded by a first baseman. Accordingly, trajectory parameters are randomly identified from a predetermined range of parameters designated to propel a ball 22 toward the first base player position 177 and outside of the first baseline 83 of the practice field 84. Alternatively the trajectory parameters for a specific ball 22 or series of balls 22 to be delivered from the practice machine 10 can be selected from previously stored trajectory parameters. A quantity for the number of balls 22 having trajectory parameters for simulating foul ball towards the first base player position 177 can be entered at 196. As set forth above, with respect to grounders, additional foul ball selection options can be employed wherein a user can further limit the selectable trajectory parameters for a ball 22.

If the Pitcher Covers 204 option is selected, the baseball practice program 90 identifies and stores predetermined trajectory parameters for delivering a ball 22 toward the first base player position 177 for simulating a hit ball to be fielded by the first baseman and thrown to a pitcher covering first base for a put-out. Accordingly, the trajectory parameters for the ball 22 are randomly selected by the baseball practice program 90 from a predetermined range of parameters such that a ball 22 will be propelled toward the first base player position 177 on the practice field 84 and spaced from a predetermined approximate location of a position player sufficiently to draw a first baseman away from first base 179. Thus, the trajectory parameters are predetermined so that a first basemen fielding such a propelled ball 22 would be required to move away from first base 179 sufficiently such that he would need the assistance from a pitcher to beat a hypothetical or actual baserunner to first base 179. Alternatively the trajectory parameters for a specific ball 22 or series of balls 22 to be delivered from the practice machine 10 can be selected from previously stored trajectory parameters. A quantity for the number of balls 22 having trajectory parameters for simulating Pitcher Covers 204 towards the first base player position 177 can be entered at 196. As set forth above, with respect to grounders, additional pitcher cover selection options can be employed wherein a user can further limit the selectable trajectory parameters for a ball 22 to be propelled toward the first base player position 177.

If the Tough Ones 206 option is selected, the baseball practice program 90 identifies and stores trajectory parameters for a ball 22 with spin, velocity, and trajectory characteristics consistent with tough defensive plays to be made by a defensive player in a selected player position. Trajectories selected in the Tough Ones 206 program may also be located in other operating programs such as grounders, line drives, fouls, fly balls, etc., and may be specific trajectories of each trajectory category as determined to provoke a tough defensive play by a player in the field. Trajectories located in the tough ones 206 program, are selected from a range of predetermined trajectory parameters for delivering a ball 22 toward an end of an area of the practice field 84 identified within the range of a first baseman. Thus, the Tough Ones 206 selector allows a user to select a ball to be delivered toward an outer edge of the first base player position 177 (or other selected player position) on the practice field 84. Alternatively, the trajectory parameters for a specific ball 22 or series of balls 22 to be delivered from the practice machine 10 can be selected from previously stored trajectory parameters. A quantity for the number of balls 22 having trajectory parameters for simulating hits directed towards a perimeter of the first base player position 177 can be entered at 196. As set forth above, with respect to grounders, additional Tough Ones selection options can be employed wherein a user can further limit or extend the selectable trajectory parameters for a ball 22 to be propelled toward the perimeter of the first base player position 177.

If the Double Plays 208 option is selected, the baseball practice program 90 identifies and stores predetermined trajectory parameters for delivering a ball 22 toward the first base player position 177 for simulating a ball to be fielded by a first baseman and delivered to another player at one of the bases or home plate for setting up a double play. Additionally, a user is given a prompt and may select the location of at least one base runner to be indicated on the scoreboard 24 prior to the selected ball 22 is propelled from the practice machine 10. Accordingly, trajectory parameters are randomly identified from a predetermined range of parameters designated to propel a ball 22 toward or near the first base player position 177. Alternatively the trajectory parameters for a specific ball 22 or series of balls 22 to be delivered from the practice machine 10 can be selected from previously stored trajectory parameters. A quantity for the number of balls 22 having trajectory parameters for simulating double play balls towards the first base player position 177 can be entered at 196. As set forth above, with respect to grounders, additional Double Plays 208 selection options can be employed wherein a user can further limit the selectable trajectory parameters for a ball 22 to be propelled toward the first base player position 177.

If the Pop-ups 210 option is selected, the baseball practice program 90 identifies and stores predetermined trajectory parameters for delivering a ball 22 toward the first base player position 177 for simulating a pop-up to be fielded by a first baseman. Accordingly, trajectory parameters are randomly identified from a predetermined range of trajectory parameters designated to propel a ball 22 from the practice machine 10 toward the first base player position 177. The range of trajectory parameters corresponding to a Pop-ups 210 selection provide parameters to propel a ball 22 in a sharp vertical ascent consistent with a typical pop-up, and have an intended landing location within the area of the practice field 84 designated as the first base player position 177. Alternatively the trajectory parameters for a specific ball 22 or series of balls 22 to be delivered from the practice machine 10 can be selected from previously stored trajectory parameters corresponding to Pop-ups 210 for the First Base 176 player position practice mode. A quantity for the number of balls 22 having trajectory parameters for simulating pop-ups towards the first base player position 177 can be entered at 196. As set forth above, with respect to grounders, additional Pop-ups 210 selection options can be employed wherein a user can further limit the selectable trajectory parameters for a ball 22 designated a pop-up to be propelled toward the first base player position 177.

If the Line Drives 212 option is selected, the baseball practice program 90 identifies and stores predetermined trajectory parameters for delivering a ball 22 toward the first base player position 177 for simulating a line drive to be fielded by a first baseman. Accordingly, trajectory parameters are randomly identified from a predetermined range of parameters designated to propel a ball 22 from the practice machine 10 toward the first base player position 177 along a relatively low or substantially flat trajectory above the practice field 84. Alternatively the trajectory parameters for a specific ball 22 or series of balls 22 to be delivered from the practice machine 10 can be selected from previously stored trajectory parameters. A quantity for the number of balls 22 having trajectory parameters for simulating line drives towards the first base player position 177 can be entered at 196. As set forth above, with respect to grounders, additional Line Drives 212 selection options can be employed wherein a user can further limit the selectable trajectory parameters for a ball 22 designated a line drive to be propelled toward the first base player position 177.

If the Bloopers option 214 is selected, the baseball practice program 90 identifies and stores predetermined trajectory parameters for delivering a ball 22 toward a location between the infield and outfield player positions. Accordingly a blooper selected for a first base player position 177 corresponds to trajectory parameters for delivering a ball 22 toward a far edge of the first base player position 177 and designed to land between a first baseman a right fielder. Accordingly, trajectory parameters are randomly identified from a predetermined range of parameters designated to propel a ball 22 from the practice machine 10 toward the outer edge of the first base player position 177. Alternatively the trajectory parameters for a specific ball 22 or series of balls 22 to be delivered from the practice machine 10 can be selected from previously stored trajectory parameters. A quantity for the number of balls 22 having trajectory parameters for simulating bloopers towards the first base player position 177 can be entered at 196. As set forth above, with respect to grounders, additional Blooper 214 selection options can be employed wherein a user can further limit the selectable trajectory parameters for a ball 22 designated a Blooper to be propelled toward the first base player position 177.

Following selecting a trajectory parameter or plurality of trajectory parameters that define the trajectories of a series of balls 22 to be propelled toward the first base player position 177, the selected trajectory parameters for each ball 22 in the series are displayed for review by a user of the practice machine 10 on the monitor 42 or display 46. The order of the trajectory parameters selected can be shuffled randomly using the Random Order selector at block 216 or otherwise modified using the Change Order/Menu shown at block 218. The FIG. 10 embodiment of the GUI for the First Base 176 player position practice mode also includes Group and Main Menu selectors 220 and 222 respectively.

Similar to the above-described control options for the First Base player position practice mode 176, the Positions practice mode 134 provides for selecting trajectory parameters directed toward each of the above-identified player positions.

Figure 20:
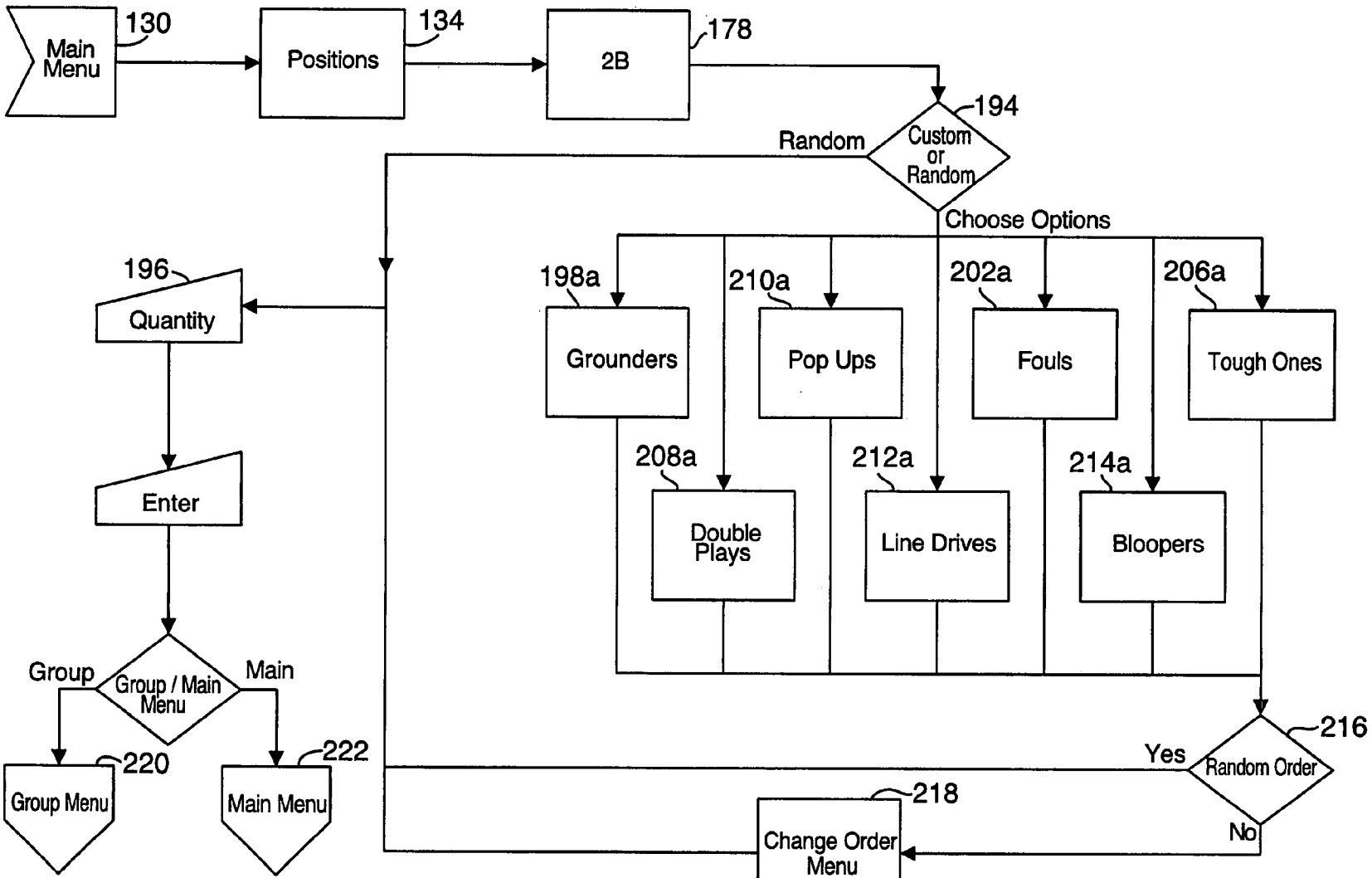
FIG. 20 is an illustration of one embodiment of a user interface for a Second Base player position practice mode for controlling the practice machine of the present invention.

FIG. 20 includes a flow chart illustrating control options for the Second Base player position practice mode 178 for selecting trajectory parameters for propelling balls 22 toward the second base player position 181. User options 198*a*, 200*a*, 202*a*, 204*a*, 206*a*, 208*a*, 212*a* and 214*a* for the Second Base player position practice mode 178 are similar to the user options having the same base reference number described above with respect to the First Base player position practice mode 176. The only difference being that for the balls 22 propelled toward the second base player position 181, the trajectory parameters are selected from different predetermined ranges of trajectory parameters designated for the Second Base player position 181.

Figure 21:
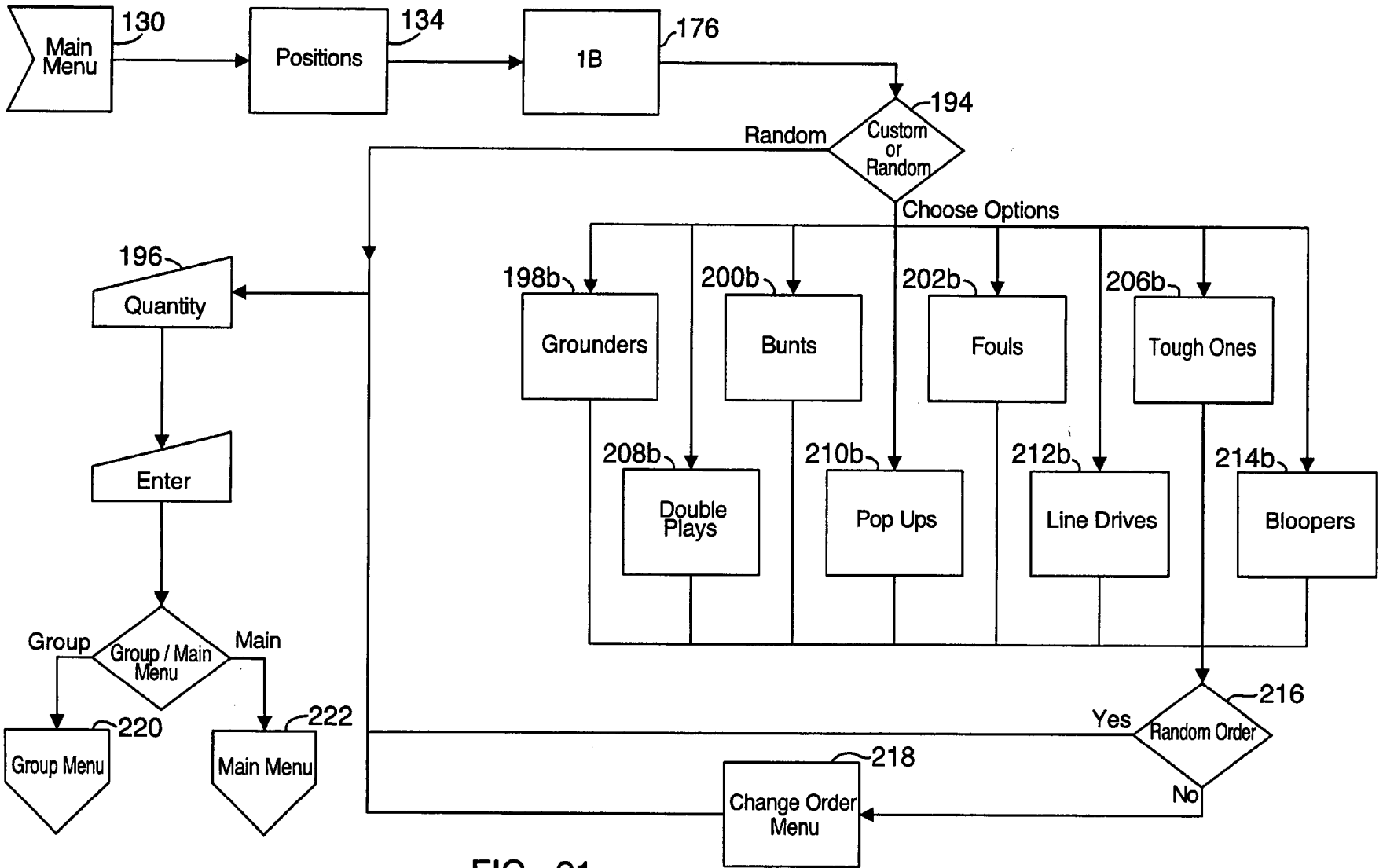
FIG. 21 is an illustration of one embodiment of a user interface for a Third Base player position practice mode for controlling the practice machine of the present invention.

FIG. 21 includes a flow chart illustrating control options for the Third Base player position practice mode 180 for selecting trajectory parameters for propelling balls 22 toward the third base player position 187. User options 198*b*, 200*b*, 202*b*, 206*b*, 208*b*, 210*b*, 212*b* and 214*b* for the Third Base player position practice mode 180 are similar to the user options having the same base reference number described above with respect to the First Base player position practice mode 176. The only difference being that for the balls 22 propelled toward the third base player position 185, the trajectory parameters are selected from different predetermined ranges of trajectory parameters designated for the third base player position 185.

Figure 22:
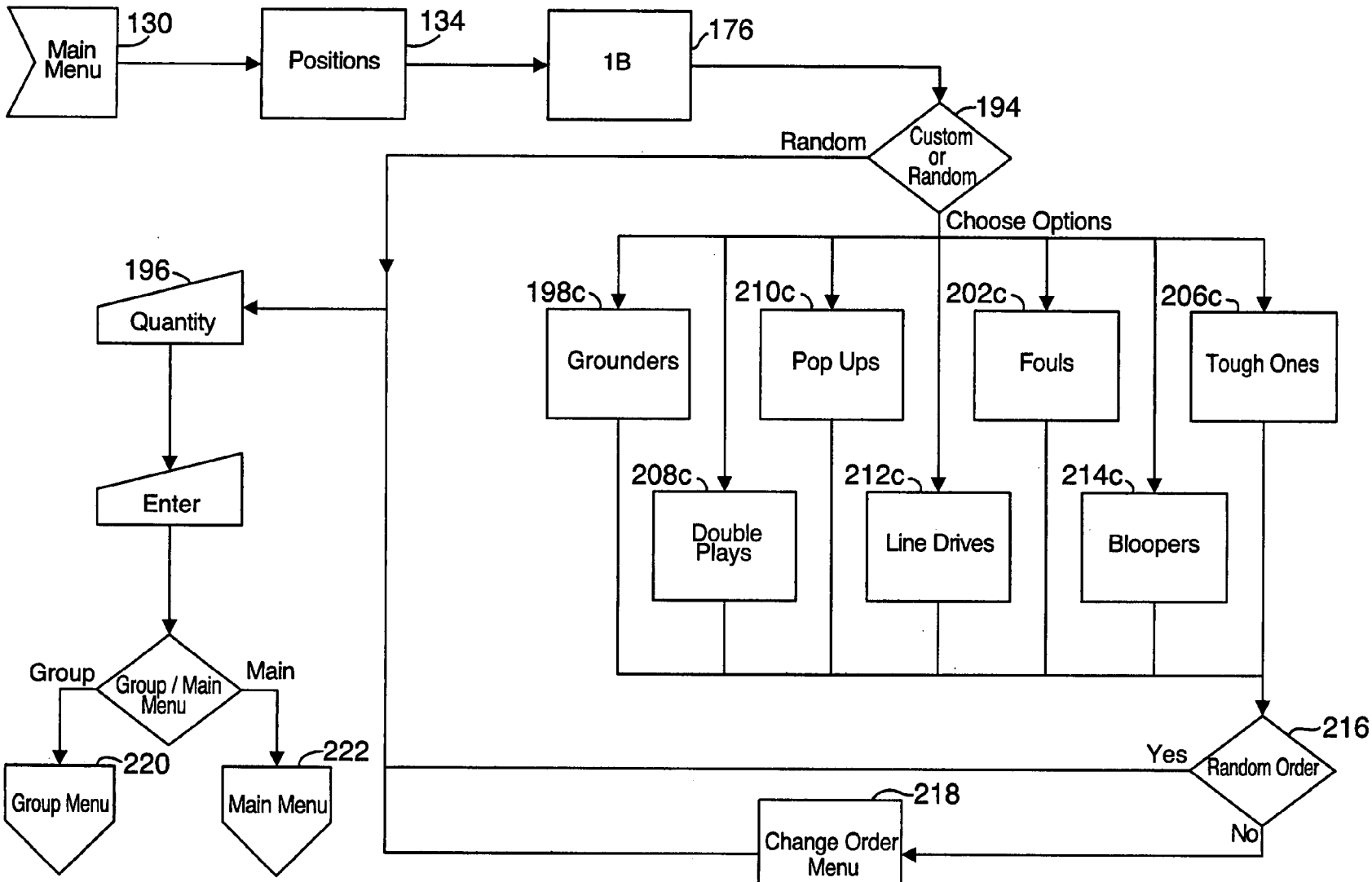
FIG. 22 is an illustration of one embodiment of a user interface for a Shortstop player position practice mode for controlling the practice machine of the present invention.

FIG. 22 includes a flow chart illustrating control options for the Shortstop player position practice mode 182 for selecting trajectory parameters for propelling balls 22 toward the shortstop player position 189. User options 198*c*, 210*c*, 202*c*, 206*c*, 208*c*, 212*c* and 214*c* for the Shortstop player position practice mode 182 are similar to the user options having the same base reference number described above with respect to the First Base player position practice mode 176. The only difference being that for the balls 22 propelled toward the shortstop player position 189, the trajectory parameters are selected from different predetermined ranges of trajectory parameters designated for the shortstop player position 189.

As shown in the above-identified flow charts, the user options for the infield player position practice modes including the, Second Base player position practice mode 178, the Third Base player position practice mode 180, and Shortstop player position practice mode 182 are similar to the user control options described above with respect to the First Base player position practice mode 176.

Figure 23:
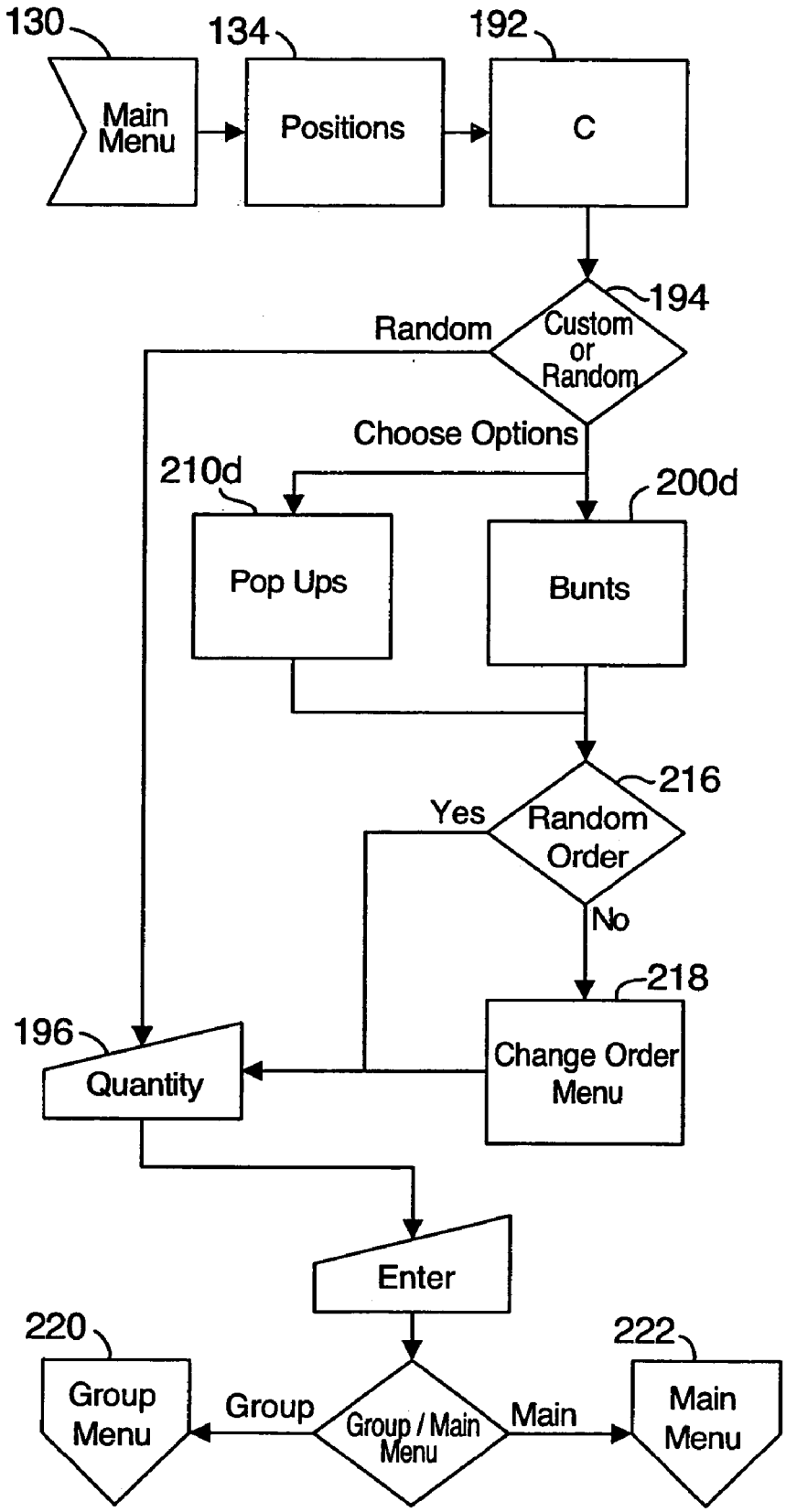
FIG. 23 is an illustration of one embodiment of a user interface for a Catcher player position practice mode for controlling the practice machine of the present invention.

FIG. 23 is a flow chart representing user control options for the Catcher player position practice mode 192. The Catcher player position practice mode 192 allows a user to configure the baseball practice program 92 and the control system 36 for causing the practice machine 10 to deliver balls 22 toward the area designated as the catcher player position 199 of the practice field 84. Similar to the other player position practice modes, at block 194 a user can select either random trajectory parameters selected from a predetermined range of trajectories directed towards the catcher player position 199 or the user can choose to define one or more trajectory parameters for balls 22 to be delivered from a practice machine 10 toward the catcher player position 199. A quantity of balls 22 to be propelled toward the catcher player position 199 can be entered at block 196 of the flow chart. Using the custom selection option, the user can select trajectories for simulating bunts at block 200*d* and pop-ups at block 210*d* to be fielded by a catcher. The pop-ups can include pop-ups in both fair and foul territory. The other selection options included on the FIG. 23 flow chart and available for defining a practice session for the catcher player position 199 are similar to those discussed above with respect to the First Base player position practice mode 176.

Figure 24:
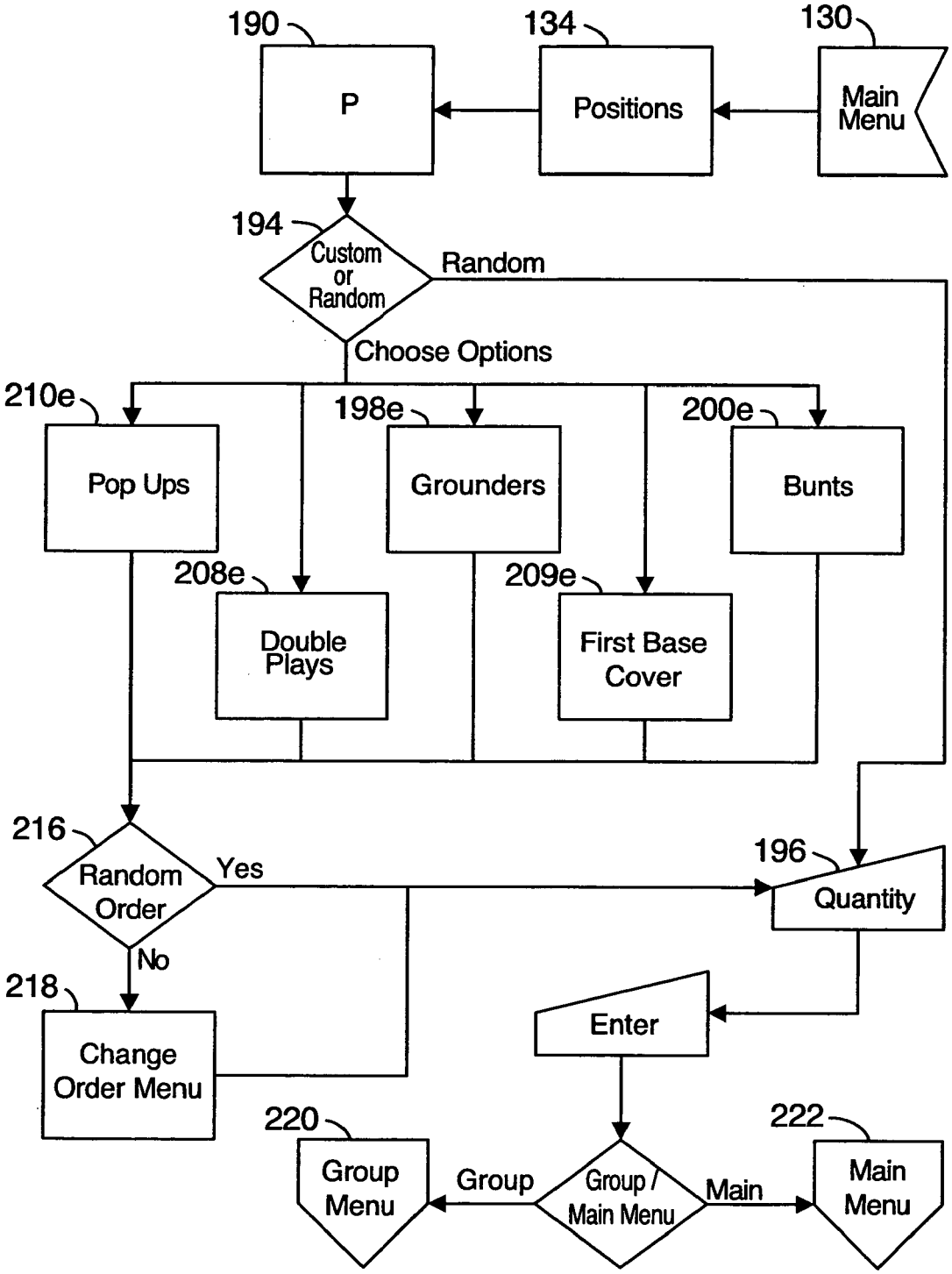
FIG. 24 is an illustration of one embodiment of a user interface for a Pitcher player position practice mode for controlling the practice machine of the present invention.

FIG. 24 is a flow chart representing user control options for the Pitcher player position practice mode 190. The Pitcher player position practice mode 190 allows the user to configure the baseball practice program 90 and the control system 36 for causing the practice machine 10 to deliver balls 22 toward the pitcher player position 197 of the practice field 84. User options 198*e*, 200*e*, 208*e*, and 210*e* for the Pitcher player position practice mode 190 are similar to the user options having the same base reference number described above with respect to the First Base player position practice mode 176. Additionally, the First Base Cover 209*e* option allows a user to select trajectory options that will propel a ball toward the first base player position 177 such that a force play at first base 179 requires a pitcher to move to first base 179 and receive a throw from a first baseman.

Figure 25:
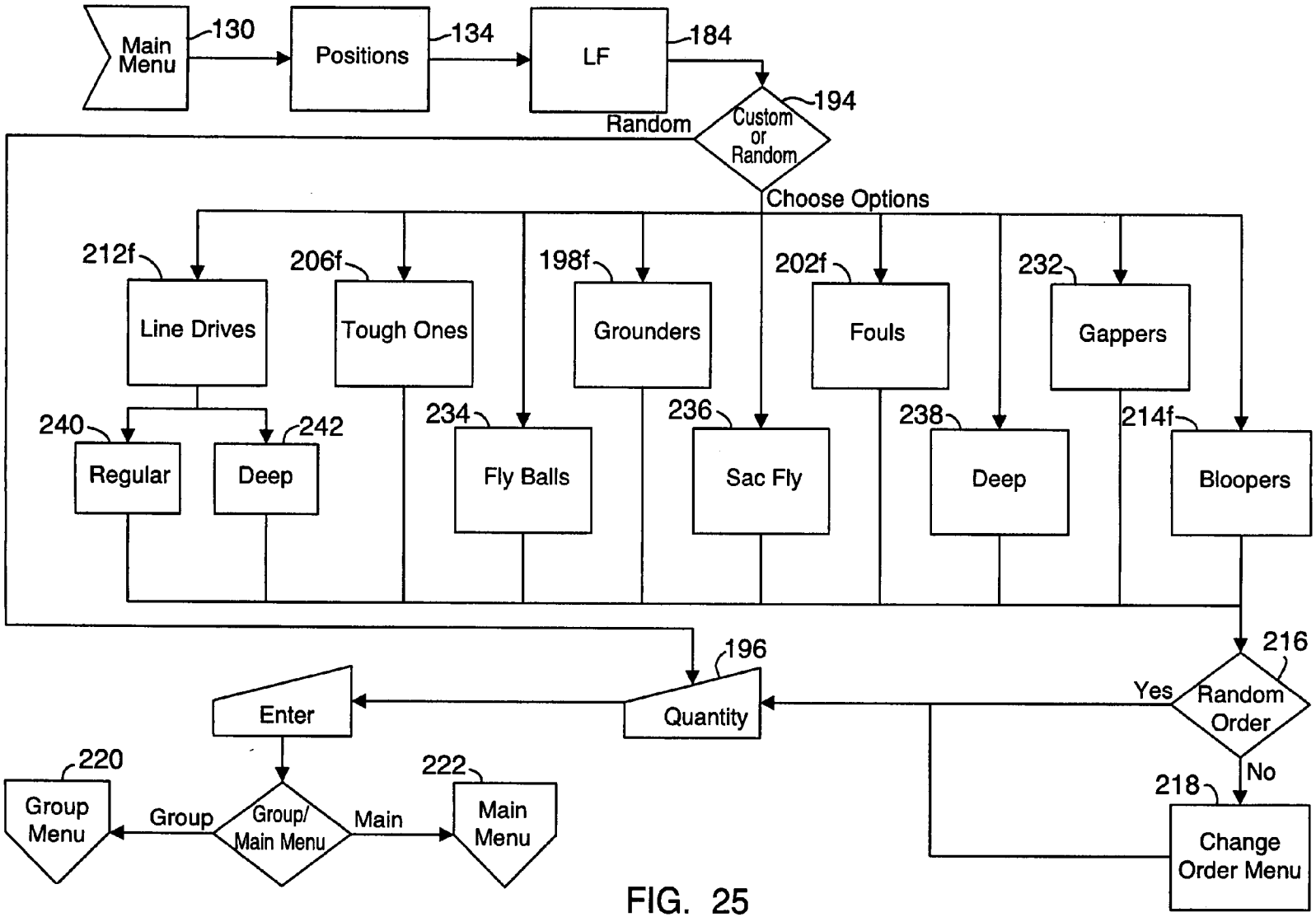
FIG. 25 is an illustration of one embodiment of a user interface for a Left Field player position practice mode for controlling the practice machine of the present invention.

FIG. 25 is a flow chart representing user control options for the Left Field player position practice mode 184. The Left Field player position practice mode 184 allows the user to configure the baseball practice program 90 and the control system 36 for causing the practice machine 10 to deliver balls 22 toward the left field player position 191 of the practice field 84. Custom trajectory parameters including trajectory parameters for simulating line drives 212*f*, grounders 198*f*, tough ones 206*f*, fouls 202*f*, and Bloopers 214*f* can be selected for balls 22 to be propelled toward the left field player position 191 similar to those described above with respect to the First Base player position practice mode 176 having the same base reference numeral.

Additionally, custom trajectory parameters can be selected for the Left Field player position practice mode 184 for Gappers at block 232. The Gappers 232 selection allow a user to select trajectory parameters for a ball 22 to be propelled toward the perimeter of predetermined area of the practice field 84 designated as the left field player position 191. Thus, the Gappers 232 selection allows a practice session to include balls 22 propelled toward areas of the practice field 84 that are between a normal range of two or more position players. For example, a ball 22 propelled toward a "gap" between the center fielder player position 193 and left field player position 191, allows one of the position players to practice signaling to, or calling off other players prior to fielding the ball 22, for the purpose of increasing defensive player communication skills. The Gappers selection 232 is provided to allow position players to practice signaling for and fielding balls 22 that could otherwise cause two or more position players to move on collision courses towards a propelled ball 22 while attempting to field the ball 22.

Referring again to FIG. 25, a Fly Ball selector 234 allows a user to select trajectory parameters determined to propel a ball 22 from the machine toward the left field player position 191 along an arcuate trajectory similar to that which is considered a fly ball to those skilled in the art. The fly ball 234 option may be used to select specific fly ball trajectory parameters as set forth below.

A Sac Fly selector 236 allows a user to select trajectory parameters for a fly ball trajectory determined to be within an outfielder's range for potentially throwing out a base runner when attempting to tag up and run when a fly ball is caught by the outfielder. Therefore, the Sac Fly option 236 allows a user to designate at least one base runner wherein an indicator 30 on the scoreboard 24 will indicate the location of a selected base runner. Accordingly, the scoreboard 24 will alert left field position player (not shown) to throw the ball 22 to a proper base following catching the ball 22 propelled from the machine 10 and representing a simulated sacrifice fly.

A Deep selector 238 allows a user to select a long fly ball wherein trajectory parameters are selected from predetermined trajectory parameters designated as fly balls corresponding to the left field player position 191 of the practice field 84. Accordingly, a ball 22 selected as a deep fly ball to the left field player position 191, would result in the control system 36 being programmed to propel a ball 22 toward a location that is near or at the far end of the left field player position 191 area of the practice field 84 which can be selected according to and within a pre-programmed or user determined distance from an outer edge of the practice field 84.

The Left Field player position practice mode 184 also includes selectors Regular 240 and Deep 242 for selecting trajectory parameters for simulating line drives propelled toward the left field player position 191. The Regular 240 selector allows a user to select trajectory parameters for a ball 22 to be propelled from the practice machine 10 toward the left field player position 191 along a substantially flat trajectory similar to a line drive. As set forth above, the actual trajectory parameters are randomly selected by the control system 36 from a plurality of predetermined trajectory parameters designed to simulate line drives directed towards the left field player position 191 of the practice field 84. The Deep 242 line drive selector allows a user to select trajectory parameters designed to propel a ball 22 along a substantially flat trajectory deep into the left field player position 191 of the practice field 84.

Figure 26:
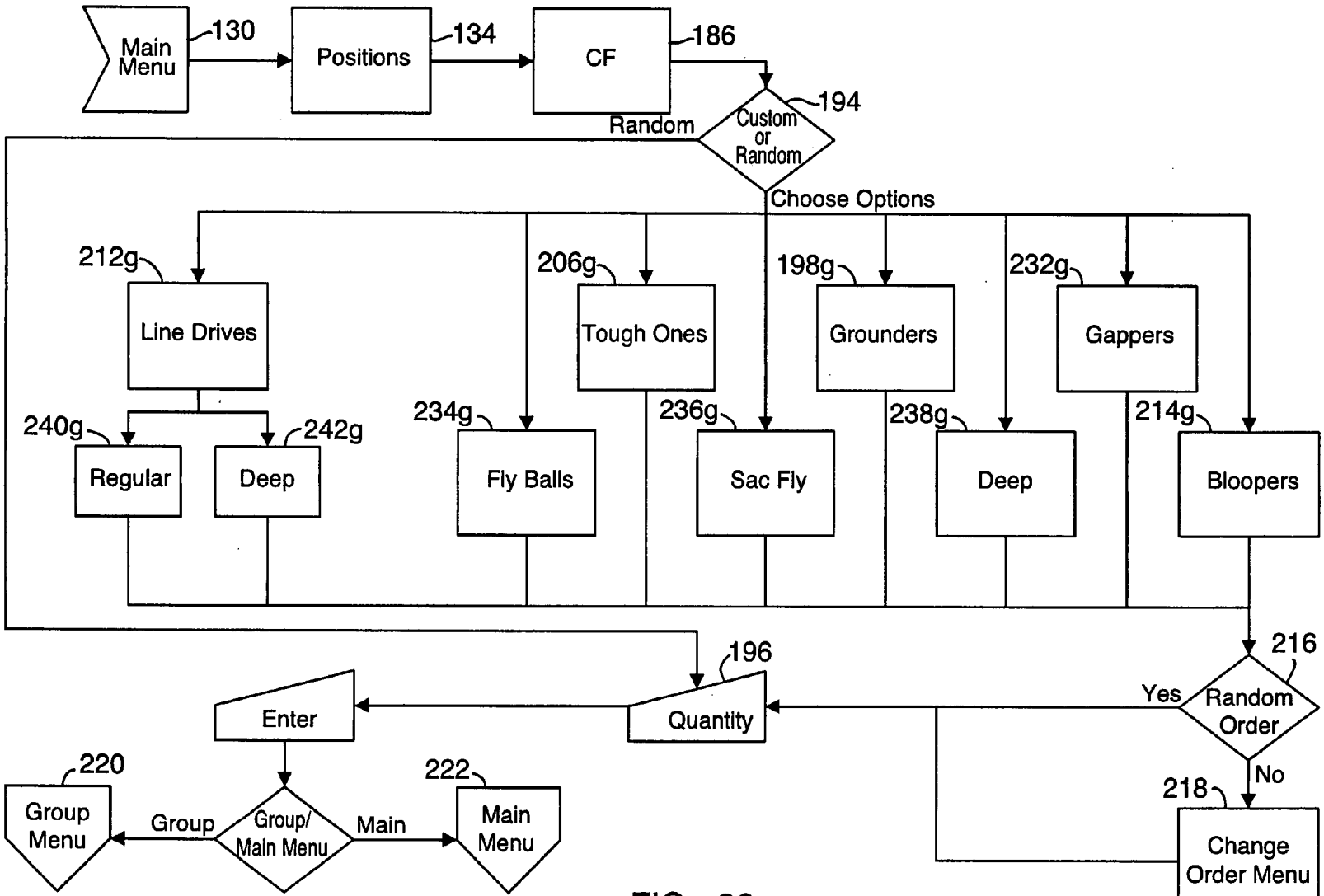
FIG. 26 is an illustration of one embodiment of a user interface for a Center Field player position practice mode for controlling the practice machine of the present invention.
Figure 27:
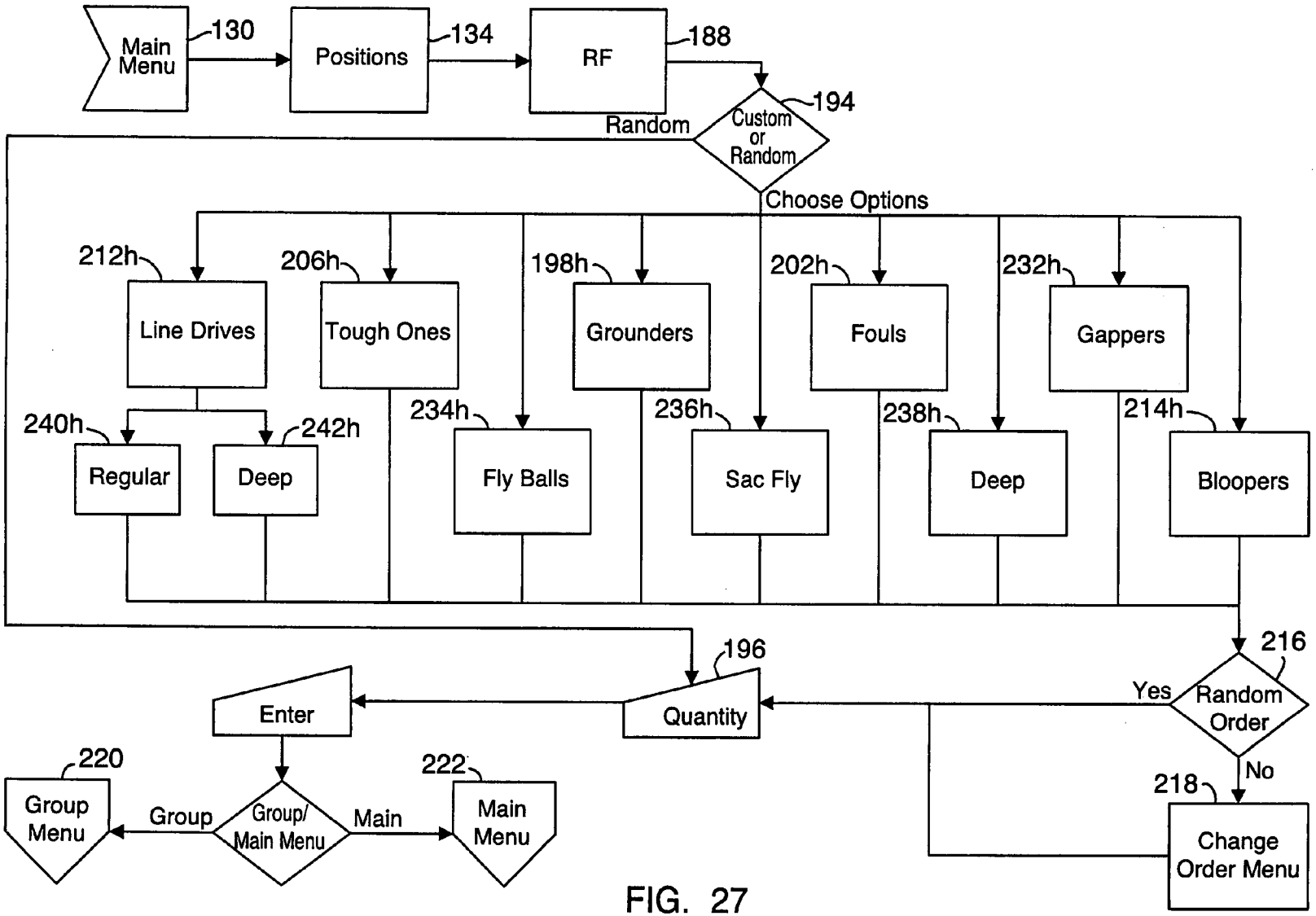
FIG. 27 is an illustration of one embodiment of a user interface for a Right Field player position practice mode for controlling the practice machine of the present invention.

FIG. 26 and 27 are flow charts representing user control options for the Center Field player position practice mode 186 and the Right Field player position practice mode 188 respectively. The Center Field 186 player position practice mode and the Right Field 188 player position practice mode allow the user to configure the baseball practice program 90 for operating the control system 36 for causing the practice machine 10 to deliver balls 22 toward the center field player position 193 and the right field player position 195 of the practice field 84 respectively. As shown in FIGS. 26 and 27, the control options for the Center Field player position practice mode 186 the Right Field player position practice mode 188 correspond to those described above for the Left Field player position practice mode 184.

For the Center Field player position practice mode 186, FIG. 26 includes user options 212*g*, 206*g*, 198*g*, and 214*g* that correspond to the user options having the same base reference number as those identified above with respect to the First Base player position practice mode 176. The user options 232*g*, 234*g*, 236*g*, 238*g*, 240*g*, and 242*g* are similar to those described above for the Left Field player position practice mode 184 having the same base reference number.

For the Right Field player position practice mode 188, FIG. 27 includes user options 212*h*, 206*h*, 198*h*, 202*h*, and 214*h* that correspond to the user options having the same base reference number as those identified above with respect to the First Base player position practice mode 176. The user options 232*h*, 234*h*, 236*h*, 238*h*, 240*h*, and 242*h* are similar to those described above for the Left Field player position practice mode 184 having the same base reference number.

As set forth above with respect to the First Base player position practice mode 176, for each of the player position practice modes, the trajectory parameters for a specific ball 22 or series of balls 22 to be delivered from the practice machine 10 can be selected from previously stored trajectory parameters corresponding to the particular player position. Additionally, for each of the player position practice modes, additional selection options can be employed wherein a user can further limit the selectable trajectory parameters for a ball 22 to be propelled toward the selected player position of the practice field 84. For example, for each of the player position practice modes, a user can select either backhand or forehand to further limit the trajectory parameters identified as selectable so that the ball 22 will be propelled toward a particular side of the selected player position area of the practice field thereby forcing the position player to practice fielding on the selected side of the fielder's body.

Figure 28:
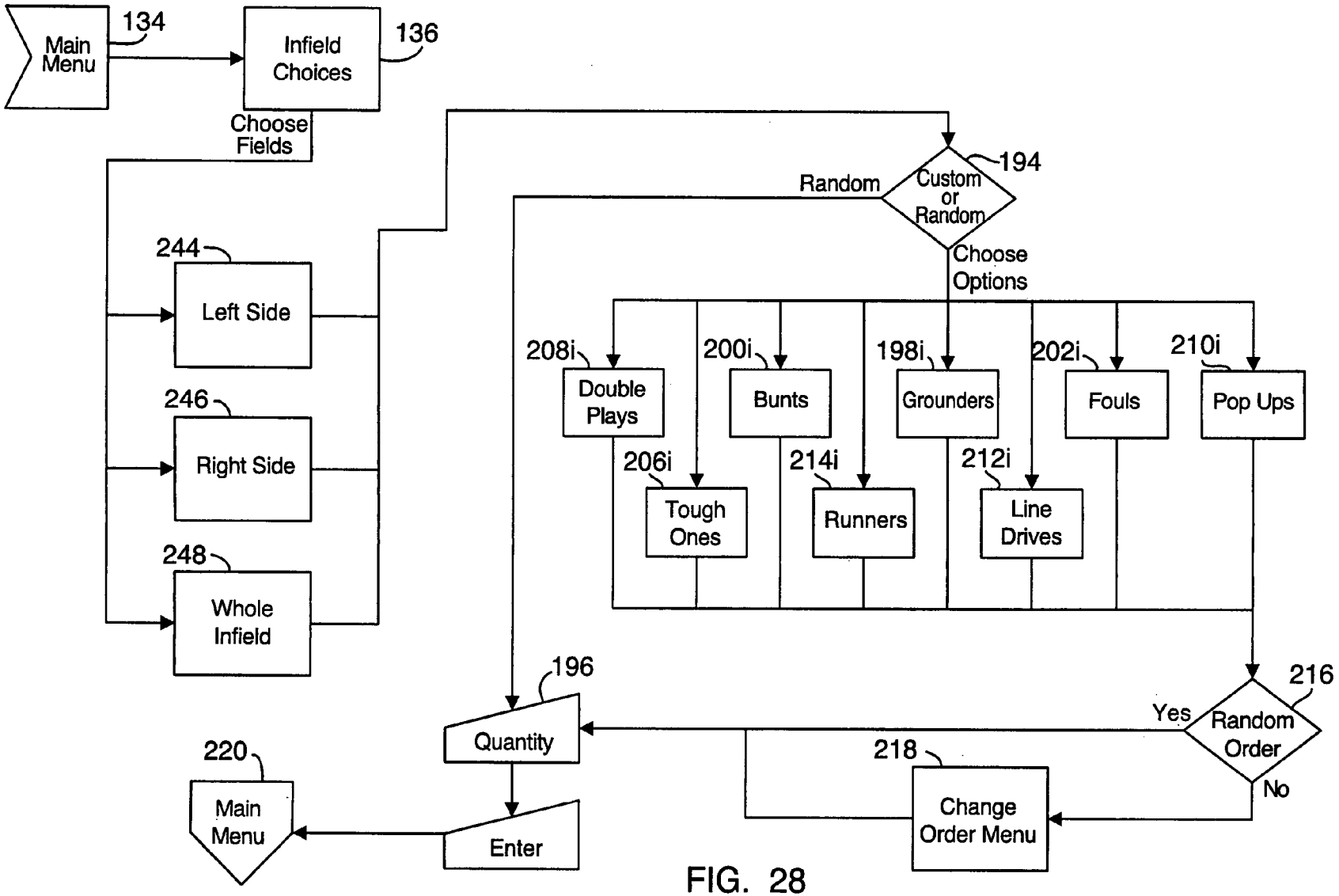
FIG. 28 is an illustration of one embodiment of a user interface for a Infield player position practice mode for controlling the practice machine of the present invention.

Referring again to the main menu 130, a user can select an Infield practice mode 136 wherein the baseball practice program 90 can be configured to operate the control system 36 for controlling the practice machine 10 to propel balls 22 toward any of the infield player positions of the practice field 84. The infield player positions include the first, second, and third base player positions 177, 181, and 185, respectively as well as the shortstop player position 189, and the pitcher and catcher player positions, 197 and 199 respectively. FIG. 28 includes a flow chart representing user control options for the Infield practice mode 136. The flow chart includes blocks 244, 246, and 248 wherein a user can select either a particular side of the infield or the whole infield for the intended destination of a ball 22 or series of balls 22 to be propelled from the practice machine 10 in an infield practice session. As set forth above with respect to the First Base player position practice mode 176, a user can choose at block 194 between random or custom options for selecting the trajectory parameters for the series of balls 22 for the infield practice session. For example, using the random option, a user can select a quantity of balls 22 and the control system 36 will randomly select trajectory parameters for a series of balls equal in number to the quantity selected. As shown in the FIG. 28 flow chart, the user options 198*i*, 200*i*, 202*i*, 206*i*, 208*i*, 210*i*, 212*i*, and 214*i* for the Infield practice mode 136 are similar to the options discussed above with respect to the individual player position option modes having the same base reference number. However, in the Infield practice mode 136, the range of trajectory parameters which are selectable for the balls 22 includes those trajectory parameters for each of the infield player positions.

Figure 29:
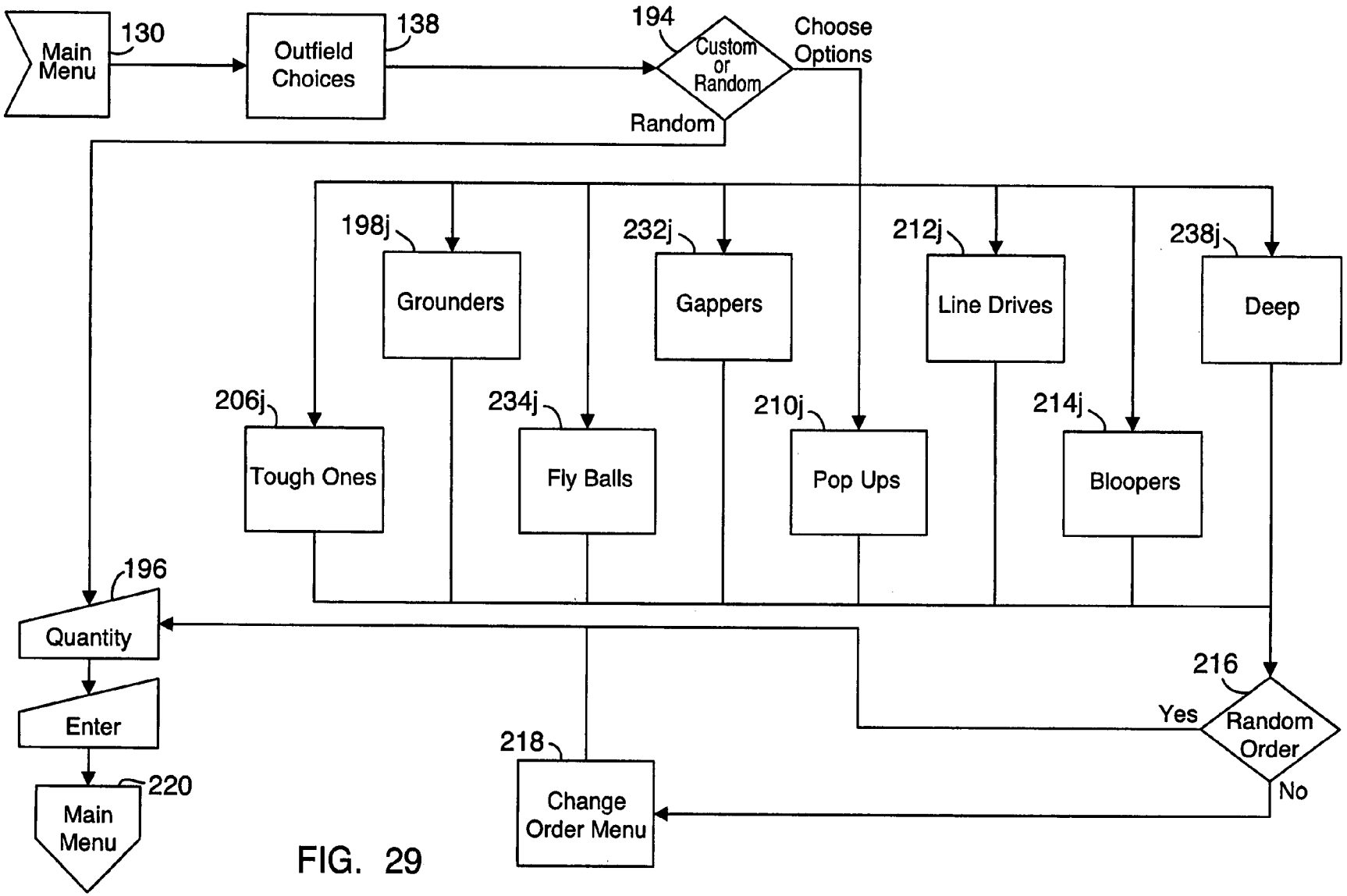
FIG. 29 is an illustration of one embodiment of a user interface for a Outfield player position practice mode for controlling the practice machine of the present invention.

The control system 36 also includes an Outfield practice mode 138 option that is selectable from the main menu 130. In the Outfield practice mode 138, the baseball practice program 90 can be configured to operate the control system 36 for controlling the practice machine 10 to propel balls 22 toward any of the outfield player positions, or group thereof. The outfield player positions include the left field player positions 191, the center field player position 193 and the right field player position 195. FIG. 29 shows a flow chart representing user control options for the Outfield practice mode 138. As shown in the FIG. 29 flow chart, the user control options for the Outfield practice mode 138 are similar to the options available for each of the individual outfield player positions. However, in the Outfield practice mode 138, the range of trajectory parameters which are selectable for the balls 22 includes those trajectory parameters for each of the outfield player positions. The user options 198*j*, 206*j*, 210*j*, 212*j*, 214*j*, 232*j*, 234*j*, and 238*j* are similar to those described above with respect to the individual outfield practice modes having the same base reference number.

Figure 30:
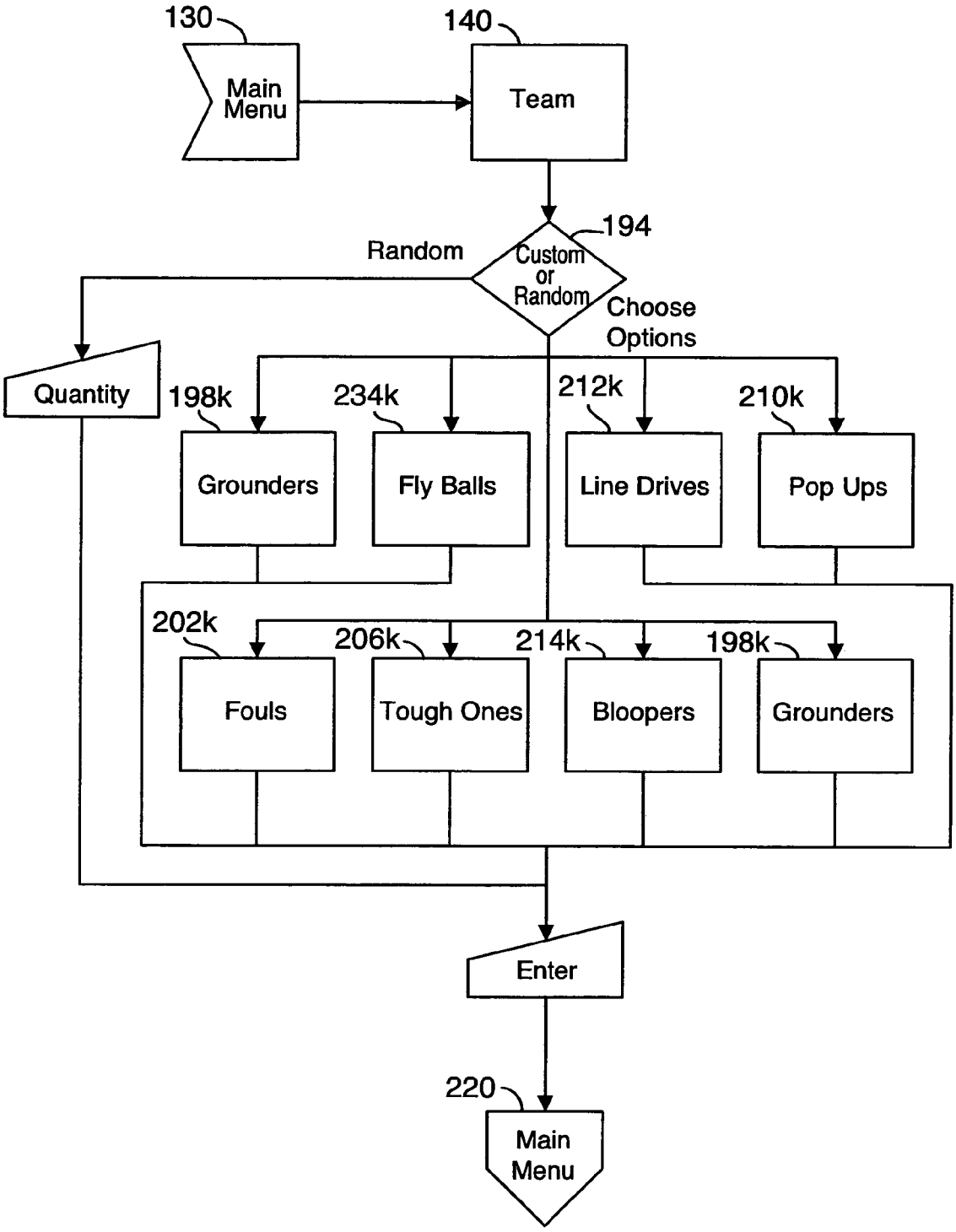
FIG. 30 is an illustration of one embodiment of a user interface for a Team player position practice mode for controlling the practice machine of the present invention.

Referring to FIG. 30, a user can select a Team practice mode 140 option is selectable from the main menu 130. In the Team practice mode 140, the baseball practice program 90 can be configured to operate the control system 36 for controlling the practice machine 10 to propel balls 22 toward any of the player positions of the practice field 84. FIG. 30 shows a flow chart representing user control options for the Team practice mode 140. As shown in the FIG. 30 flow chart, the user control options for the Team practice mode 140 are similar to the options available for each of the individual player positions. However, in the Team practice mode 140, the range of trajectory parameters which are selectable for the balls 22 include those trajectory parameters for any of the player positions and may be operated for a team as a whole.

The user options 198*k*, 202*k*, 206*k*, 210*k*, 212*k*, 214*k*, and 234*k* are similar to those options having the same base reference number and discussed above with reference to the individual player position practice modes.

Similar to the individual player position practice modes, a random/custom option is selectable at block 194 for the Team practice mode 140. In a random mode, the baseball practice program 90 is configured to randomly select trajectory parameters for a series of balls 22 to be propelled toward any of the player positions of the practice field 84. In the Team practice mode 140 using the random mode selection, the trajectory parameters are selected from those trajectory parameters identified for any of the player positions and includes trajectory parameters for any type of simulated hit. Using the custom option, a user can select one or more user defined trajectory parameters defining the trajectories of a series of balls 22 to be propelled towards the practice field to be fielded by an entire team of players.

Figure 31:
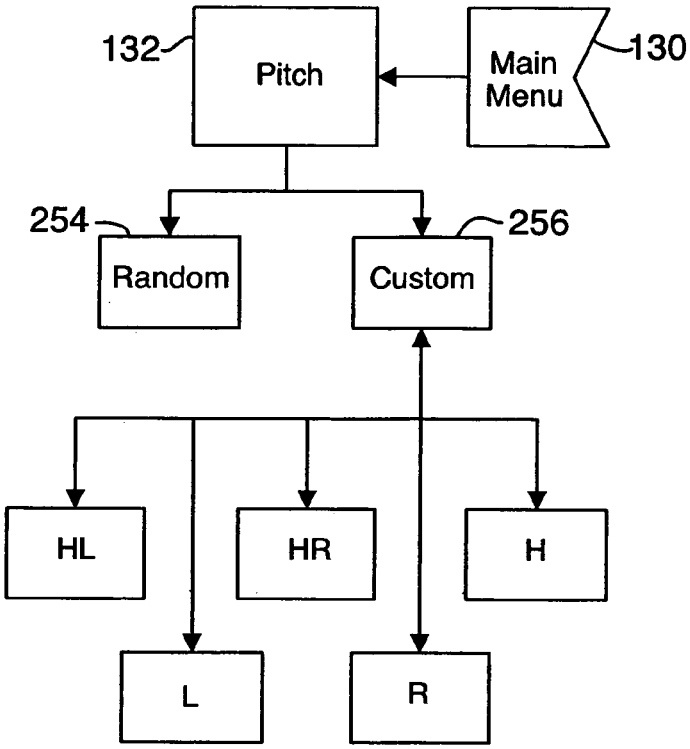
FIG. 31 is an illustration of one embodiment of a user interface for a Pitch practice mode for controlling the practice machine of the present invention.
Figure 32:
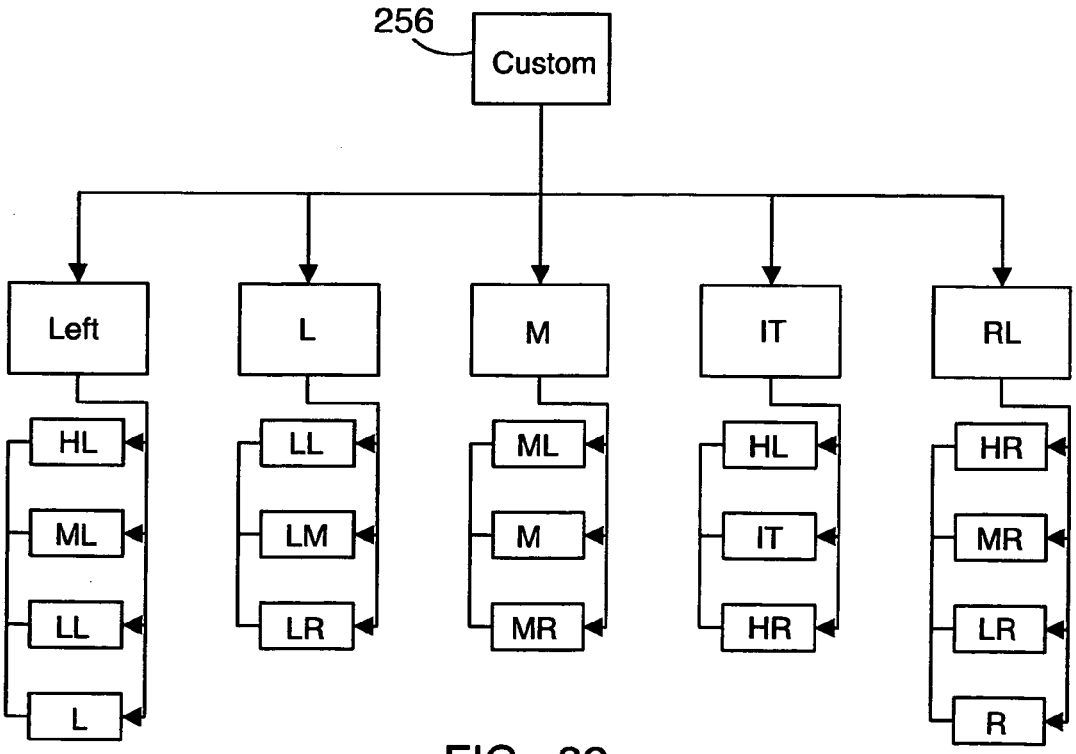
FIG. 32 is an illustration showing further options for use in programming the control system in the Pitch practice mode.

Referring to FIG. 31, a user can select a Pitch 132 practice mode option from the main menu 130. In the Pitch 132 practice mode, the control system 36 can be configured for controlling the practice machine 10 to operate as a pitching machine. In using the Pitch 132 practice mode, the practice machine 10 is positioned in the practice field 84 with the barrel opening facing home plate 87. The distance between the practice machine 10 and home plate 87 can be entered as well as a range of speeds for the balls 22 to be propelled toward home plate 87 as simulated pitches. Random or custom trajectory parameters are selectable as shown at blocks 254 and 256 respectively. Using the custom trajectory parameters selection, a user can select trajectory parameters depending on a type of pitch desired or the desired location of a propelled ball 22 relative to home plate 87 based on predetermined trajectories defining certain simulated pitches. FIG. 32 illustrates additional user options to select trajectory parameters for a ball 22 in the Pitch 132 practice mode.

Figure 33:
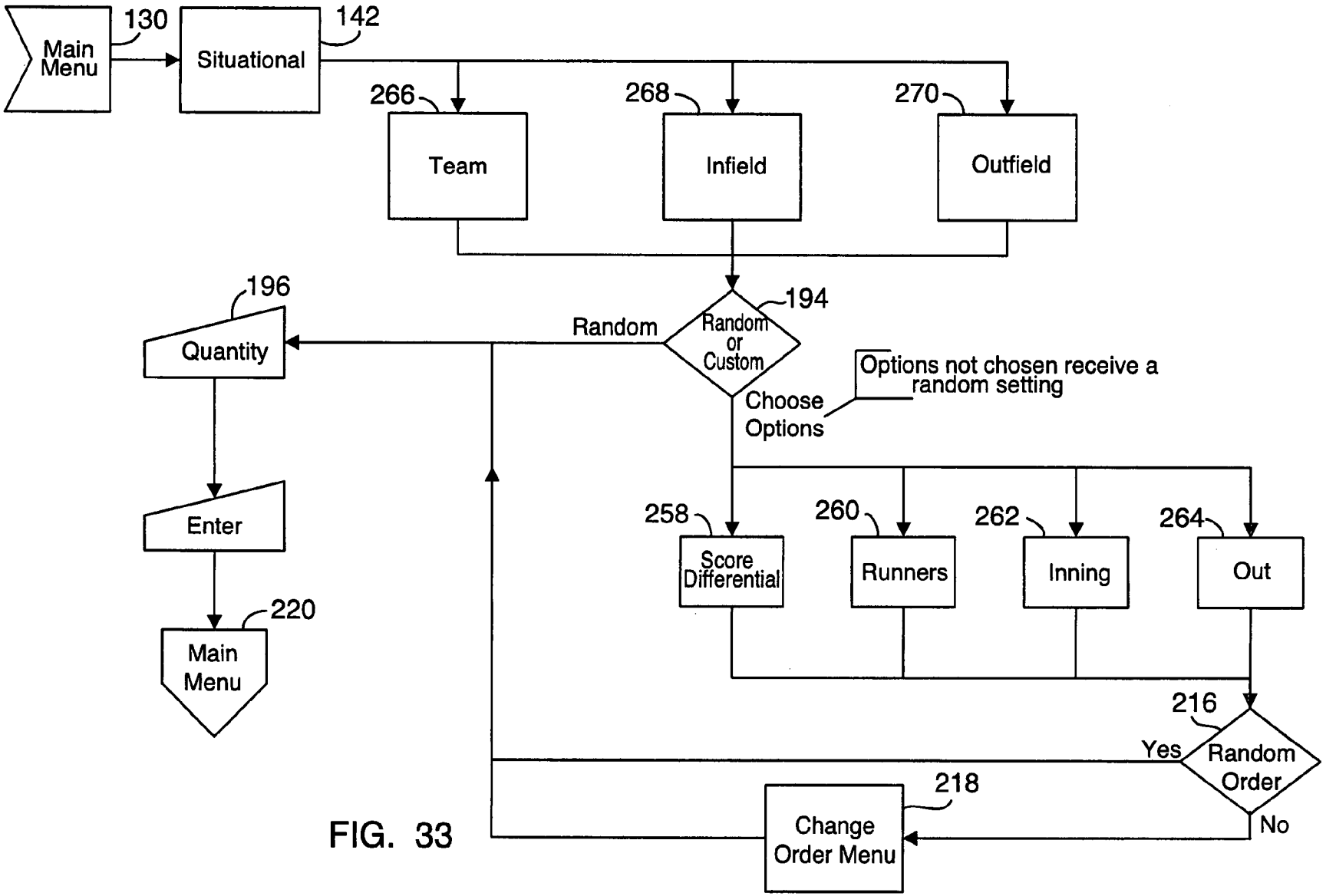
FIG. 33 is flow chart representing user control options for programming the control system of the present invention practice machine in a Situational practice mode.

Referring to FIG. 33, a user can select a Situational 142 practice mode option from the main menu 130. In the Situational 142 practice mode, the baseball practice program 90 can be configured for controlling the practice machine 10 to propel balls 22 toward any of the player positions of the practice field 84. Additionally, the Situational 142 practice mode allows a user to configure the scoreboard 24 to display information related to a hypothetical game situation for practice sessions simulating real game situations. The actual position players can field the propelled balls 22 and respond appropriately according to the game situation information displayed on the scoreboard 24 as determined randomly by the control system 36 or manually by a user.

As show in FIG. 33, a user can input the hypothetical game situation information by selecting a score differential at block 258. Base runners can be assigned to one or more of first base 179, second base 183, or third base 187 at block 260. At block 262 an inning number can be entered. A user can enter a number of outs for the inning at block 264. Random selections are entered for the above-identified game situation parameters not entered by a user.

A flow chart representing user control options for the Situational 142 practice mode is shown in FIG. 33. The trajectory parameters for a ball 22 or series of balls 22 for the Situational 142 practice mode can be selected randomly for any of the player positions in a Team option at block 266. The Infield player positions can be selected at 268 and the Outfield player positions at 270. The user control options for the Situational 142 practice mode are similar to the options available for each of the individual player positions.

Figure 34:
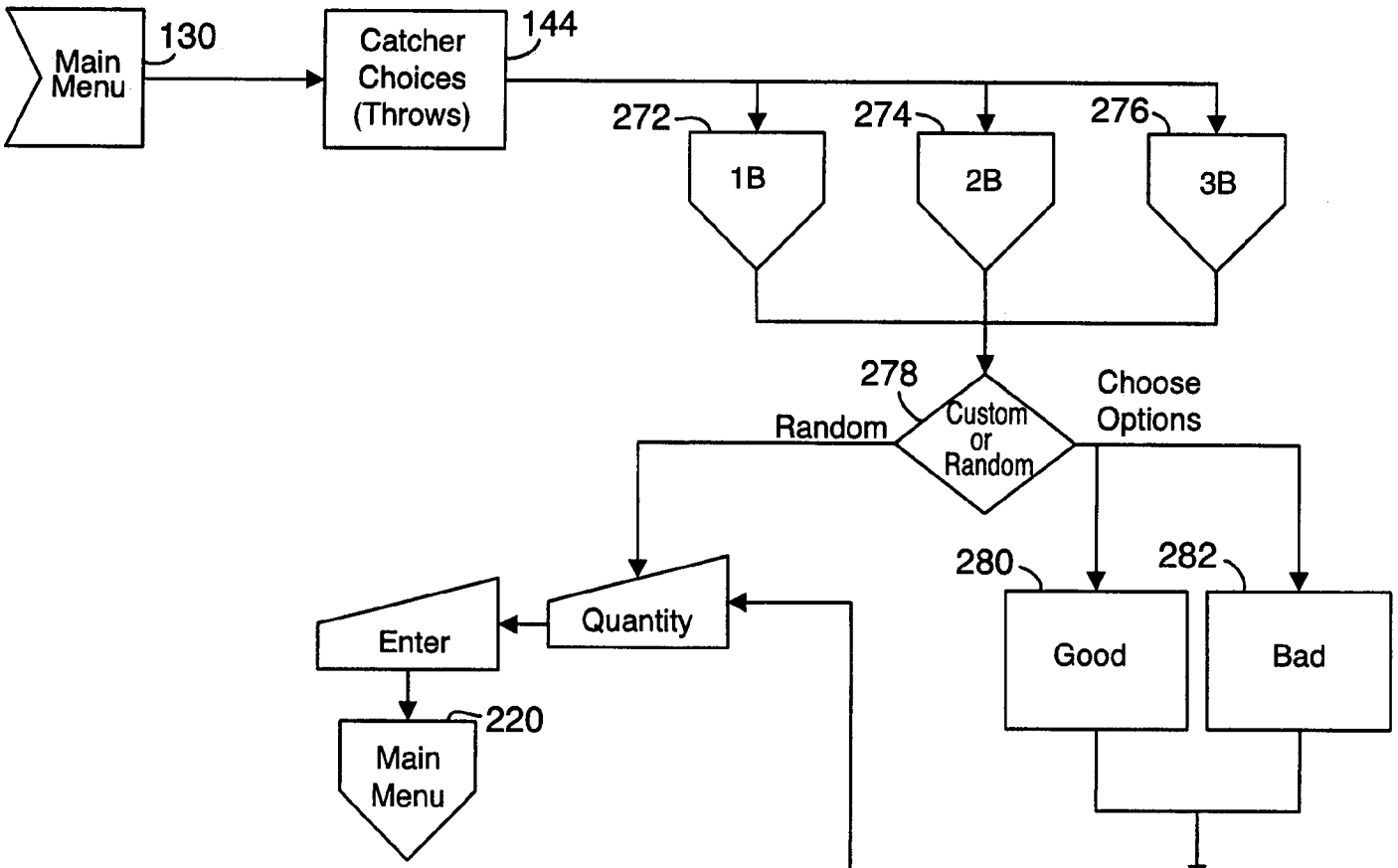
FIG. 34 is flow chart representing user control options for programming the control system of the present invention practice machine in a Catcher Throw practice mode.

FIG. 34 shows a flow chart representing user control options for the Catcher Throw 144 practice mode that is user selectable from the main menu 132. The Catcher Throw 144 practice mode is designed to provide practice situations for measuring a base runner's speed and ability, and for practicing defensive plays to defend against base runners stealing bases. The trajectory parameters for a ball 22 or series of balls 22 for the Catcher Throw 144 practice mode can be selected for first base at block 272, second base at 274 and third base at block 276. A user can choose between a random or custom trajectory parameter selection for each ball 22 at block 278. If the custom choice is selected, a user can further define the trajectory parameters for a simulated throw toward the selected base choosing either a good throw at block 282 or a bad throw at block 284. As set forth above, the user options are utilized by the baseball practice program 90 to identify the appropriate ranges of predetermined trajectory parameters stored in the memory of the control system 36 from which to randomly select and thereby establish the trajectory parameters for each ball 22 to be propelled from the practice machine 10. Thus, user selections for a good throw toward second base 183 corresponds to certain ranges of the predetermined trajectory parameters identified in the FIG. 19B chart and stored in the memory of the control system 36. The remaining user control options for the Catcher Throw 144 practice mode are similar to the above-identified options available for each of the individual player positions. Balls 22 propelled from the practice machine 10 using the Catcher Throw 144 practice mode utilize trajectory parameters corresponding to the age and skill level of the intended players and may be increased, decreased, adjusted or saved by a user at any time during a practice session as set forth above.

Figure 35:
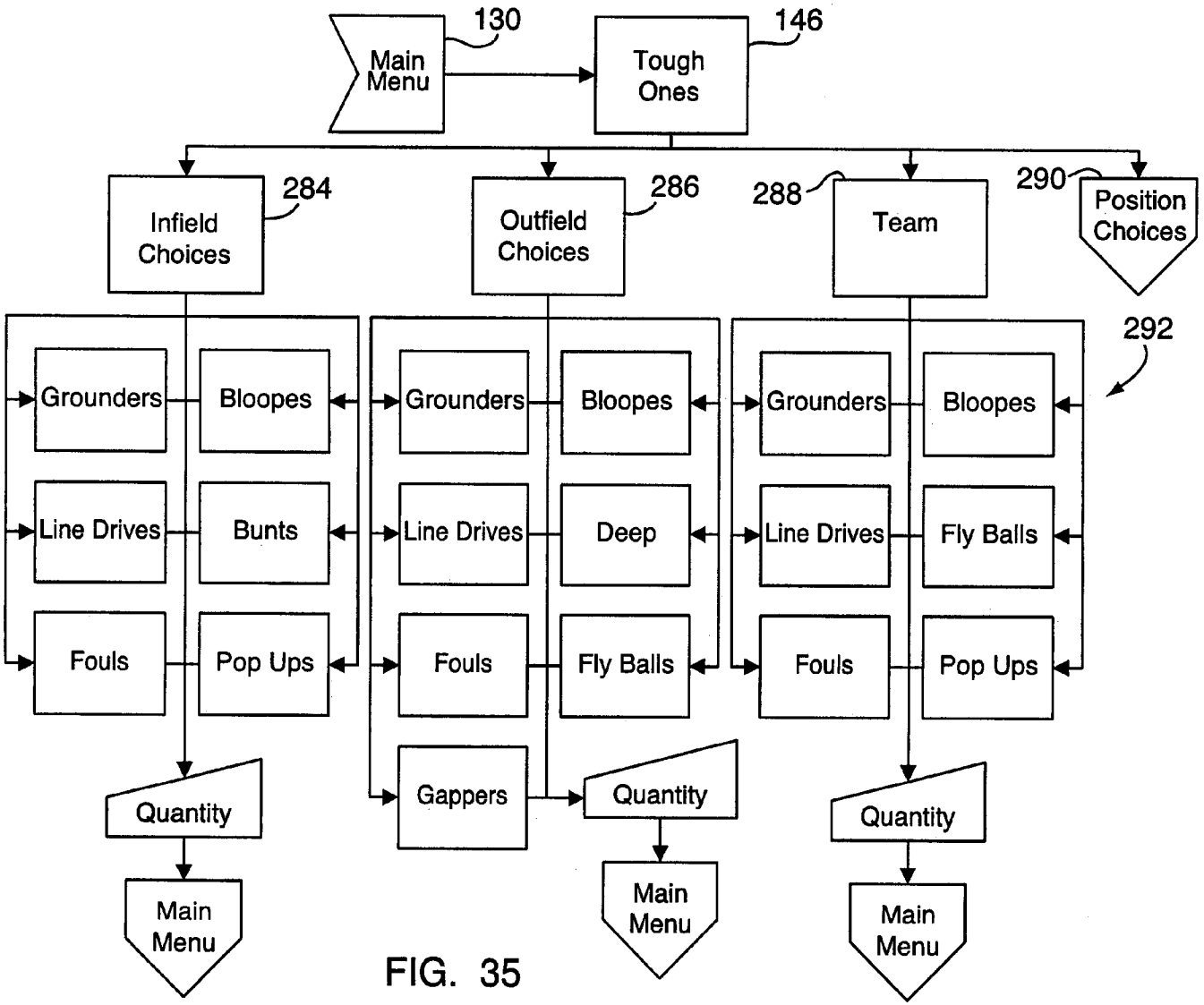
FIG. 35 is flow chart representing user control options for programming the control system of the present invention practice machine in a Tough Ones practice mode.

Referring again to the main menu 130, a user can select an Tough Ones 146 practice mode wherein the baseball practice program 90 can be configured to operate the control system 36 for controlling the practice machine 10 to propel balls 22 toward any of the player positions of the practice field 84. FIG. 35 includes a flow chart representing user control options for the Tough Ones 146 practice mode. The flow chart includes blocks 284, 286, and 288 wherein a user can select the infield player positions, the outfield player positions or all of the player positions (Team), respectively. At block 290 a user can select an individual player position. For the selected player position(s), a user can then select a type of simulated hit from those identified generally at reference numeral 292. The baseball practice program 90 identifies, based on the user selections, the appropriate range of trajectory parameters from the stored data and randomly selects therefrom the trajectory parameters for a ball 22 or series of balls 22 to be propelled from the practice machine 10 along trajectories consistent with tough defensive plays in the field for a selected defensive player position. Additional user control options for the Tough Ones 146 practice mode are similar to the above-identified options available for each of the individual player positions.

Figure 36:
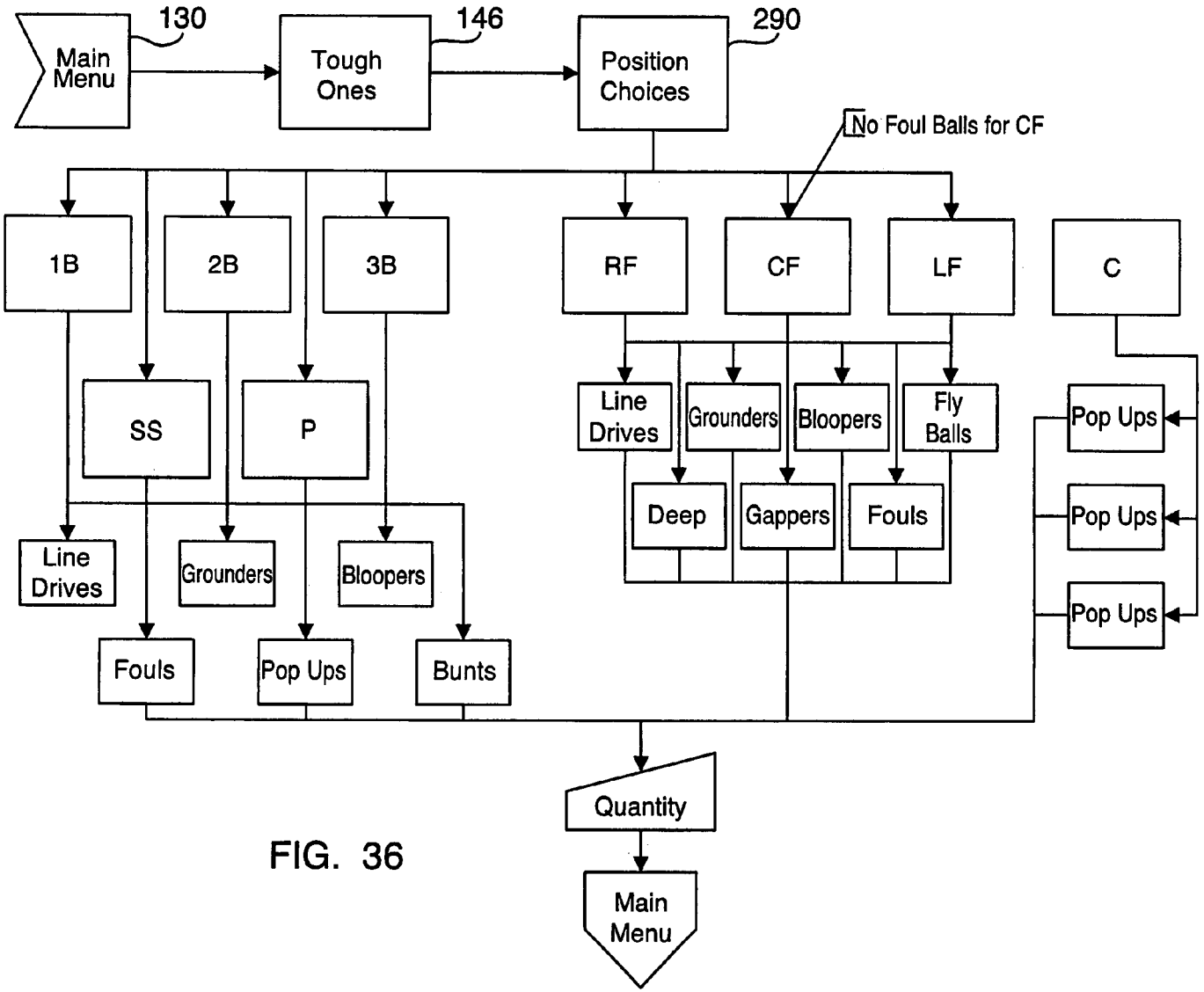
FIG. 36 is flow chart showing additional user control options for programming the control system of the present invention practice machine in the Tough Ones practice mode.

FIG. 36 includes a flow chart illustrating one embodiment of the user options for the player position 290 option of the Tough Ones 146 practice mode. As set forth in the flow chart, a user can further define the trajectory parameters for a simulated hit for a Tough Ones 146 practice session for each of the player positions. Although the user selection options for each of the player positions appear similar to those of the player position practice modes discussed above, in the Tough Ones 146 practice mode, the predetermined ranges of trajectory parameters are more limited. For example, the predetermined ranges for the Tough Ones 146 selections of trajectory parameters for a foul ball toward the first base player position 177 are limited to those trajectory parameters that will result in a ball 22 being propelled toward the outer edges of the first base player position thereby causing the fielder to move to a position near a limit of his/her range in the practice field 84. Thus, the Tough Ones 146 practice mode provides means for a player to practice fielding balls 22 at the limits of his/her range on the practice field 84.

Figure 37:
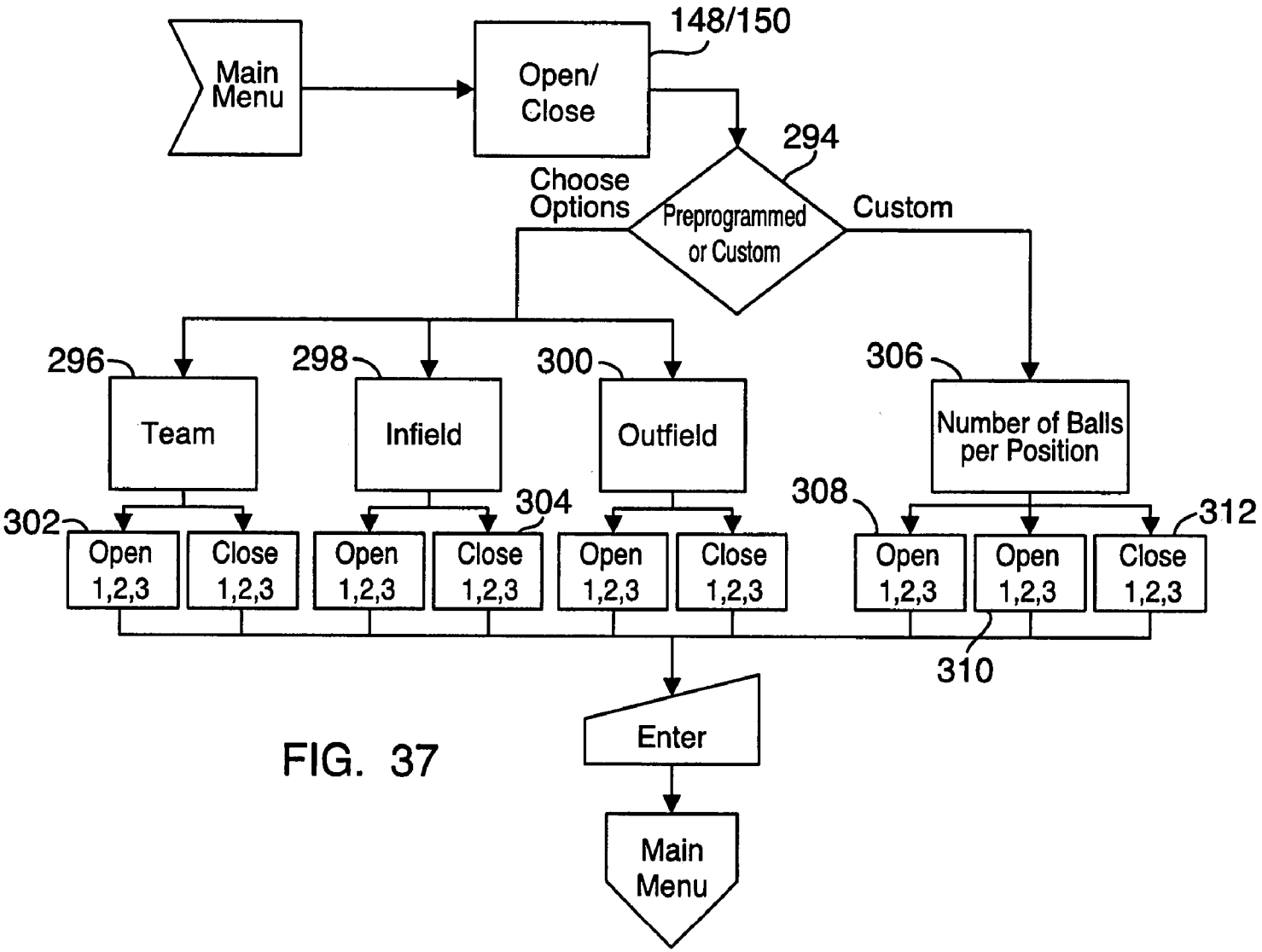
FIG. 37 is flow chart representing user control options for programming the control system of the present invention practice machine in an Open or Close practice mode.

FIG. 37 is a flow chart representing user control options for both of the Open 148 practice mode and the Close 150 practice mode options selectable from the main menu 130. The Open 148 and Close 150 allow a user to configure the baseball practice program 90 and the control system 36 for causing the practice machine 10 to deliver a series of balls 22 toward the player positions of the practice field 84 for use in warm-up and cool-down drills respectively as when a team takes or leaves the practice field. FIG. 37 represents the flow chart for both the Open 148 practice mode and the Close 150 practice mode. A user can choose a pre-programmed practice session or design a custom opening or closing practice session at block 294. Using the pre-programmed option, a user can select an opening or closing practice sessions for each of the entire team at block 296, the infield player positions at 298 and the outfield player positions at 300. For each of the groups of player positions selected, a user can select the identifier for a desired practice session. For example, at block 302 a user can select the pre-programmed opening practice session number 1. At the entered start time for the Open 148 practice mode, the control system 36 will then proceed to propel a predetermined number of balls 22 towards the player positions of the entire team in accordance with the trajectory parameters previously stored for the opening practice session number 1. Similarly, a previously stored closing practice session for the infield player positions can be selected at block 304 wherein a selected number of balls 22 are propelled toward each player position of the infield and which may constitute a routine to be used each time the infield players take the field or prepare to leave the practice field.

Choosing the custom selection at block 294 allows a user to select a quantity of balls 22 at block 306. For each ball 22 or series of balls 22, the user can then proceed to select trajectory parameters starting with the group of player positions at blocks 308 for the all of the player positions (Team), block 310 for the infield player positions, and block 312 for the outfield player positions. The custom selection for the Open 148 and Close 150 practice modes continues as set forth above for each of the groups of player positions selected.

Figure 38:
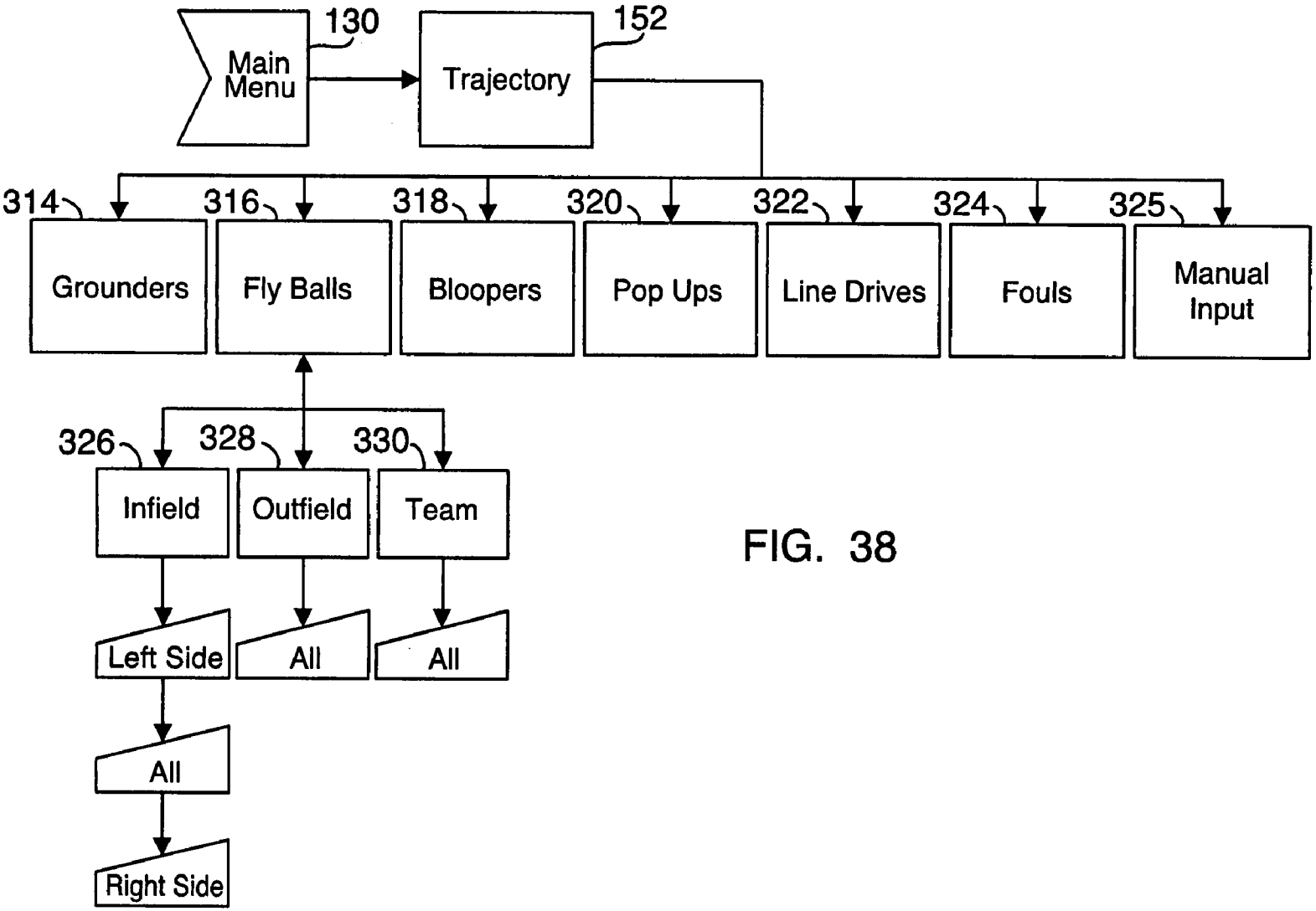
FIG. 38 is flow chart representing user control options for programming the control system of the present invention practice machine in an Trajectory practice mode.

As shown in FIG. 38, a user can select a Trajectory 152 practice mode option from the main menu 130. In the Trajectory 152 practice mode, a user can configure the baseball practice program 90 for controlling the practice machine 10 to propel balls 22 toward any of the player positions based on the trajectory of the propelled ball 22. As shown in FIG. 38, a user can select grounders at block 314, fly balls at block 316, bloopers at block 318, pop-ups at block 320, line drives at block 322, and fouls at block 324. The user can choose a group of player positions to be included in the practice session at blocks 326, 328, and 330. Based on the user selections, the baseball practice program 90 establishes the order of, and the trajectory parameters for each of the balls 22 to be propelled in the practice session as set forth above. Alternatively, at block 325, a user can manually input trajectory parameters for a ball 22 or a series of balls 22 to be propelled from the practice machine 10. The manual inputs include both vertical and horizontal angular positions for movable barrel 18 as well as the desired speed for the ball 22. Additionally, if desired the speed of the ball 22 can be input by inputting the desired rotational speed for each of the rotating wheels 56 and 58 can be input such that the spin imparted to a ball 22 can be directly controlled by a user.

Figure 39:
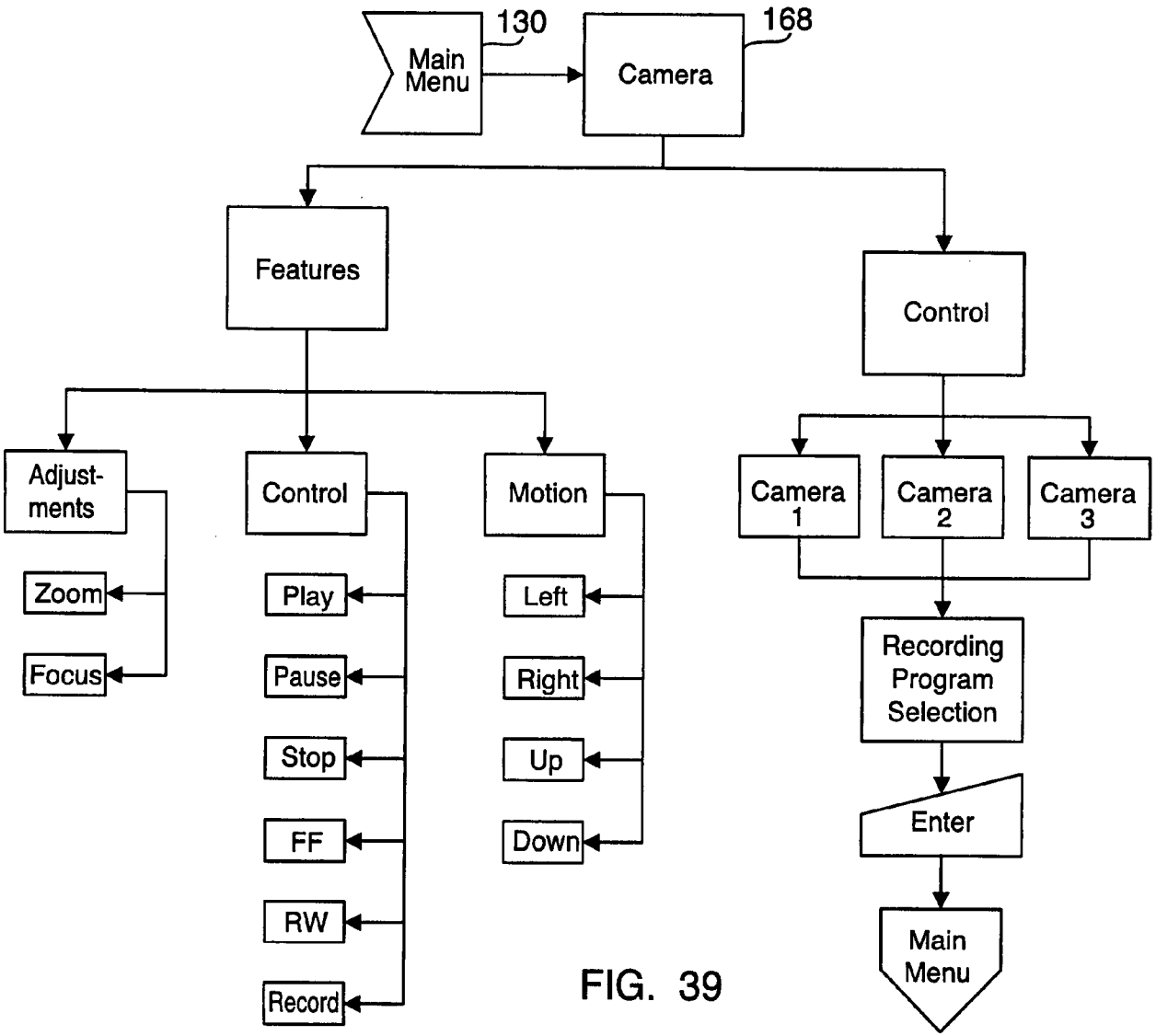
FIG. 39 is flow chart representing user control options for controlling a camera attached to a practice machine according to the present invention.

The operation of the cameras 88 mounted on the practice machine 10 can also be controlled by the control system 36 via the main menu 130 at block 168. FIG. 39 is a flow chart representing user selectable control options for the cameras 88. The cameras 88 are preferably standard digital video cameras wherein the use of and control operations are equivalent to state of the art video cameras and known to those skilled in the art of video equipment. The cameras 88 are mounted to the practice machine 10 for recording the practice sessions of the position players fielding the balls 22 propelled from the practice machine. In a preferred embodiment, the cameras 88 are coupled to and automatically controlled by the control system 36 based on the trajectory parameters of the balls 22 to be propelled from the practice machine 10. In an automatic camera control mode the control system 36 controls the cameras 88 to focus on and record the location of the practice field 84 where a next ball 22 propelled from the practice machine 10 is intended to land on the practice field. Thus, in the automatic mode, the cameras 88 are aimed toward, focused, and recording the area of the practice field where a ball 22 is intended to land or be caught by a position player, prior to the ball leaving the practice machine 10. Accordingly, the players can review the tape of the camera recorded practice sessions for use in improving their baseball fielding skills.

Figure 40:
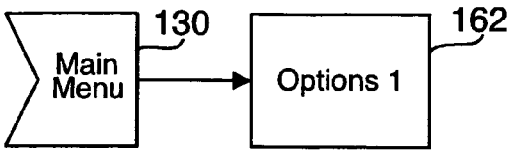
FIGS. 40 and 40A–40G are flow charts representing user control options for direct control of the control system of a practice machine according to the present invention.
Figure 40A:
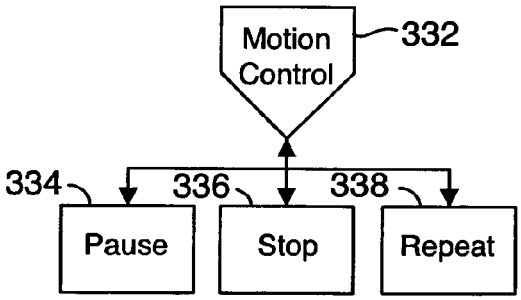
Figure 40B:
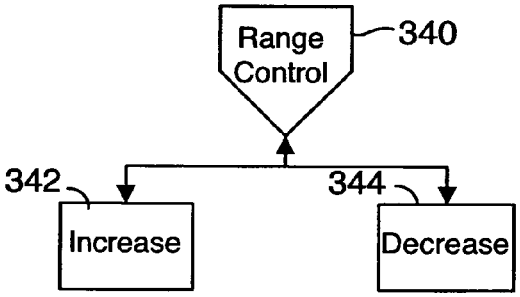
Figure 40C:
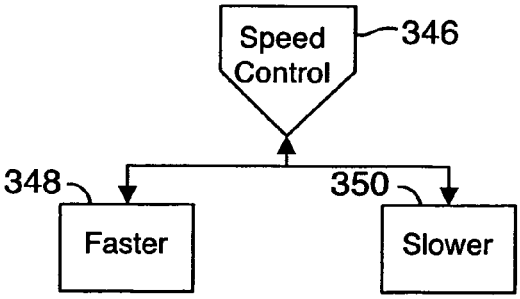

Referring to FIG. 40, the control system 36 can be also be controlled by a user directly from the main menu 130 using direct control features. Using the Options 1 key 162 on the main menu 130 the operator can access a user interface for directly controlling the control system 36. FIG. 40 includes flow charts representing user selectable controls for direct control of the control system 36.

FIG. 40-A, shows a user can select a Motion Control option at block 332 wherein an operating practice mode can be immediately paused (block 334), stopped (block 336) or skipped (not shown), and other options relevant to the operation of programs for controlling the practice machine 10. The repeat key (block 338) allows a user to operate the control system 36 to immediately repeat the trajectory of a previously propelled ball 22 with a next ball 22. The Motion Control option allows a user/coach to stop or pause the practice machine 10 for allowing a coach to provide immediate hands-on instructions to one or more of the position players.

Referring to FIG. 40-B, a range control feature (block 340) allows a user to directly adjust the horizontal distance of a next ball 22 to be propelled from the practice machine 10 based on the horizontal distance traveled of a previous ball 22 while maintaining approximately the same trajectory. A user simply chooses to increase (block 342) or decrease (block 344) the distance the ball traveled, while maintaining the same general trajectory, and the baseball practice program 90 will make the necessary adjustments before the next ball 22 is launched. The range control option may be used to adjust the horizontal range for a single ball to repeat the trajectory of a previous ball or to adjust the range for any ball 22 in a selected practice mode.

Similarly, FIG. 40-C illustrates a speed control selector (block 346) allows a user to directly adjust the speed of the rotating wheels for a next ball 22 to be propelled from the practice machine 10 based on the speed of the previous ball 22. A user simply choose to increase (block 348) or decrease (block 350) the speed parameters for the next ball 22 to be propelled from the practice machine 10, while maintaining the same general trajectory. The speed control 346 may be used to adjust the speed for a single next ball to repeat the trajectory of a previous ball 22 or to adjust the speed for any ball 22 in a selected practice mode.

Figure 40D:
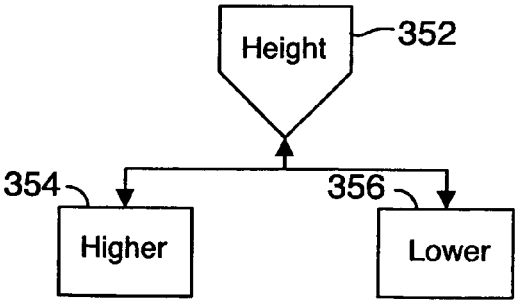

A height control selector (block 352) shown in FIG. 40D, allows a user to directly adjust the height of the trajectory (hang time of a propelled ball 22) for a next ball 22 to be propelled from the practice machine 10 based on the height of the trajectory of a previous ball 22 while maintaining the intended landing point of the previously launched ball. A user simply choose to increase (higher) at block 354 or decrease (lower) at block 356 the height of the trajectory of a next ball 22 to be propelled from the practice machine 10. The height control 352 may be used to adjust the height for a single next ball to repeat the trajectory of a previous ball 22 or to adjust the height for any ball 22 in a selected practice mode.

Figure 40E:
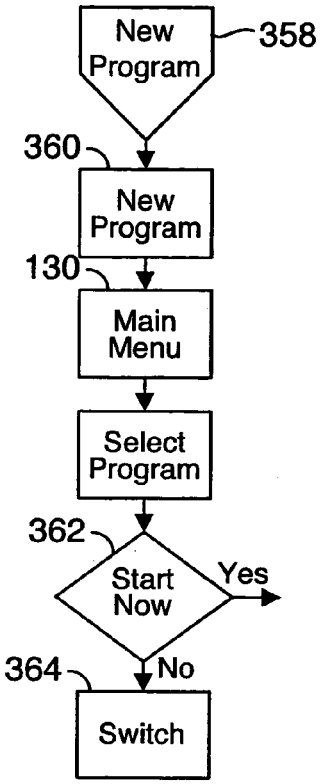

Referring to FIG. 40E, a program transfer control selector (block 358) allows a user to cancel an operating or current practice mode and select a new program or new practice mode. The new program control returns a user to the main menu 130 at block 360 wherein a new practice mode can be selected. A start control illustrated at block 362 allows a user to restart the practice machine 10 within the selected new practice mode or reselect a different practice mode at the switch block 364.

Figure 40F:
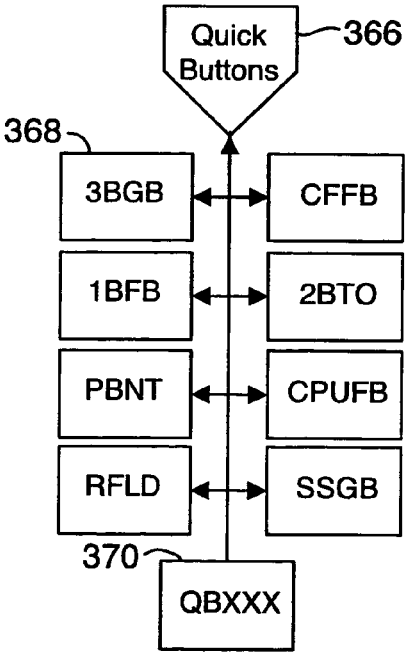

Referring again to the main menu 130, a user can select a Quick Buttons 158 option for directly controlling the control system 36 and the operation of the practice machine 10. As shown in FIG. 40F, the Quick Buttons (block 366) allow a user to select previously stored trajectory parameters for a specific trajectory, a plurality of trajectories or a specific practice mode. Thus, the Quick Buttons are used to define a plurality of trajectory parameters that will determine the trajectory of a next ball 22 or a series thereof, to be propelled from the practice machine 10 in accordance with the stored trajectory parameters. To store the Quick Button trajectory parameters, a user simply selects the desired trajectory parameters, or a specific practice mode to be used and using the save button on the user interface for the practice mode, the selected trajectory parameters can be assigned to one of the Quick Buttons. In the embodiment shown, the Quick Buttons are identified according to the stored trajectory parameters. For example, the Quick Button at block 368 is assigned to a trajectory for propelling a series of balls 22 toward the third base player position 185 that will simulate a plurality of grounders. Additionally, the Quick Button at block 370 can be used to store trajectory parameters in the memory of the control system for every player position.

Figure 40G:
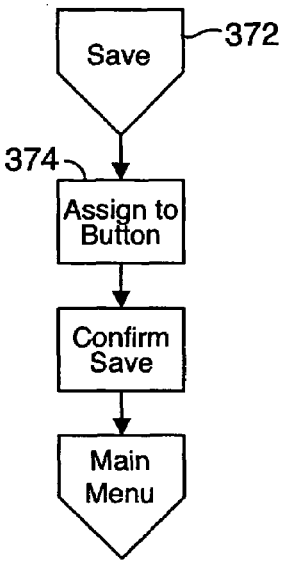

As shown in FIG. 40G, a Save feature (block 372) allows a user to save trajectory parameters for a plurality of balls 22, selected practice modes, as well as a portion of a practice session that include the trajectory parameters for a series of balls 22 to be propelled from the practice machine 10. The Save feature allows a user to assign a user control button (block 374) on the input device 40 or the keyboard 50 to a selected trajectory parameter or series thereof. By either selecting a series of trajectory parameters, or the trajectory parameters of only one ball 22, the save feature 372 allows a user to store preset conditions and trajectories for all aspects of a practice session.

Figure 41:
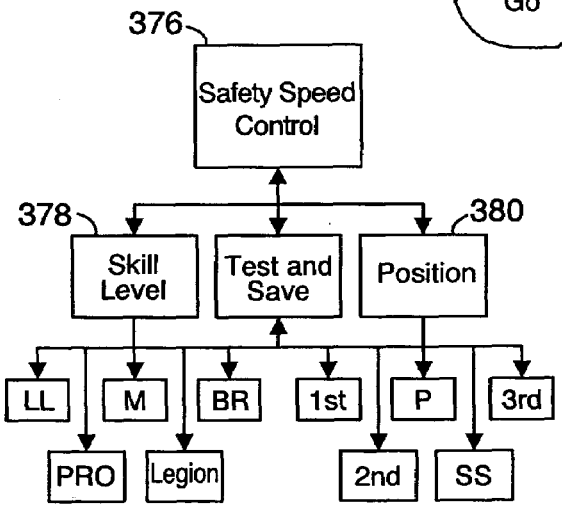
Figure 42:
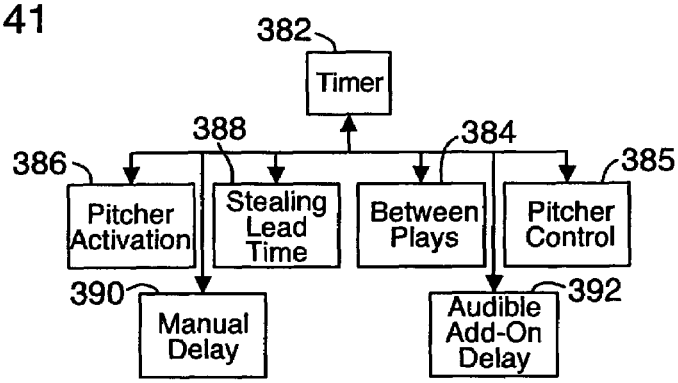

FIGS. 41 and 42 include flow charts illustrating certain embodiments of user options for initializing the start-up program 92 and for direct control of the control system 36. Referring to FIG. 41, at block 376, a safety speed control option allows a user to initialize the start-up program 92 according to skill levels (block 378) based on a level of play, and for personal data for each position player at block 380. The initialization data for safety and skill level inputs is discussed hereinabove with respect to the start-up program 92. In addition to initializing the start-up program 92, the safety and speed controls 376 are accessible to a user to update or revise speed and safety controls for the practice machine 10 at any time.

FIG. 42 includes a flow chart of one embodiment of a user interface for initializing the timers for the control system 36. The illustrated user interface for controlling the timers begins at block 382. A user can adjust and/or set the time lapse between successive balls 22 to be propelled from the practice machine 10 during a practice mode or session at block 384. Block 386 allows a user to adjust or set the time delay for propelling each ball 22 for practice sessions when the practice machine is used as a pitching machine. In one embodiment (block 385), a mock pitcher activates the practice machine 10 to propel a ball 22 in accordance with a practice mode using a switch or transmitter. At block 388, a timer can be initialized or adjusted for use in base stealing situations in the Catcher Throw 144 practice mode for simulating the amount of time between the beginning of a pitcher's pitching motion toward home plate and when a ball leaves a catcher's hand in a throw intended to throw out a base runner stealing a base. A manual delay timer can be initialized with a predetermined time at block 390. The manual delay timer can be used to delay a practice mode for the duration of the manual delay time preset by a user. The manual delay timer can be used to suspend the operation of the practice machine 10 during a practice mode for the purpose of instruction. An audible add-on delay option (block 392) also provides a user an option to activate a timer and causing the control system 36 to suspend the operation of a current practice mode for the duration of a preset time for an audible delay.

Figure 43:
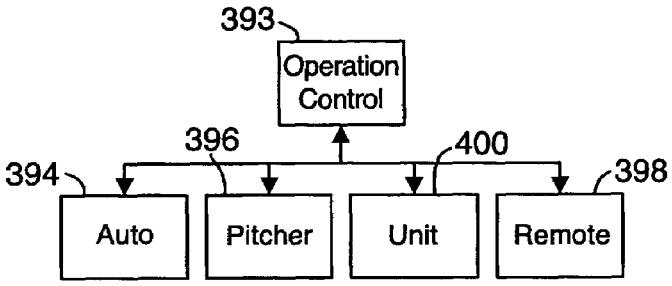
FIGS. 41–45 are flow charts representing user control options for direct control of the operation FIG. 1 practice machine.

FIG. 43 shows a flow chart representing one embodiment of a user interface for operational control of the practice machine 10. At block 393 a user can designate an input or activation device for communicating with the control system 36. The input device 40 mounted to the control panel 38 of the practice machine 10 is a default input device and is always operational. Additionally, as shown in FIG. 43, a user can select an automatic mode at block 394 allowing the practice machine 10 to operate selected programs automatically, a pitcher activation mode 396 wherein a mock pitcher activates the practice machine via a switch or at block 398 select to operate the practice machine 10 via the remote control device 44. At block 400, a user can designate the control panel 38 as the input device which may terminate the operation of all other input devices such as a pitcher remote activation unit or the remote control device 44.

Figure 44:
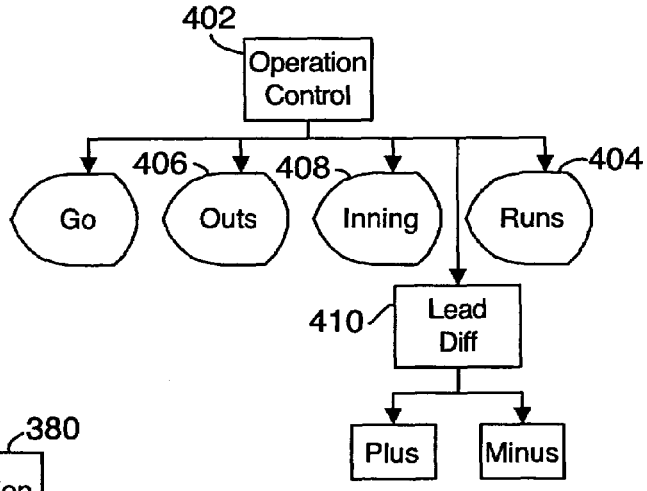

FIG. 44 is a flow chart representing one embodiment of a user interface for controlling the scoreboard 24. At block 402, the user can access a plurality of scoreboard controls wherein a user can set the indicators on the scoreboard as to the number of runners (block 404), outs (block 406) and the inning number (block 408). At block 410 scores are indicated using a run differential display indicating a simulated team's lead or deficit relative to the other teams score for defensive practice in any simulated game situation.

Figure 45:
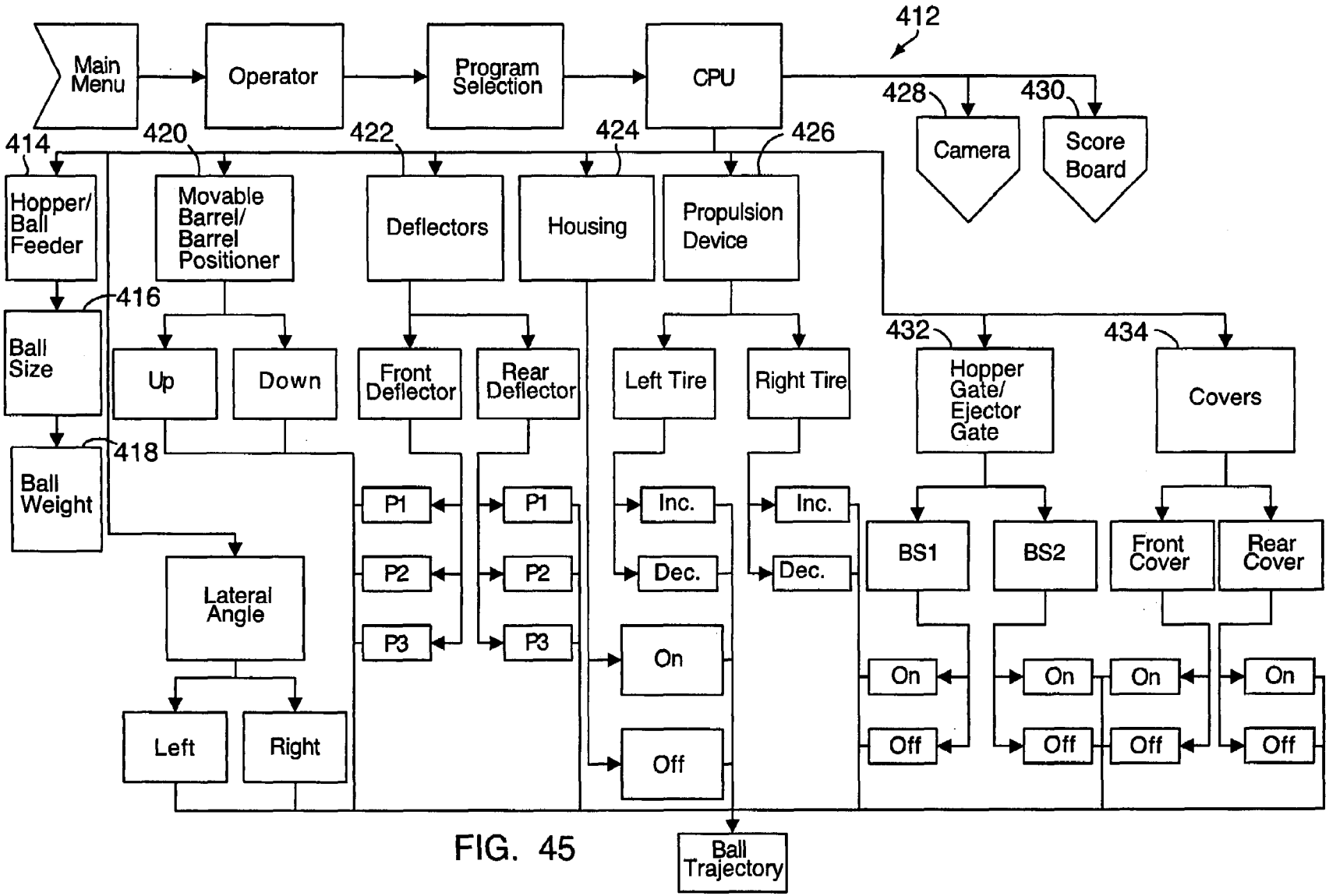

FIG. 45 is a flow chart illustrating a user interface for providing direct control and monitoring of the mechanical systems of the practice machine 10. As shown in FIG. 45 each of the systems of the practice machine 10 can be directly controlled and monitored by the user via the control system 36 and the operations interface referred to generally by the reference numeral 412.

For example, the ball hopper 32 and ball feeder 34 are accessible and controllable at block 414. The practice machine 10 is adjusted for a particular ball size and weight at blocks 416 and 418 respectively. At block 420, a user can access and control the movable barrel 18 and barrel positioner 57. The first and second deflectors 70 and 72 are accessed and controlled at block 422. User control of the housing 12 and leveler devices therefor is accessible at block 424. Block 426 shows a user interface for user access and control of the propulsion unit 16. Controls for the operation of the cameras 88 are shown at block 428. A user control device for the scoreboard 24 is shown at block 430. Block 432 represents a user control device for user control of the hopper gate 52 and ejector gate 59. A control device for the upper and lower openings in the housing 12 is shown at block 434.

The entire practice machine 10, including all of the components and systems thereof are controlled by the control system 36 and operable by a user from the control panel 38 and remote control device 44. Accordingly, the practice machine 10 provides a fully automated system for propelling balls 22 in a controlled manner to an entire baseball team positioned in a practice field 84.

The foregoing description of embodiments of the present invention baseball fielding practice machine have been presented for the purpose of illustration and description and are not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A baseball fielding practice machine for propelling balls onto a practice field thereby providing simulated hits for use in fielding practice for ball players, the practice machine comprising:

a ball hopper;

a propulsion unit for propelling a ball from the practice machine, the propulsion unit for imparting at least one of a velocity and a spin on a ball;

a ball feeder for transporting a ball between the ball hopper and the propulsion unit;

a movable barrel disposed adjacent to the propulsion unit through which a ball is propelled;

a barrel positioner coupled to the movable barrel for adjusting the position of the barrel thereby controlling the trajectory of a propelled ball;

a programmable control system coupled to the propulsion unit and the barrel positioner for controlling the propulsion unit and the barrel positioner to impart at least one of a velocity, trajectory and spin to a ball propelled from the practice machine toward an intended location in a practice field, the velocity, trajectory and spin selected from predetermined parameters defining the path of a propelled ball to a location in the practice field where a propelled ball is intended to land; and at least one deflector coupled to the movable barrel and the control system, the deflector for changing the trajectory of a propelled ball.

2. A baseball fielding practice machine for propelling balls onto a practice field thereby providing simulated hits for use in fielding practice for ball players, the practice machine comprising:

a ball hopper;

a propulsion unit for propelling a ball from the practice machine, the propulsion unit for imparting at least one of a velocity and a spin on a ball;

a ball feeder for transporting a ball between the ball hopper and the propulsion unit;

a movable barrel disposed adjacent to the propulsion unit through which a ball is propelled;

a barrel positioner coupled to the movable barrel for adjusting the position of the barrel thereby controlling the trajectory of a propelled ball;

a programmable control system coupled to the propulsion unit and the barrel positioner for controlling the propulsion unit and the barrel positioner to impart at least one of a velocity, trajectory and spin to a ball propelled from the practice machine toward an intended location in a practice field, the velocity, trajectory and spin selected from predetermined parameters defining the path of a propelled ball to a location in the practice field where a propelled ball is intended to land; and a scoreboard coupled to the control system for displaying a simulated game situation including at least one of a score, an inning number, a number of outs, and a location of any base runners.

3. A baseball fielding practice machine for propelling balls onto a practice field thereby providing simulated hits for use in fielding practice for ball players, the practice machine comprising:

a ball hopper;

a propulsion unit for propelling a ball from the practice machine, the propulsion unit for imparting at least one of a velocity and a spin on a ball;

a ball feeder for transporting a ball between the ball hopper and the propulsion unit;

a movable barrel disposed adjacent to the propulsion unit through which a ball is propelled;

a barrel positioner coupled to the movable barrel for adjusting the position of the barrel thereby controlling the trajectory of a propelled ball;

a programmable control system coupled to the propulsion unit and the barrel positioner for controlling the propulsion unit and the barrel positioner to impart at least one of a velocity, trajectory and spin to a ball propelled from the practice machine toward an intended location in a practice field, the velocity, trajectory and spin selected from predetermined parameters defining the path of a propelled ball to a location in the practice field where a propelled ball is intended to land; and wherein the movable barrel includes an end portion coupled to the control system and movable relative to the movable barrel such that an outer surface of the end portion engages a ball propelled from the propulsion unit and deflects the ball altering the trajectory thereof.

4. A baseball practice machine comprising:

a ball hopper;

a propulsion unit for propelling a ball from the practice machine;

a ball feeder for transporting a ball between the ball hopper and the propulsion unit;

a movable barrel disposed adjacent to the propulsion unit through which a propelled ball travels;

a barrel positioner coupled to the movable barrel for adjusting the position of the movable barrel and thereby controlling the trajectory of a propelled ball;

a control system coupled to the propulsion unit and the barrel positioner for controlling at least one of the velocity, trajectory and spin imparted to a propelled ball, the control system being operable in one of a plurality of selectable practice modes for controlling the operation of the practice machine;

a scoreboard coupled to the control system for displaying a simulated game situation defining at least one of a score, an inning number, a number of outs, and a location of any base runners;

whereby the practice machine is positionable on a practice field wherein balls propelled from the practice machine provide simulated hits for use in fielding practice for ball players in simulated game situations.

5. The baseball practice machine of claim 4 further comprising at least one deflector coupled to the movable barrel and the control system, the deflector for changing the trajectory of a propelled ball.

6. The baseball practice machine of claim 4 wherein the plurality of practice modes include at least one of a pre-programmed mode, a random mode, an infield mode, an outfield mode, a position player mode, a situational play mode, a tough-ones mode, a trajectory mode, and a catcher throwing mode.

7. The baseball practice machine of claim 4 wherein the control system includes an input device wherein at least one field dimension can be inputted to the control system and used to calculate at least one of the velocity and the trajectory of a propelled ball.

8. A baseball practice machine comprising:

a ball hopper;

a propulsion unit for propelling a ball from the practice machine;

a ball feeder for transporting a ball between the ball hopper and the propulsion unit;

a movable barrel coupled to the propulsion unit through which a propelled ball travels;

a barrel positioner coupled to the movable barrel for adjusting the trajectory of a propelled ball;

a control system coupled to the propulsion unit and the barrel positioner for controlling at least one of the velocity, trajectory and spin imparted to a propelled ball, the control system being operable in one of a plurality of selectable practice modes for controlling the operation of the practice machine, the control system having an input device wherein at least one field dimension of a practice field can be input and used to calculate at least one of the velocity and the trajectory of a propelled ball;

whereby the practice machine is positionable on the practice field wherein balls propelled from the practice machine provide simulated hits for use in fielding practice for ball players.

9. The baseball fielding practice machine of claim 8 wherein the control system includes an input device for inputting data to the control system.

10. The baseball fielding practice machine of claim 8 wherein the programmable control system includes a random mode in which the control system randomly selects trajectory parameters for propelling balls one after the other toward randomly selected locations in the practice field.

11. The baseball fielding practice machine of claim 8 wherein the programmable control system includes an infield mode in which the control system randomly selects trajectory parameters for propelling balls one after the other toward randomly selected locations in an infield of the practice field.

12. The baseball fielding practice machine of claim 8 wherein the programmable control system includes an outfield mode in which the control system randomly selects trajectory parameters for propelling balls one after the other toward randomly selected locations in an outfield of the practice field.

13. The baseball fielding practice machine of claim 8 wherein the programmable control system includes a position player mode in which the control system randomly selects trajectory parameters for propelling balls one after the other toward randomly selected locations in a predetermined area of the practice field designated to be within the range of a selected player position.

14. The baseball practice machine of claim 13 wherein the position player mode further comprises a backhand/forehand option, wherein a ball is propelled to a specific side of a selected position player.

15. The baseball fielding practice machine of claim 8 wherein the programmable control system includes a hit type mode in which the control system selects trajectory parameters for propelling balls one after the other depending on a selected hit type, the hit type selectable from at least one of grounder, line drive, pop-up and fly ball.

16. The baseball fielding practice machine of claim 8 wherein the programmable control system includes a tough play mode in which the control system selects trajectory parameters for propelling balls one after the other toward selected locations in the practice field between player positions.

17. The baseball fielding practice machine of claim 8 wherein the programmable control system includes a catcher throwing mode in which the control system selects trajectory parameters propelling a ball toward a selected base in the practice field simulating a throw of a catcher attempting to throw out a base runner stealing the selected base.

* * * * *